US006709809B2

(12) United States Patent
Yanagisawa et al.

(10) Patent No.: US 6,709,809 B2
(45) Date of Patent: Mar. 23, 2004

(54) SILVER SALT PHOTOTHERMOGRAPHIC DRY IMAGING MATERIAL

(75) Inventors: Hiroyuki Yanagisawa, Hino (JP); Socman Ho Kimura, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/885,952

(22) Filed: Jun. 21, 2001

(65) Prior Publication Data

US 2002/0028414 A1 Mar. 7, 2002

(30) Foreign Application Priority Data

Jun. 26, 2000 (JP) ..... 2000-191062
Sep. 5, 2000 (JP) ..... 2000-268559

(51) Int. Cl.[7] ..... G03C 1/498; G03C 1/295; G03C 1/34

(52) U.S. Cl. ..... 430/619; 430/264; 430/350; 430/601; 430/603; 430/611; 430/613; 430/614

(58) Field of Search ..... 430/601, 603, 430/611, 619, 264, 613, 614, 350

(56) References Cited

U.S. PATENT DOCUMENTS 5,236,821 A * 8/1993 Yagihara et al. ..... 430/600
5,656,419 A * 8/1997 Toya et al. ..... 430/619
5,804,362 A * 9/1998 Kuno et al. ..... 430/567
5,968,725 A 10/1999 Katoh et al.
5,985,508 A * 11/1999 Ito et al. ..... 430/264
6,025,122 A * 2/2000 Sakai et al. ..... 430/619
6,090,538 A * 7/2000 Arai et al. ..... 430/619
6,132,950 A * 10/2000 Ishigaki et al. ..... 430/619
6,297,001 B1 * 10/2001 Takiguchi et al. ..... 430/619
2001/0038977 A1 * 11/2001 Kato ..... 430/350

FOREIGN PATENT DOCUMENTS

EP 897130 2/1999

* cited by examiner

*Primary Examiner*—Thorl Chea
(74) *Attorney, Agent, or Firm*—Muserlian, Lucas and Mercanti

(57) ABSTRACT

A silver salt photothermographic material is disclosed, comprising at least a light sensitive layer and at least a light insensitive layer, the light sensitive layer comprising organic silver salt grains, a light sensitive emulsion containing light sensitive silver halide grains and medium, a reducing agent and a binder, wherein at least one of the light sensitive layer and the light insensitive layer contains a silver-saving agent and the photothermographic material which has been subjected to thermal development at 123° C. for 13.5 sec. exhibits an average contrast of 2.0 to 6.0 within the density range of 0.25 to 2.0 on a characteristic curve of the photothermographic material.

13 Claims, 1 Drawing Sheet

SILVER SALT PHOTOTHERMOGRAPHIC DRY IMAGING MATERIAL

FIELD OF THE INVENTION

The present invention related to silver salt photothermographic dry imaging materials exhibiting enhanced image quality and superior storage stability and in particular to black-and-white silver salt photothermographic dry imaging materials (hereinafter, also denoted as photothermographic imaging materials or simply as photothermographic materials), exhibiting enhanced image quality and superior silver image lasting property.

BACKGROUND OF THE INVENTION

In the field of graphic arts and medical treatment, there have been concerns in processing of photographic film with respect to effluents produced from wet-processing of image forming materials, and recently, reduction of the processing effluent is strongly demanded in terms of environmental protection and space saving. There has been desired a photothermographic material for photographic use, capable of forming distinct black images exhibiting high sharpness, enabling efficient exposure by means of a laser imager or a laser image setter.

Known as such a technique is a thermally developable photothermographic material which comprises on a support an organic silver salt, light sensitive silver halide grains, and reducing agent, as described in U.S. Pat. Nos. 3,152,904 and 3,487,075, and D. Morgan, "Dry Silver Photographic Materials" (Handbook of Imaging Materials, Marcel Dekker, Inc. page 48, 1991). In such photothermographic materials, no solution type processing chemicals is used, providing a simple and environment friendly system to users.

Usually, a photothermographic imaging material comprises a support provided thereon at least two functional layers comprised of an image forming layer and at least a protective layer. Silver salt photothermographic materials which are capable of forming a high density image at a relative low silver content are attractive to manufactures, for the amount of silver necessary for maintaining a given optical density is reduced, reducing the amount of emulsion used in coating, thereby reducing loads on coating and drying and enhancing productivity. Further, reduction of the silver amount enables cost savings of the photothermographic material. However, it is rather difficult to achieve reduction of the silver amount, while at the same time maintaining high photographic performance, so that a technique effective for improving it has been desired.

With regard to outputted images used for medical diagnosis, it has been supposed that more exact diagnostic observation results can be easily achieved with cold image tone. The cold image tone refers to pure black tone or bluish black tone and the warm image tone refers to a brownish black image exhibiting a warm tone.

Such a photothermographic material contains a reducible light-insensitive silver source (such as organic silver salts), a catalytically active amount of photocatalyst (such as silver halide) and a reducing agent, which are dispersed in a binder matrix. Such photothermographic materials are stable at ordinary temperature and, after exposure, form silver upon heating at a relatively high temperature (e.g., 80° C. or higher) through an oxidation reduction reaction between the reducible silver source (which functions as an oxidizing agent) and the reducing agent. The oxidation reduction reaction is accelerated by catalytic action of a latent image produced by the exposure. Silver formed through reaction of the reducible silver salt in exposed areas provides a black image, which contrasts with non-exposes areas, leading to image formation.

Antifoggants to minimizing fogging of images are optionally incorporated into the photothermographic material. As one of the most effective techniques for antifogging is cited incorporation of polyhalogenide compounds described in JP-A Nos. 9-160164, 9-244178, 9-258367, 9-265150, 9-281640 and 9-319022 (hereinafter, the term, JP-A means an unexamined, published Japanese Patent Application). However, problems arose with the application of such compounds to photothermographic imaging materials used in a laser imager for medical use, such that deteriorations in image aging stability, such as increased fogging after storage were noticed or a silver image tone changed to a yellowish warm tone. Known as a technique for improving image color tone is incorporation of a dye into a photothermographic material or a support. Image toning agents (or tone modifying agents) are also commonly known, as described in U.S. Pat. Nos. 4,132,282, 3,994,732, 3,846,136 and 4,021,249. However, such improvement means are insufficient for image tone for medical use and a further improvement is desired to enhance diagnosis levels, but effective improving technique is not achieved as yet.

SUMMARY OF THE INVENTION

In view of the foregoing, it is an object of the present invention to provide a photothermographic imaging material exhibiting enhanced image quality and superior image tone and image lasting property, while having a relatively low silver content, and an image recording method by the use of the same.

The object of the invention can be accomplished by the following constitution:

a silver salt photothermographic dry imaging material comprising a light sensitive layer and a light insensitive layer, the light sensitive layer comprising organic silver salt grains, a light sensitive emulsion containing light sensitive silver halide grains and a solvent, a reducing agent and a binder, characterized in that at least one of the light sensitive layer and the light insensitive layer contains a silver saving agent and an image obtained by thermal development at 123° C. for 13.5 sec. exhibits an average contrast of 2.0 to 6.0 within the diffuse density range of 0.25 to 2.0 on a characteristic curve represented on orthogonal coordinates in which a unit length of a diffuse density (Y-coordinate) and that of common logarithmic exposure (X-coordinate) are equivalent to each other.

Further, preferred embodiments of the silver salt photothermographic dry imaging material include (2) the material having a total silver amount of 0.7 to 1.2 per $m^2$ of the material, (3) comprising at least two light sensitive layers, (4) containing at least two compounds capable of generating a labile species capable of oxidizing silver or deactivating the reducing agent which is incapable of reducing silver ions of the organic silver salt, upon exposure to ultraviolet light or visible light, (5) the light sensitive layer being formed by using a coating solution to form the light sensitive layer, containing at least 30% by weight of water, (6) meeting the requirement of $190° < h_{ab} < 260°$, in which $h_{ab}$ is a hue angle (as defined in JIS-Z 8729) and (7) exhibiting a correlated color temperature of 5000 to 6000° K with respect to light transmitted through the photothermographic material film placed on a viewing box using a white fluorescent lamp.

Furthermore, when recording an image on the photothermographic dry imaging material, exposure is conducted preferably using a laser light scanning exposure machine (8) employing double beam scanning laser light or (9) longitudinal multiple laser scanning light.

EXPLANATION OF DESIGNATION

1 Support

2 Coating back-up roll

3 Coating die

4 Coating solution

P Pump

DETAILED DESCRIPTION OF THE INVENTION

Figure 1:
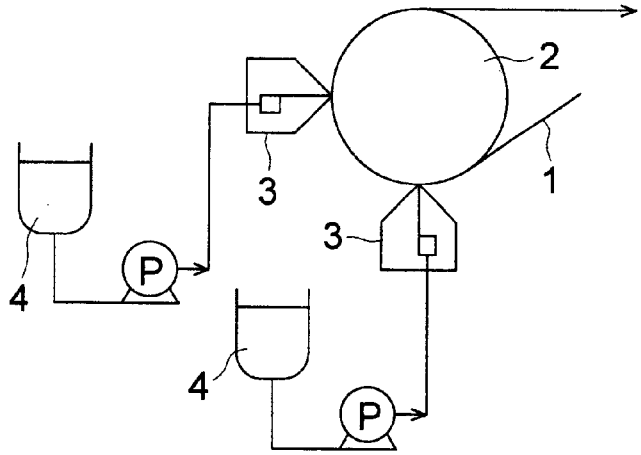
FIG. 1 illustrates a coating apparatus used in the invention.
Figure 2:
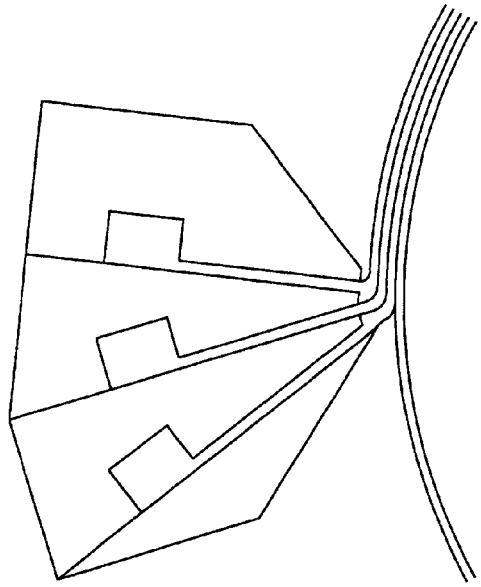
FIG. 2 illustrates an extrusion type die coater, in which coating solutions ejected from three slits are coated on a support.

In the invention the photothermographic material exhibits an average contrast of 2.0 to 6.0. Thus, when the photothermographic material is subjected to thermal development at 123° C. for 13.5 sec., the photothermographic material exhibits an average contrast of 2.0 to 6.0 within the density range of 0.25 to 2.0 on the characteristic curve of the photothermographic material. In the invention, the average contrast within the density range of 0.25 to 2.0 is defined as a slope of a straight line that connects two points corresponding to densities of 0.25 and 2.0 on the characteristic curve. The characteristic is commonly known in the art and also called a Hurter and Driffield curve (also denoted as H & D curve). This curve is obtained by plotting the density against the common logarithm of the exposure, where exposure E is determined by the product I·t of the light irradiance I and the time of action t.

The photothermographic imaging material according to the invention comprises a support provided thereon with at least one light sensitive layer. On the support, there may be provided the light sensitive layer alone but it is preferred that at least a light insensitive layer be further provided on the light sensitive layer. In one of preferred embodiments of the invention, at least two light sensitive layers are provided on one side of the support, or at least one light sensitive layer is provided on each of the both sides of the support. In this case, it is preferred that the two light sensitive layers contain different silver-saving agents. Further, it is also preferred that the light sensitive layers further contain an antifoggant or an image toning agent.

Plural functional layers can be provided on the support by a successive multi-layer coating system, in which coating and drying of each layer is repeated. Examples thereof include a roll coating system such as reverse roll coating and gravure roll coating, blade coating, wire-bar coating, and die coating. Using plural coaters, before drying the coated layer, the next layer is coated and the plural layers can also be simultaneously coated. Further, employing slide coating or curtain coating, plural coating solutions are layered on the slide surface and coated, as described in Stephen F. Kistler & M. Schweizer "LIQUID FILM COATING" (CHAPMAN & HALL, 1997). Extrusion coating is more preferred. Thus, the use of an extrusion type die coater lessens the open area, relative to the slide coating or curtain coating, leading to little variation in physical property of the coating solution, caused by vaporization of a solvent and enhancing the precision of coating layer formation. Simultaneous multi-layer coating of photothermographic imaging materials is detailed in JP-A No. 2000-015173.

The organic silver salts used in the invention are reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, ligand of which have a total stability constant to a silver ion of 4.0 to 10.0 are preferred. Exemplary preferred complex salts are described in RD17029 and RD29963, including organic acid salts (for example, salts of gallic acid, oxalic acid, behenic acid, stearic acid, palmitic acid, lauric acid, etc.); carboxyalkylthiourea salts (for example, 1-(3-carboxypropyl)thiourea, 1-(3-caroxypropyl)-3,3-dimethylthiourea, etc.); silver complexes of polymer reaction products of aldehyde with hydroxy-substituted aromatic carboxylic acid (for example, aldehydes such as formaldehyde, acetaldehyde, butylaldehyde), hydroxy-substituted acids (for example, salicylic acid, benzoic acid, 3,5-dihydroxybenzoic acid, 5,5-thiodisalicylic acid, silver salts or complexes of thiones (for example, 3-(2-carboxyethyl)-4-hydroxymethyl-4-(thiazoline-2-thione and 3-carboxymethyl-4-thiazoline-2-thione), complexes of silver with nitrogen acid selected from imidazole, pyrazole, urazole, 1.2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides. Of these organic silver salts, silver salts of fatty acids are preferred, and silver salts of behenic acid, arachidinic acid and/or stearic acid are specifically preferred. A mixture of two or more kinds of organic silver salts is preferably used, enhancing developability and forming silver images exhibiting relatively high density and high contrast. For example, preparation by adding a silver ion solution to a mixture of two or more kinds of organic acids is preferable.

The organic silver salt compound can be obtained by mixing an aqueous-soluble silver compound with a compound capable of forming a complex. Normal precipitation, reverse precipitation, double jet precipitation and controlled double jet precipitation, as described in JP-A 9-127643 are preferably employed. For example, to an organic acid can be added an alkali metal hydroxide (e.g., sodium hydroxide, potassium hydroxide, etc.) to form an alkali metal salt soap of the organic acid (e.g., sodium behenate, sodium arachidate, etc.), thereafter, the soap and silver nitrate are mixed by the controlled double jet method to form organic silver salt crystals. In this case, silver halide grains may be concurrently present.

Organic silver salt grains may be of almost any shape but are preferably tabular grains. Tabular organic silver salt grains are specifically preferred, exhibiting an aspect ratio of 3 or more and a needle form ratio of not less than 1.1 and less than 10.0 of a needle form ratio measured from the major face direction, thereby lessen anisotropy in shape of substantially parallel, two faces having the largest area (so-called major faces). The more preferred needle form ratio is not less than 1.1 and less than 5.0.

It is preferable that the tabular organic silver salt grains exhibiting an aspect ratio of 3 or more is contained in an amount of at least 50% by number of the total organic silver salt grains. The organic silver salt grains having an aspect ratio of 3 or more accounts for more preferably at least 60% by number, still more preferably at least 70% by number, and specifically preferably at least 80% by number. The tabular organic silver salt particle having an aspect ratio of 3 or more refers to an organic salt grain exhibiting a ratio of grain diameter to grain thickness, a so-called aspect ratio (also denoted as AR) of 3 or more, which is defined as below:

$$AR = \text{diameter } (\mu m)/\text{thickness } (\mu m)$$

wherein when an organic silver salt grain is approximated to be a rectangular parallelepiped, the diameter is the maximum edge length (also denoted as MX LNG) and the thickness is the minimum edge length (also denoted as MN LNG).

The aspect ratio of the tabular organic silver salt grain is preferably within the range of 3 to 20, and more preferably 3 to 10. In the case of an aspect ratio of less than 3, the organic salt particles easily form closest packing and in the case of the aspect ratio being excessively high, organic silver salt grains are easily superposed and dispersed in a coating layer in the form of being brought into contact with each other, easily causing light scattering and leading to deterioration in transparency of the photothermographic material.

The method for obtaining organic silver salt particles having a preferred form is not specifically limited but effective means are those which suitably maintain mixing at the time of forming an alkali metal salt soap of the organic acid or mixing at the time of adding silver nitrate to the soap or to optimally control the ratio of silver nitrate to the soap.

The photothermographic imaging material relating to the invention is obtained preferably by coating a light sensitive emulsion containing a light sensitive silver halide and organic silver salt grains in which organic silver salt grains exhibiting a grain projected area of less than 0.025 $\mu m^2$ account for at least 70% of the total grain projected area and organic silver salt grains exhibiting a grain projected area of 0.2 $\mu m^2$ or more accounts for not more than 10% of the total grain projected area when observing the section vertical to the support by an electron microscope. In such a case, coagulation of organic silver salt grains in the light sensitive emulsion is prevented, achieving homogeneous distribution of the grains. The condition for preparation of the light sensitive emulsion having such a feature is not specifically limited but it is preferred that the mixing state at the time of forming an alkali metal soap of an organic acid and/or the mixing state at the time of adding silver nitrate to the soap are optimally maintained, the proportion silver nitrate to be reacted with the soap is optimized, and the emulsion is dispersed or pulverized using a media type dispersing machine or high pressure homogenizer, in which a binder is added preferably in an amount of 0.1 to 10% by weight of the organic silver salt, the temperature until completion of drying and the final dispersion is preferably not more than 45° C. and stirring at the time of the emulsion preparation is conducted preferably using a dissolver at a circumferential speed of not less than 2.0 m/sec.

Light sensitive silver halide grains used in the invention will be described. The light sensitive silver halide grains used in the invention refers to silver halide crystal grains which have been treated and prepared so as to be capable of absorbing visible or infrared light and causing physico-chemical changes in the interior of and/or on the surface of the silver halide crystal when absorbing the visible or infrared light, essentially as a inherent property of a silver halide crystal or artificially by the physico-chemical method.

The silver halide grains used in the invention can be prepared according to the methods described in P. Glafkides, Chimie Physique Photographique (published by Paul Montel Corp., 19679; G. F. Duffin, Photographic Emulsion Chemistry (published by Focal Press, 1966); V. L. Zelikman et al., Making and Coating of Photographic Emulsion (published by Focal Press, 1964). Any one of acidic precipitation, neutral precipitation and ammoniacal precipitation is applicable and the reaction mode of aqueous soluble silver salt and halide salt includes single jet addition, double jet addition and a combination thereof. Specifically, preparation of silver halide grains with controlling the grain formation condition, so-called controlled double-jet precipitation is preferred. The halide composition of silver halide is not specifically limited and may be any one of silver chloride, silver chlorobromide, silver iodochlorobromide, silver bromide, silver iodobromide and silver iodide.

In order to minimize cloudiness after image formation and to obtain excellent image quality, the less the average grain size, the more preferred, and the average grain size is preferably not more than 0.2 $\mu m$, more preferably between 0.01 and 0.17 $\mu m$, and still more preferably between 0.02 and 0.14 $\mu m$. The average grain size as described herein is defined as an average edge length of silver halide grains, in cases where they are so-called regular crystals in the form of cube or octahedron. Furthermore, in cases where grains are tabular grains, the grain size refers to the diameter of a circle having the same area as the projected area of the major faces. Furthermore, silver halide grains are preferably monodisperse grains. The monodisperse grains as described herein refer to grains having a coefficient of variation of grain size obtained by the formula described below of not more than 7%; more preferably not more than 5%, still more preferably not more than 3%, and most preferably not more than 1%.

$$\text{Coefficient of variation of grain size} = \text{standard deviation of grain diameter}/\text{average grain diameter} \times 100(\%)$$

The grain form can be of almost any one, including cubic, octahedral or tetradecahedral grains, tabular grains, spherical grains, bar-like grains, and potato-shaped grains. Of these, cubic grains, octahedral grains, tetradecahedral grains and tabular grains are specifically preferred.

The aspect ratio of tabular grains is preferably 1.5 to 100, and more preferably 2 to 50. These grains are described in U.S. Pat. Nos. 5,264,337, 5,314,798 and 5,320,958 and desired tabular grains can be readily obtained. Silver halide grains having rounded corners are also preferably employed.

Crystal habit of the outer surface of the silver halide grains is not specifically limited, but in cases when using a spectral sensitizing dye exhibiting crystal habit (face) selectivity in the adsorption reaction of the sensitizing dye onto the silver halide grain surface, it is preferred to use silver halide grains having a relatively high proportion of the crystal habit meeting the selectivity. In cases when using a sensitizing dye selectively adsorbing onto the crystal face of a Miller index of [100], for example, a high ratio accounted for by a Miller index [100] face is preferred. This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized.

It is preferred to use low molecular gelatin having an average molecular weight of not more than 50,000 in the preparation of silver halide grains used in the invention, specifically, in the stage of nucleation. Thus, the low molecular gelatin has an average molecular eight of not more than 50,000, preferably 2,000 to 40,000, and more preferably 5,000 to 25,000. The average molecular weight can be determined by means of gel permeation chromatography. The low molecular gelatin can be obtained by subjecting an aqueous gelatin conventionally used and having an average molecular weight of ca. 100,000 to enzymatic hydrolysis, acid or alkali hydrolysis, thermal degradation at atmospheric pressure or under high pressure, or ultrasonic degradation.

The concentration of dispersion medium used in the nucleation stage is preferably not more than 5% by weight, and more preferably 0.05 to 3.0% by weight.

In the preparation of silver halide grains, it is preferred to use a compound represent by the following formula, specifically in the nucleation stage:

$$YO(CH_2CH_2O)m(C(CH_3)CH_2O)p(CH_2CH_2O)nY$$

where Y is a hydrogen atom, —$SO_3M$ or —CO—B—COOM, in which M is a hydrogen atom, alkali metal atom, ammonium group or ammonium group substituted by an alkyl group having carbon atoms of not more than 5, and B is a chained or cyclic group forming an organic dibasic acid; m and n each are 0 to 50; and p is 1 to 100. Polyethylene oxide compounds represented by foregoing formula have been employed as a defoaming agent to inhibit marked foaming occurred when stirring or moving emulsion raw materials, specifically in the stage of preparing an aqueous gelatin solution, adding a water-soluble silver and halide salts to the aqueous gelatin solution or coating an emulsion on a support during the process of preparing silver halide photographic light sensitive materials. A technique of using these compounds as a defoaming agent is described in JP-A No. 44-9497. The polyethylene oxide compound represented by the foregoing formula also functions as a defoaming agent during nucleation.

The compound is used preferably in an amount of not more than 1%, and more preferably 0.01 to 0.1% by weight, based on silver.

Silver halide may be incorporated into an image forming layer by any means, in which silver halide is arranged so as to be as close to reducible silver source as possible. It is general that silver halide, which has been prepared in advance, added to a solution used for preparing an organic silver salt. In this case, preparation of silver halide and that of an organic silver salt are separately performed, making it easier to control the preparation thereof. Alternatively, as described in British Patent 1,447,454, silver halide and an organic silver salt can be simultaneously formed by allowing a halide component to be present together with an organic silver salt-forming component and by introducing silver ions thereto.

Silver halide can also be prepared by reacting a halogen containing compound with an organic silver salt through conversion of the organic silver salt. Thus, a silver halide-forming component is allowed to act onto a pre-formed organic silver salt solution or dispersion or a sheet material containing an organic silver salt to convert a part of the organic silver salt to photosensitive silver halide.

The silver halide-forming components include inorganic halide compounds, onium halides, halogenated hydrocarbons, N-halogeno compounds and other halogen containing compounds. These compounds are detailed in U.S. Pat. Nos. 4,009,039, 3,457,075 and 4,003,749, British Patent 1,498,956 and JP-A 53-27027 and 53-25420. Exemplary examples thereof include inorganic halide compound such as a metal halide and ammonium halide; onium halides, such as trimethylphenylammonium bromide, cetylethyldimethylammonium bromide, and trimethylbenzylammonium bromide; halogenated hydrocarbons, such as iodoform, bromoform, carbon tetrachloride and 2-brom-2-methylpropane; N-halogeno compounds, such as N-bromosucciimde, N-bromophthalimide, ans N-bromoacetoamide; and other halogen containing compounds, such as triphenylmethyl chloride, triphenylmethyl bromide, 2-bromoacetic acid, 2-bromoethanol and dichlorobenzophenone. As described above, silver halide can be formed by converting a part or all of an organic silver salt to silver halide through reaction of the organic silver salt and a halide ion. The silver halide separately prepared may be used in combination with silver halide prepared by conversion of at least apart of an organic silver salt. The silver halide which is separately prepared or prepared through conversion of an organic silver salt is used preferably in an amount of 0.001 to 0.7 mol, and more preferably 0.03 to 0.5 mol per mol of organic silver salt.

Silver halide used in the invention preferably occludes ions of metals belonging to Groups 6 to 11 of the Periodic Table. Preferred as the metals are W; Fe, Co, Ni, Cu, Ru, Rh, Pd, Re, Os, Ir, Pt and Au. These metals may be introduced into silver halide in the form of a complex. In the present invention, regarding the transition metal complexes, six-coordinate complexes represented by the general formula described below are preferred:

Formula: $(ML_6)^m$:

wherein M represents a transition metal selected from elements in Groups 6 to 11 of the Periodic Table; L represents a coordinating ligand; and m represents 0, 1-, 2-, 3- or 4-. Exemplary examples of the ligand represented by L include halides (fluoride, chloride, bromide, and iodide), cyanide, cyanato, thiocyanato, selenocyanato, tellurocyanato, azido and aquo, nitrosyl, thionitrosyl, etc., of which aquo, nitrosyl and thionitrosyl are preferred. When the aquo ligand is present, one or two ligands are preferably coordinated. L may be the same or different.

Exemplary examples of transition metal ligand complexes are shown below:

1: $[RhCl_6]^{3-}$
2: $[RuCl_6]^{3-}$
3: $[ReCl_6]^{3-}$
4: $[RuBr_6]^{3-}$
5: $[OsCl_6]^{3-}$
6: $[CrCl_6]^{4-}$
7: $[IrCl_6]^{4-}$
8: $[IrCl_6]^{3-}$
9: $[Ru(NO)Cl_5]^{2-}$
10: $[RuBr_4(H_2O)]^{2-}$
11: $[Ru(NO)(H_2O)Cl_4]^{-}$
12: $[RhCl_5(H_2O)]^{2-}$
13: $[Re(NO)Cl_5]^{2-}$
14: $[Re(NO)(CN)_5]^{2-}$
15: $[Re(NO)Cl(CN)_4]^{2-}$
16: $[Rh(NO)_2Cl_4]-$
17: $[Rh(NO)(H_2O)Cl_4]^{-}$
18: $[Ru(NO)(CN)_5]^{2-}$
19: $[Fe(CN)_6]^{3-}$
20: $[Rh(NS)Cl_5]^{2-}$
21: $[Os(NO)Cl_5]^{2-}$
22: $[Cr(NO)Cl_5]^{2-}$
23: $[Re(NO)Cl_5]^{-}$
24: $[Os(NS)Cl_4(TeCN)]^{2-}$
25: $[Ru(NS)Cl_5]^{2-}$
26: $[Re(NS)Cl_4(SeCN)]^{2-}$

27: $[Os(NS)Cl(SCN)_4]^{2-}$

28: $[Ir(NO)Cl_5]^{2-}$;

and with regard to cobalt or iron compounds, hexacyano cobalt or iron complexes are preferably used and exemplary examples thereof are shown below:

29: $[Fe(CN)_6]^{4-}$

30: $[Fe(CN)_6]^{3-}$

31: $[Co(CN)_6]^{3-}$.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation. These compounds may be added several times by dividing the added amount. Uniform content in the interior of a silver halide grain can be carried out. As disclosed in JP-A No. 63-29603, 2-306236, 3-167545, 4-76534, 6-110146, 5-273683, the metal can be distributively occluded in the interior of the grain.

These metal compounds can be dissolved in water or a suitable organic solvent (e.g., alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

Silver halide grain emulsions used in the invention may be desalted after the grain formation, using the methods known in the art, such as the noodle washing method and flocculation process.

The silver-saving agent used in the invention refers to a compound capable of reducing the silver amount necessary to obtain a prescribed silver density. The action mechanism for the reducing function has been variously supposed and compounds having a function of enhancing covering power of developed silver are preferred. Herein the covering power of developed silver refers to an optical density per unit amount of silver. Examples of the preferred silver-saving agent include hydrazine derivative compounds represented by the following formula [H], vinyl compounds represented by formula (G) and quaternary onium compounds represented by formula (P):

formula [H]

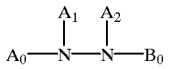

formula (G)

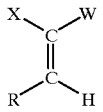

formula (P)

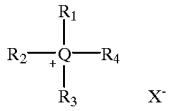

In formula [H], $A_0$ is an aliphatic hydrocarbon group, aromatic hydrocarbon group, heterocyclic group, each of which may be substituted, or —$G_0$—$D_0$ group; $B_0$ is a blocking group; $A_1$ and $A_2$ are both hydrogen atoms, or one of them is a hydrogen atom and the other is an acyl group, a sulfonyl group or an oxalyl group, in which $G_0$ is a —CO—, —COCO—, —CS—, —C(=$NG_1D_1$)—, —SO—, —$SO_2$— or —P(O)($G_1D_l$)— group, in which $G_1$ is a bond, or a —O—, —S— or —N($D_1$)— group, in which $D_1$ is a hydrogen atom, or an aliphatic group, aromatic group or heterocyclic group, and Do is a hydrogen atom, an aliphatic group, aromatic group, heterocyclic group, amino group, alkoxy group, aryloxy group, alkylthio group or arylthio group; and preferred; and the preferred $D_0$ is a hydrogen atom, an alkyl group, alkoxy group or an amino group.

In formula (H), an aliphatic group represented by $A_0$ of formula (H) is preferably one having 1 to 30 carbon atoms, more preferably a straight-chained, branched or cyclic alkyl group having 1 to 20 carbon atoms. Examples thereof are methyl, ethyl, t-butyl, octyl, cyclohexyl and benzyl, each of which may be substituted by a substituent (such as an aryl, alkoxy, aryloxy, alkylthio, arylthio, sulfooxy, sulfonamido, sulfamoyl, acylamino or ureido group).

An aromatic group represented by $A_0$ of formula (H) is preferably a monocyclic or condensed-polycyclic aryl group such as a benzene ring or naphthalene ring. A heterocyclic group represented by $A_0$ is preferably a monocyclic or condensed-polycyclic one containing at least one heteroatom selected from nitrogen, sulfur and oxygen such as a pyrrolidine-ring, imidazole-ring, tetrahydrofuran-ring, morpholine-ring, pyridine-ring, pyrimidine-ring, quinoline-ring, thiazole-ring, benzthiazole-ring, thiophene-ring or furan-ring. The aromatic group, heterocyclic group or —$G_0$—$D_0$ group represented by $A_0$ each may be substituted. Specifically preferred $A_0$ is an aryl group or —$G_0$—$D_0$ group.

$A_0$ contains preferably a non-diffusible group or a group for promoting adsorption to silver halide. As the non-diffusible group is preferable a ballast group used in immobile photographic additives such as a coupler. The ballast group includes an alkyl group, alkenyl group, alkynyl group, alkoxy group, phenyl group, phenoxy group and alkylphenoxy group, each of which has 8 or more carbon atoms and is photographically inert.

The group for promoting adsorption to silver halide includes a thioureido group, thiourethane, mercapto group, thioether group, thione group, heterocyclic group, thioamido group, mercapto-heterocyclic group or a adsorption group as described in JP A 64-90439.

In Formula (H), $B_0$ is a blocking group, and preferably —$G_0$—$D_0$, wherein $G_0$ is a —CO—, —COCO—, —CS—, —C(=NG$_1$D$_1$)—, —SO—, —SO$_2$— or —P(O)(G$_1$D$_l$)— group, and preferred G$_0$ is a —CO—, —COCOA—, in which G$_1$ is a linkage, or a —O—, —S— or —N(D$_1$)— group, in which D$_1$ represents a hydrogen atom, or an aliphatic group, aromatic group or heterocyclic group, provided that when a plural number of D$_1$ are present, they may be the same with or different from each other. D$_0$ is an aliphatic group, aromatic group, heterocyclic group, amino group, alkoxy group or mercapto group, and preferably, a hydrogen atom, or an alkyl, alkoxy or amino group. A$_1$ and A$_2$ are both hydrogen atoms, or one of them is a hydrogen atom and the other is an acyl group, (acetyl, trifluoroacetyl and benzoyl), a sulfonyl group (methanesulfonyl and toluenesulfonyl) or an oxalyl group (ethoxaly).

More preferred hydrazine compounds are represented by the following formulas (H-1), (H-2), (H-3) and (H-4):

formula (H-1)

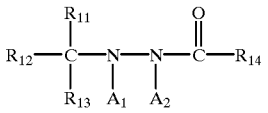

formula (H-2)

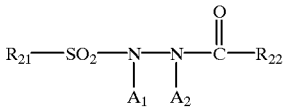

formula (H-3)

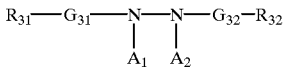

formula (H-4)

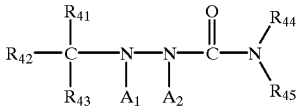

In formula (H-1), R$_{11}$, R$_{12}$ and R$_{13}$ are each a substituted or unsubstituted ary group or substituted or unsubstituted heteroary group (i.e., an aromatic heterocyclic group). Examples of the aryl group represented by R$_{11}$, R$_{12}$ or R$_{13}$ include phenyl, p-methylphenyl and naphthyl and examples of the heteroaryl group include a triazole residue, imidazole residue, pyridine residue, furan residue and thiophene residue. R$_{11}$, R$_{12}$ or R$_{13}$ may combine together with each other through a linkage group. Substituents which R$_{11}$, R$_{12}$ or R$_{13}$ each may have include, for example, an alkyl group, an alkenyl group, an alkynyl group, an aryl group, a heterocyclic group, a quaternary nitrogen containing heterocyclic group (e.g., pyridionyl), hydroxy, an alkoxy group (including containing a repeating unit of ethyleneoxy or propyleneoxy), an aryloxy group, an acyloxy group, an acyl group, an alkoxycarbonyl group, an aryloxycarbonyl group, a carbamoyl group, a urethane group, carboxy, an imodo group, an amino group, a carbonamido group, a sulfonamido group, a ureido group, a thioureido group, a sulfamoylamino group, semicarbazido group, thiosemocarbaido group, hydrazine group, a quaternary ammonio group, an alkyl-, aryl- or heterocyclicthio group, mercapto group, an alkyl- or aryl-sufonyl group, an alkyl- or aryl-sulfinyl group, sulfo group, sulfamoyl group, an acylsufamoyl group, an alkyl or aryl-sulfonylureido group, an alkyl- or aryl-sulfonylcarbamoyl group, a halogen atom, cyano, nitro, and phosphoric acid amido group. All of R$_{11}$, R$_{12}$ and R$_{13}$ are preferably phenyl groups and more preferably unsubstituted phenyl groups.

R$_{14}$ is heterocyclic-oxy group or a heteroarylthio group. Examples of the heteroaryl group represented by R$_{14}$ include a pyridyloxy group, benzimidazolyl group, benzothiazolyl group, benzimidazolyloxy group, furyloxy group, thienyloxy group, pyrazolyloxy group, and imidazolyloxy group; and examples of the the heteroarylthio group include a pyridylthio group, pyrimidylthio group, indolylthio group, benzothiazolylthio, benzoimidazolylthio group, furylthio group, thienylthio group, pyrazolylthio group, and imidazolylthio group. R$_{14}$ is preferably a pyridyloxy or thenyloxy group.

A$_1$ and A$_2$ are both hydrogen atoms, or one of them is a hydrogen atom and the other is an acyl group (e.g., acetyl, trifluoroacetyl, benzoyl, etc.), a sulfonyl (e.g., methanesulfonyl, toluenesulfonyl, etc.), or oxalyl group (e.g., ethoxalyl, etc.). A$_1$ and A$_2$ are both preferably hydrogen atoms.

In formula (H-2), R$_{21}$ is a substituted or unsubstituted alkyl group, aryl group or heteroaryl group. Examples of the alkyl group represented by R$_{21}$ include methyl, ethyl, t-butyl, 2-octyl, cyclohexyl, benzyl, and diphenylmethyl; the aryl group, the heteroaryl group and the substituent groups are the same as defined in R$_{11}$, R$_{12}$ and R$_{13}$. In cases where R$_{21}$ is substituted, the substituent groups are the same as defined in R$_{11}$, R$_{12}$ and R$_{13}$. R$_{21}$ is preferably an aryl group or a heterocyclic group, and more preferably a phenyl group.

R$_{22}$ is a hydrogen atom, an alkylamino group, an arylamino group, or heteroarylamino group. Examples thereof include methylamino, ethylamino, propylamino, butylamino, dimethylamino, diethylamino, and ethylmethylamino. Examples of the arylamino group include an anilino group; examples of the heteroaryl group include thiazolylamino, benzimidazolylamino and benzthiazolylamino. R$_{22}$ is preferably dimethylamino or diethylamino. A$_1$ and A$_2$ are the same as defined in formula (H-1).

In formula (H-3), R$_{31}$ and R$_{32}$ are each a univalent substituent group and the univalent substituent groups represented by R$_{31}$ and R$_{32}$ are the same as defined in R$_{11}$, R$_{12}$, and R$_{13}$ of formula (H-1), preferably an alkyl group, an aryl group, a heteroaryl group, an alkoxy group and an amino group, more preferably an aryl group or an alkoxy group, and specifically preferably, at least one of R$_{31}$ and R$_{32}$ t-butoxy and another preferred structure is that when R$_{31}$ is phenyl, R$_{32}$ is t-butoxycarbonyl. G$_{31}$ and G$_{32}$ are each a —(CO)p- or —C(=S)— group, a sulfonyl group, a sulfoxy group, a —P(=O)R$_{33}$— group, or an iminomethylene group, in which R$_{33}$ is an alkyl group, an alkenyl group, an alkynyl group, an aryl group, an alkoxy group, an alkenyloxy group, an alkynyloxy group, an arylamino group or an amino group, provided that when G$_{31}$ is a sulfonyl group, G$_{32}$ is not a carbonyl group. G$_{31}$ and G$_{32}$ are preferably —CO—, —COCO—, a sulfonyl group or —CS—, and more preferably —CO— or a sulfonyl group. A$_1$ and A$_2$ are the same as defined in A$_1$ and A$_2$ of formula (H-1).

In formula (H-4), R$_{41}$, R$_{42}$ and R$_{43}$ are the same as defined in R$_{11}$, R$_{12}$ and R$_{13}$. R$_{41}$, R$_{42}$ and R$_{43}$ are preferably substituted or unsubstituted phenyl group, and more preferably all of R$_{41}$, R$_{42}$ and R$_{43}$ are an unsubstituted phenyl group. R$_{44}$ and R$_{45}$ are each an unsubstituted alkyl group and examples thereof include methyl, ethyl, t-butyl, 2-octyl, cyclohexyl, benzyl, and diphenylmethyl. R$_{44}$ and R$_{45}$ are preferably ethyl. A$_1$ and A$_2$ are the same as defined in A$_1$ and A$_2$ of formula (H-1).

The compounds of formulas (H-1) through (H-4) can be readily synthesized in accordance with methods known in the art, as described in, for example, U.S. Pat. Nos. 5,467,738 and 5,496,695.

Furthermore, preferred hydrazine derivatives include compounds H-1 through H-29 described in U.S. Pat. No. 5,545,505, col. 11 to col. 20; and compounds 1 to 12 described in U.S. Pat. No. 5,464,738, col. 9 to col. 11. These hydrazine derivatives can be synthesized in accordance with commonly known methods.

In formula (G), X and R may be either cis-form or trans-form. The structure of its exemplary compounds is also similarly included.

In formula (G), X is an electron-with drawing group; W is a hydrogen atom, an alkyl group, alkenyl group, an alkynyl group, an aryl group, a heterocyclic group, a halogen atom, an acyl group, a thioacyl group, an oxalyl group, an oxyaxalyl group, a thiooxalyl group, an oxamoyl group, an oxycarbonyl group, a thiocarbonyl group, a carbamoyl group, a thiocarbamoyl group, a sulfonyl group, a sulfinyl group, an oxysulfinyl group, a thiosulfinyl group, a sulfamoyl group, a sulfinamoyl group, a phosphoryl group, nitro group, an imino group, a N-carbonylimino group, a N-sulfonylimino group, a dicyanoethylene group, an ammonium group, a sulfonium group, a phosphonium group, pyrylium group, or an inmonium group.

R is a halogen atom, hydroxy, an alkoxy group, an aryloxy group, a heterocyclic-oxy group, an alkenyloxy group, an acyloxy group, an alkoxycarbonyloxy group, an aminocarbonyloxy group, a mercapto group, an alkylthio group, an arylthio group, a heterocyclic-thio group, an alkenylthio group, an acylthio group, an alkoxycarbonylthio group, an aminocarbonylthio group, an organic or inorganic salt of hydroxy or mercapto group (e.g., sodium salt, potassium salt, silver salt, etc.), an amino group, a cyclic amino group (e.g., pyrrolidine), an acylamino group, anoxycarbonylamino group, a heterocyclic group (5- or 6-membered nitrogen containing heterocyclic group such as benztriazolyl, imidazolyl, triazolyl, or tetrazolyl), a ureido group, or a sulfonamido group. X and W, or X and R may combine together with each other to form a ring. Examples of the ring formed by X and W include pyrazolone, pyrazolidinone, cyclopentadione, β-ketolactone, and β-ketolactam.

In formula (G), the electron-withdrawing group represented by X refers to a substituent group exhibiting a negative Hammett's substituent constant σp. Examples thereof include a substituted alkyl group (e.g., halogen-substituted alkyl, etc.), a substituted alkenyl group (e.g., cyanoalkenyl, etc.), a substituted or unsubstituted alkynyl group (e.g., trifluoromethylacetylenyl, cyanoacetylenyl, etc.), a substituted or unsubstituted heterocyclic group (e.g., pyridyl, triazyl, benzoxazolyl, etc.), a halogen atom, an acyl group (e.g., acetyl, trifluoroacetyl, formyl, etc.), thioacetyl group (e.g., thioacetyl, thioformyl, etc.), an oxalyl group (e.g., methyloxalyl, etc.), an oxyoxalyl group (e.g., ethoxalyl, etc.), a thiooxalyl group (e.g., ethylthiooxalyl, etc.), an oxamoyl group (e.g., methyloxamoyl, etc.), an oxycarbonyl group (e.g., ethoxycarbonyl, etc.), carboxy group, a thiocarbonyl group (e.g., ethylthiocarbonyl, etc.), a carbamoyl group, a thiocarbamoyl group, a sulfonyl group, a sulfinyl group, an oxysulfonyl group (e.g., ethoxysulfonyl), a thiosulfonyl group (e.g., ethylthiosulfonyl, etc.), a sulfamoyl group, an oxysulfinyl group (e.g., methoxysulfinyl, etc.), a thiosulfinyl (e.g., methylthiosulfinyl, etc.), a sulfinamoyl group, phosphoryl group, a nitro group, an imino group, N-carbonylimino group (e.g., N-acetylimino, etc.), a N-sulfonylimino group (e.g., N-methanesufonylimono, etc.), a dicynoethylene group, an ammonium group, a sulfonnium group, a phophonium group, pyrilium group and inmonium group and further including a group of a heterocyclic ring formed by an ammonium group, sulfonium group, phosphonium group or immonium group. Of these group, groups exhibiting σp of 0.3 or more are specifically preferred.

Examples of the alkyl group represented by W include methyl, ethyl and trifluoromethyl; examples of the alkenyl include vinyl, halogen-substituted vinyl and cyanovinyl; examples of the aryl group include nitrophenyl, cyanophenyl, and pentafluorophenyl; and examples of the heterocyclic group include pyridyl, pyrimidyl, triazinyl, succinimido, tetrazolyl, triazolyl, imidazolyl, and benzoxazolyl. The group, as W, exhibiting positive σp is preferred and the group exhibiting σp of 0.3 or more is specifically preferred.

Of the groups represented by R, a hydroxy group, a mercapto group, an alkoxy group, an alkylthio group, a halogen atom, an organic or inorganic salt of a hydroxy or mercapto group and a heterocyclic group are preferred, and a hydroxy group, a mercapto group and an organic or inorganic salt of a hydroxy or mercapto group are more preferred.

Of the groups of X and W, the group having a thioether bond is preferred.

In formula (P), Q is a nitrogen atom or a phosphorus atom; $R_1$, $R_2$, $R_3$ and $R_4$ each are a hydrogen atom or a substituent group, provided that at least two of $R_1$, $R_2$, $R_3$ and $R_4$ may combine together with each other to form a ring; and $X^-$ is an anion.

Examples of the substituent group represented by $R_1$, $R_2$, $R_3$ and $R_4$ include an alkyl group (e.g., methyl, ethyl, propyl, butyl, hexyl, cyclohexyl), an alkenyl group (e.g., allyl, butenyl), an alkynyl group (e.g., propargyl, butynyl), an ryl group (e.g., phenyl, naphthyl), heterocyclic group (e.g., piperidyl, piperazinyl, morpholinyl, pyridyl, furyl, thienyl, tetrahydrofuryl, tetrahydrothienyl, sulforanyl), and an amino group. Examples of the ring formed by $R_1$, $R_2$, $R_3$ and $R_4$ include a piperidine ring, morpholine ring, piperazine ring, pyrimidine ring, pyrrole ring, imidazole ring, triazole ring and tetrazole ring. The group represented by $R_1$, $R_2$, $R_3$ and $R_4$ may be further substituted by a hydroxy group, alkoxy group, aryloxy group, carboxy group, sulfo group, alkyl group or aryl group. Of these, $R_1$, $R_2$, $R_3$ and $R_4$ are each preferably a hydrogen atom or an alkyl group. Examples of the anion of $X^-$ include a halide ion, sulfate ion, nitrate ion, acetate ion and p-toluenesulfonic acid ion.

Further, quaternary onium salt compounds usable in the invention include compounds represented by formulas (Pa), (Pb) and (Pc), or formula (T):

formula (Pa)

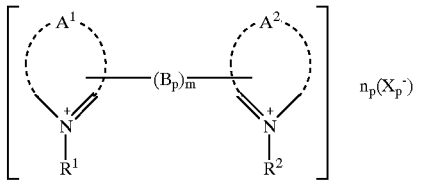

formula (Pb)

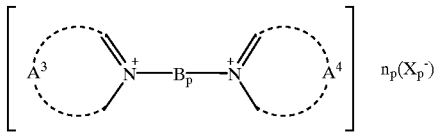

-continued formula (Pc)

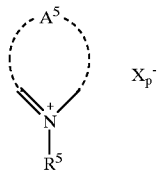

wherein $A^1$, $A^2$, $A^3$, $A^4$ and $A^5$ are each a nonmetallic atom group necessary to form a nitrogen containing heterocyclic ring, which may further contain an oxygen atom, nitrogen atom and a sulfur atom and which may condense with a benzene ring. The heterocyclic ring formed by $A^1$, $A^2$, $A^3$, $A^4$ or $A^5$ may be substituted by a substituent. Examples of the substituent include an alkyl group, an aryl group, an aralkyl group, alkenyl group, alkynyl group, a halogen atom, an acyl group, an alkoxycarbonyl group, an aryloxycarbonyl group, a sulfo group, hydroxy, an alkoxyl group, an aryloxy group, an amido group, a sulfamoyl group, a carbamoyl group, a ureido group, an amino group, a sulfonamido group, cyano, nitro, a mercapto group, an alkylthio group, and an arylthio group. Exemplary preferred $A^1$, $A^2$, $A^3$, $A^4$ and $A^5$ include a 5- or 6-membered ring (e.g., pyridine, imidazole, thiazole, oxazole, pyrazine, pyrimidine) and more preferred is a pyridine ring.

Bp is a divalent linkage group, and m is 0 or 1. Examples of the divalent linkage group include an alkylene group, arylene group, alkenylene group, —$SO_2$—, —SO—, —O—, —S—, —CO—, —N($R^6$)—, in which $R^6$ is a hydrogen atom, an alkyl group or aryl group. These groups may be included alone or in combination. Of these, Bp is preferably an alkylene group or alkenylene group.

$R^1$, $R^2$ and $R^5$ are each an alkyl group having 1 to 20 carbon atoms, and $R^1$ and $R^2$ may be the same. The alkyl group may be substituted and substituent thereof are the same as defined in $A^1$, $A^2$, $A^3$, $A^4$ and $A^5$. Preferred $R^1$, $R^2$ and $R^5$ are each an alkyl group having 4 to 10 carbon atoms, and more preferably an aryl-substituted alkyl group, which may be substituted. $X_p^-$ is a counter ion necessary to counterbalance overall charge of the molecule, such as chloride ion, bromide ion, iodide ion, sulfate ion, nitrate ion and p-toluenesulfonate ion; $n_p$ is a counter ion necessary to counterbalance overall charge of the molecule and in the case of an intramolecular salt, $n_p$ is 0.

Formula (T)

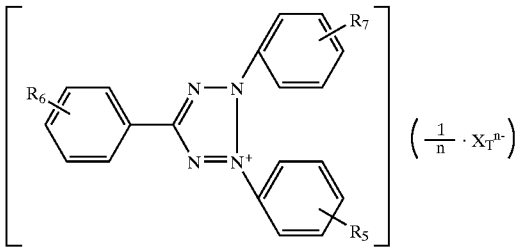

In formula (T), substituent groups $R_5$, $R_6$ and $R_7$, substituted on the phenyl group are preferably a hydrogen atom or a group, of which Hammett's σ-value exhibiting a degree of electron attractiveness is negative.

The σ values of the substituent on the phenyl group are disclosed in lots of reference books. For example, a report by C. Hansch in "The Journal of Medical Chemistry", vol.20, on page 304(1977), etc. can be mentioned. Groups showing particularly preferable negative σ-values include, for example, methyl group ($\sigma_p$=−0.17, and in the following, values in the parentheses are in terms of $\sigma_p$ value), ethyl group(−0.15), cyclopropyl group(−0.21), n-propyl group(−0.13), iso-propyl group(−0.15), cyclobutyl group(−0.15), n-butyl group(−0.16), iso-butyl group(−0.20), n-pentyl group(−0.15), n-butyl group(−0.16), iso-butyl group(−0.20), n-pentyl group(−0.15), cyclohexyl group(−0.22), hydroxyl group(−0.37), amino group(−0.66), acetylamino group(−0.15), butoxy group(−0.32), pentoxy group(−0.34), etc. can be mentioned. All of these groups are useful as the substituent for the compound represented by the formula T according to the present invention; n is 1 or 2, and as anions represented by $X_T^{n-}$ for example, halide ions such as chloride ion, bromide ion, iodide ion, etc.; acid radicals of inorganic acids such as nitric acid, sulfuric acid, perchloric acid, etc.; acid radicals of organic acids such as sulfonic acid, carboxylic acid, etc.; anionic surface active agents, including lower alkyl benzenesulfonic acid anions such as p-toluenesulfonic anion, etc.; higher alkylbenzene sulfonic acid anions such as p-dodecyl benzenesulfonic acid anion, etc.; higher alkyl sulfate anions such as lauryl sulfate anion, etc.; Boric acid-type anions such as tetraphenyl borone, etc.; dialkylsulfo succinate anions such as di-2-ethylhexylsulfo succinate anion, etc.; higher fatty acid anions such as cetyl polyethenoxysulfate anion, etc.; and those in which an acid radical is attached to a polymer, such as polyacrylic acid anion, etc. can be mentioned.

The quaternary onium salt compounds described above can be readily synthesized according to the methods commonly known in the art. For example, the tetrazolium compounds described above may be referred to Chemical Review 55, page 335–483. The above-described silver-saving agent is incorporated preferably in an amount of $1\times10^{-5}$ to 1 mole, and more preferably $1\times10^{-4}$ to $5\times10^{-1}$ mole per mole of silver halide.

Examples of the foregoing compounds represented by formulas [H], (H-1), (H-2), (H-3), (H-4), (G) and (P) are described in Japanese Patent Application No. 2000-325420 at page 33 through 151.

With regard to the difference in constitution between a conventional silver salt photographic material and a photothermographic imaging material, the photothermographic imaging material contains relatively large amounts of light sensitive silver halide, a carboxylic acid silver salt and a reducing agent which often cause fogging and silver printing-out (print out silver). In the photothermographic imaging material, therefore, an enhanced technique for antifogging and image-lasting is needed to maintain storage stability not only before development but also after development. In addition to commonly known aromatic heterocyclic compounds to restrain growth of fog specks and development thereof, there were used mercury compounds having a function of allowing the fog specks to oxidatively die away. However, such a mercury compound causes problems with respect to working safety and environment protection. Next, antifoggants and image stabilizers used in the photothermographic imaging material used in the invention will be described.

As a reducing agent usable in photothermographic materials are employed reducing agents containing a proton, such as bisphenols and sulfonamidophenols. In such a case, a compound generating a labile species which is capable of abstracting a proton and thereby deactivating the reducing agent is preferred. More preferred is a compound as a non-colored photo-oxidizing substance, which is capable of generating a free radical as a labile species upon exposure to ultraviolet or visible light. Any compound having such a function is applicable but an organic radical comprised of plural atoms is preferred. Any compound having such a function and giving no adverse effect on the photothermographic material is usable irrespective of its structure. Of such free radical generation compounds, a compound containing a carbocyclic or heterocyclic, aromatic group is preferred, which provides stability to the generated free radical so as to be in contact with the reducing agent for a period of time sufficient to react with the reducing agent to deactivate it.

Representative examples of such compounds include biimidazolyl compounds and iodonium compounds.

Of such imidazolyl compounds, a compound represented by the following formula [1] is preferred:

formula [1]

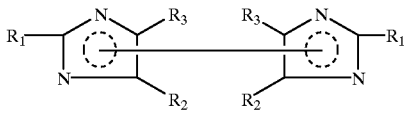

wherein $R_1$, $R_2$ and $R_3$ (,which may be either the same or different) each are a hydrogen atom, an alkyl group (e.g., methyl, ethyl, hexyl), an alkenyl group (e.g., vinyl, allyl), an alkoxyl group (e.g., methoxy, ethoxy, octyloxy), an aryl group (e.g., phenyl, naphthyl, tolyl), hydroxy, a halogen atom, an aryloxyl (e.g., phenoxy), an alkylthio group (e.g., methylthio, butylthio), an arylthio group (e.g., phenylthio), a heterocyclic group (e.g., pyridyl, triazyl), an acyl group (e.g., acetyl, propionyl butylyl, valeryl), a sulfonyl group (e.g., methylsulfonyl, phenylsulfonyl), an acylamino group, sulfonylamino group, an acyloxy group (e.g., acetoxy, benzyoy), carboxy, cyano, a sulfo group, or an amino group. Of these groups are preferred an aryl group, a heterocyclic group, an aldenyl group and cyano group.

The biimidazolyl compounds can be synthesized in accordance with the methods described in U.S. Pat. No. 3,734,733 and British Patent 1,271,177. Preferred Examples thereof are shown below.

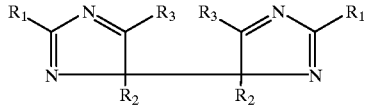

| | $R_1$ | $R_2$ | $R_3$ |
|---|---|---|---|
| BI-1 | H | CN | H |
| BI-2 | CN | H | CN |
| BI-3 | $CF_3$ | H | $CF_3$ |
| BI-4 | 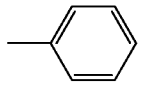 | 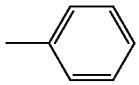 | 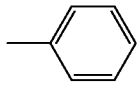 |
| BI-5 | 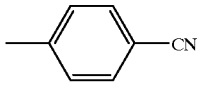 | 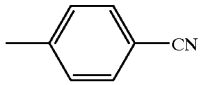 | 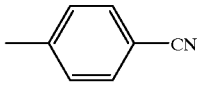 |
| BI-6 | 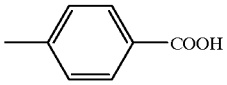 | 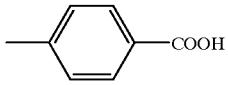 | 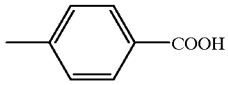 |
| BI-7 | H | —CH=$CH_2$ | H |
| BI-8 | 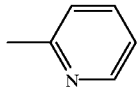 | 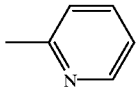 | 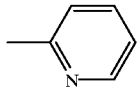 |
| BI-9 | 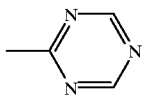 | 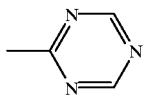 | 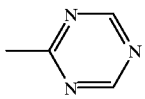 |

-continued

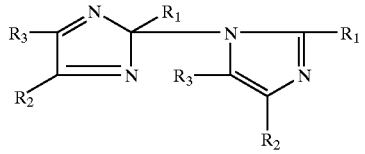

| | $R_1$ | $R_2$ | $R_3$ |
|---|---|---|---|
| BI-10 | H | 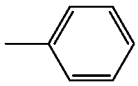 | 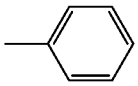 |
| BI-11 | CN | H | H |
| BI-12 | CN | 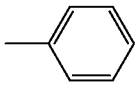 | 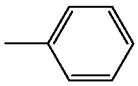 |
| BI-13 | H | 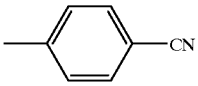 | 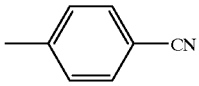 |
| BI-14 | H | $CF_3$ | H |
| BI-15 | H | 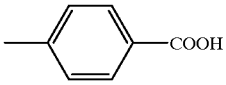 | 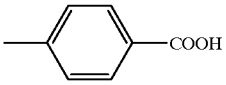 |
| BI-16 | H | 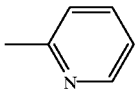 | 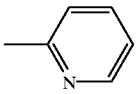 |

Similarly preferred compounds include a iodonium compound represented by the following formula (2):

Formula [2]

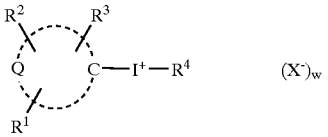

wherein Q is a group of atoms necessary to complete a 5-, 6-, or 7-membered ring, and the atoms being selected from a carbon atom, nitrogen atom, oxygen atom and sulfur atom; and $R^1$, $R^2$ and $R^3$ (,which may be the same or different) are each a hydrogen atom, an alkyl group (e.g., methyl, ethyl, hexyl), an alkenyl group (e.g., vinyl, allyl), an alkoxyl group (e.g., methoxy, ethoxy, octyloxy), an aryl group (e.g., phenyl, naphthyl, tolyl), hydroxy, a halogen atom, an aryloxyl (e.g., phenoxy), an alkylthio group (e.g., methylthio, butylthio), an arylthio group (e.g., phenylthio), an acyl group (e.g., acetyl, propionyl, butylyl, valeryl), a sulfonyl group (e.g., methylsulfonyl, phenylsulfonyl), an acylamino group, sulfonylamino group, an acyloxy group (e.g., acetoxy, benzoxy), carboxy, cyano, a sulfo group, or an amino group. Of these groups are preferred an aryl group, an alkenyl group and cyano group, provided that $R^1$, $R^2$ and $R^3$ may be bonded with each other to form a ring; $R^4$ is a carboxylate group such as acetate, benzoate or trifluoroacetate, or $O^-$; W is 0 or 1, provided that when $R^3$ is a sulfo group or a carboxy group, W is 0 and $R^4$ is $O^-$; $X^-$ is an anionic counter ion, including $CH_3CO_2$—, $CH_3SO_3$— and $PF_6^-$.

Of these is specifically preferred a compound represented by the following formula [3]:

formula [3]

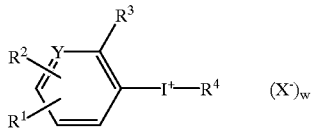

wherein $R^1$, $R^2$, $R^3$, $R^4$, $X^-$ and W are each the same as defined in formula [2]; Y is a carbon (i.e., —CH═) to form a benzene ring or a nitrogen atom (—N═) to form a pyridine ring.

The iodonium compounds described above can be synthesized in accordance with the methods described in Org. Syn., 1961 and Fieser, "Advanced Organic Chemistry" (Reinhold, N.Y., 1961).

Examples of the suitable compounds are represented by the following general formulas.

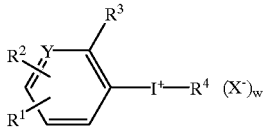

| Compound | $R^1$ | $R^2$ | $R^3$ | $R^4$ | W | X | Y |
|---|---|---|---|---|---|---|---|
| I-1 | H | H | H | $OCOCH_3$ | 1 | $OCOCH_3$ | C |
| I-2 | H | H | H | $OCOCF_3$ | 1 | $OCOCF_3$ | C |
| I-3 | H | $CH_3$ | H | $OCOCH_3$ | 1 | $OCOCH_3$ | C |
| I-4 | H | $CH_3$ | $CO_2H$ | $O^-$ | 0 | — | C |
| I-5 | H | H | $CO_2H$ | $O^-$ | 0 | — | C |
| I-6 | H | CN | $CO_2H$ | $O^-$ | 0 | — | C |
| I-7 | $OCH_3$ | $CH_3$ | H | $OCOCH_3$ | 1 | $OCOCH_3$ | C |
| I-8 | $CH_3$ | $CH_3$ | $CH_3$ | $OCOCH_3$ | 1 | $OCOCH_3$ | C |
| I-9 | $CH_3$ | $CH_3$ | H | $OCOCH_3$ | 1 | $OCOCH_3$ | C |
| I-12 | $CH_3$ | $CH_3$ | $CO_2H$ | $O^-$ | 0 | — | C |
| I-13 | H | H | $SO_3H$ | $O^-$ | 0 | — | C |
| I-14 | H | CN | $CO_2H$ | $O^-$ | 0 | — | C |
| I-15 | $OCH_3$ | Cl | H | $OCOCH_3$ | 1 | $OCOCH_3$ | C |
| I-16 | $CO_2H$ | H | H | $OCOCH_3$ | 1 | $OCOCH_3$ | C |
| I-17 | $OCH_3$ | Cl | $CH_3$ | $OCOCH_3$ | 1 | $OCOCH_3$ | C |
| I-18 | H | H | H | $OCOCH_2CH_3$ | 1 | $OCOCH_2CH_3$ | C |
| I-19 | H | $CH_2OH$ | H | $OCOCH_3$ | 1 | $OCOCH_3$ | C |
| I-20 | Cl | $CH_2OH$ | $CO_2H$ | $O^-$ | 0 | — | C |
| I-21 | Cl | $CH_3$ | $SO_3H$ | $O^-$ | 0 | — | C |
| I-22 | $CH_3$ | CN | $CO_2H$ | $O^-$ | 0 | — | C |
| I-23 | $CF_3$ | Cl | H | $OCOCH_3$ | 1 | $OCOCH_3$ | C |
| I-24 | $CO_2H$ | H | H | $OCOCH_3$ | 1 | $OCOCH_3$ | C |
| I-25 | $OCCH_3$ | H | $C_6H_5$ | $OCOCH_3$ | 1 | $OCOCH_3$ | C |
| I-26 | $C_6H_5$ | H | H | $OCOCH_3$ | 1 | $OCOCH_2CH_3$ | C |
| I-27 | $C_6H_4CO_2H$ | H | H | $OCOCH_3$ | 1 | $OCOCH_3$ | C |
| I-28 | H | $CH_2OH$ | $CO_2H$ | $O^-$ | 0 | — | C |
| I-29 | $SO_2CH_3$ | H | H | $OCOCH_3$ | 1 | $OCOCH_3$ | C |
| I-30 | Cl | CN | $CO_2H$ | $O^-$ | 0 | — | C |
| I-31 | $CF_3$ | $OCH_3$ | H | $OCOCH_3$ | 1 | $OCOCH_3$ | C |
| I-32 | $CO_2H$ | $CO_2H$ | H | $OCOCH_3$ | 1 | $OCOCH_3$ | C |
| I-33 | H | H | H | $OCOCH_3$ | 1 | $OCOCH_3$ | N |
| I-34 | H | H | H | $OCOCF_3$ | 1 | $OCOCF_3$ | N |
| I-35 | H | COOH | COOH | $O^-$ | 1 | $OCOCH_3$ | N |
| I-36 | H | CN | COOH | $O^-$ | 0 | — | N |
| I-37 | 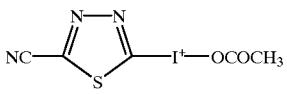 | | | | | $(OCOCH_3)^-$ | |
| I-38 | 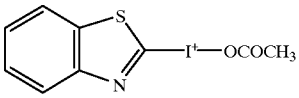 | | | | | $(OCOCH_3)^-$ | |

The compound releasing a labile species other than a halogen atom, such as represented by formula [1] or [2] is incorporated preferably in an amount of 0.001 to 0.1 mol/$m^2$, and more preferably 0.005 to 0.05 mol/$m^2$. The compound may be incorporated into any component layer of the photothermographic material relating to the invention and is preferably incorporated in the vicinity of a reducing agent.

As a compound capable of deactivating a reducing agent to inhibit reduction of an organic silver salt to silver by the reducing agent are preferable compounds releasing a labile species other than a halogen atom. In addition thereto, a compound of capable of releasing, upon exposure to ultraviolet or visible light, a labile species oxidizing silver is also usable in the invention. Specifically, the foregoing compound capable of deactivating a reducing agent, thereby inhibiting reduction of an organic silver salt to silver may be used in combination with a compound capable of releasing a labile species such as a halogen atom, which is capable of oxidizing silver.

There are known a number of compounds releasing an active halogen atom as a labile species and superior results can be achieved by the combined use thereof. Examples of the compound releasing an active halogen atom include a compound represented by the following formula [4]:

formula [4]

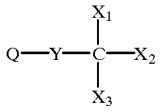

wherein Q is an aryl group or a heterocyclic group; $X_1$, $X_2$ and $X_3$ are each a hydrogen atom, a halogen atom, a haloalkyl group, an acyl group, an alkoxycarbonyl group, an aryloxycarbonyl group, a sulfonyl group, an aryl group or a heterocyclic group, provided that at least of them a halogen atom; Y is —C(=O)—, —SO— or —$SO_2$—. The aryl group represented by Q may be a monocyclic group or condensed ring group and is preferably a monocyclic or di-cyclic aryl group having 6 to 30 carbon atoms (e.g., phenyl, naphthyl), more preferably a phenyl or naphthyl group, and still more preferably a phenyl group. The heterocyclic group represented by Q is a 3- to 10-membered, saturated or unsaturated heterocyclic group containing at least one of N, O and S, which may be a monocyclic or condensed with another ring to a condensed ring.

The heterocyclic group is preferably a 5- or 6-membered unsaturated heterocyclic group, which may be condensed, more preferably a 5- or 6-membered aromatic heterocyclic group, which may be condensed, still more preferably a N-containing 5- or 6-membered aromatic heterocyclic group, which may be condensed, and optimally a 5- or 6-membered aromatic heterocyclic group containing one to four N atoms, which may be condensed. Exemplary examples of heterocyclic rings included in the heterocyclic group include imidazole, pyrazole, pyridine, pyrimidine, pyrazine, pyridazine, triazole, triazines, indole, indazole, purine, thiazole, oxadiazole, quinoline, phthalazine, naphthyridine, quinoxaline, quinazoline, cinnoline, pteridine, acrydine, phenanthroline, phenazine, tetrazole, thiazole, oxazole, benzimidazole, benzoxazole, benzthiazole, indolenine and tetrazaindene. Of these are preferred imidazole, pyridine, pyrimidine, pyrazine, pyridazine, triazole, triazines, thiadiazole, oxadiazole, quinoline, phthalazine, naphthylizine, quinoxaline, quinazoline, cinnoline, tetrazole, thiazole, oxazole, benzimidazole, and tetrazaindene; more preferably imidazole, pyrimidine, pyridine, pyrazine, pyridazine, triazole, triazines, thiadiazole, quinoline, phthalazine, naphthyridine, quinoxaline, quinazoline, cinnoline, tetrazole, thiazole, benzimidazole, and benzthiazole; and still more preferably pyridine, thiazole, quinoline and benzthiazole.

The aryl group or heterocyclic group represented by Q may be substituted by a substituent, in addition to —Y—C($X_1$)($X_2$)($X_3$). Preferred examples of the substituent include an alkyl group, an alkenyl group, an aryl group, an alkoxyl group, an aryloxyl group, an acyloxy group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, a sulfonyl group, a ureido group, phosphoramido group, a halogen atom, cyano group, sulfo group, carboxy group, nitro group and heterocyclic group. Of these are preferred an alkyl group, an aryl group, an alkoxyl group, an aryloxyl group, an acyl group, an acylamino group, an aryloxyl group, acyl group, an acylamino group, an alkoxycarbonyl group, an aryloxycarbonylamino group, a sulfonylamino group, a sulfamoyl group, a carbamoyl group, a ureido group, phosphoramido group, a halogen atom, cyano group, nitro group, and a heterocyclic group; and more preferably an alkyl group, an aryl group, an alkoxyl group, an aryloxyl group, an acyl group, an acylamino group, a sulfonylamino group, a sulfamoyl group, a carbamoyl group, a halogen group, cyano group, nitro group and a heterocyclic group; and still more preferably an alkyl group, an aryl group and a halogen atom. $X_1$, $X_2$ and $X_3$ are preferably a halogen atom, a haloalkyl group, an acyl group, an alkoxycarbonyl group, an aryloxycarbonyl group, a carbamoyl group, a sulfamoyl group, a sulfonyl group, and a heterocyclic group, more preferably a halogen atom, a haloalkyl group, an acyl group, an alkoxycarbonyl group, an aryloxycarbonyl group, and a sulfonyl group; and still more preferably a halogen atom and trihalomethyl group; and most preferably a halogen atom. Of halogen atoms are preferably chlorine atom, bromine and iodine atom, and more preferably chlorine atom and bromine atom, and still more preferably bromine atom. Y is —C(=O)—, —SO—, and —$SO_2$—, and preferably —$SO_2$—.

Exemplary examples of these compounds are shown below.

4-1

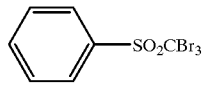

4-2

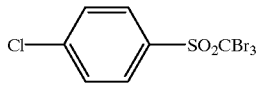

4-3

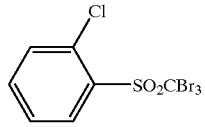

4-4

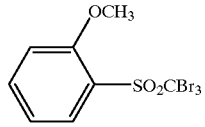

4-5

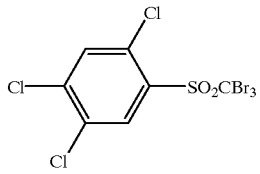

4-6

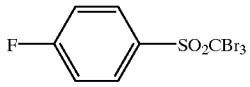

4-7

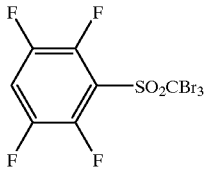

4-8

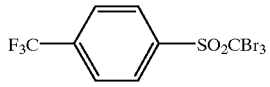

4-9

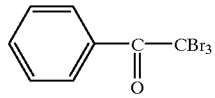

4-10

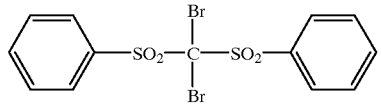

-continued
4-11
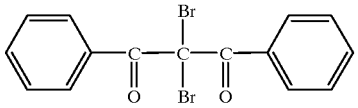
4-12
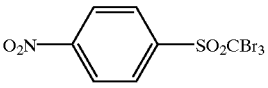
4-13
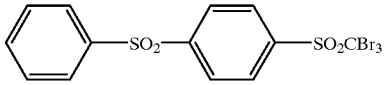
4-14
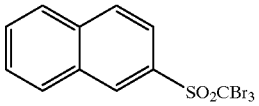
4-15
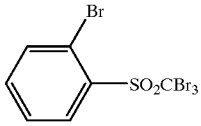
4-16
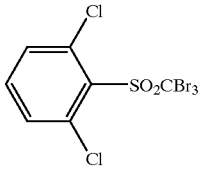
4-17
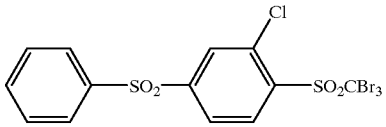
4-18
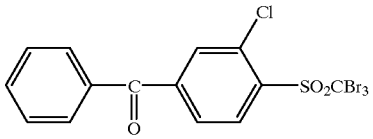
4-19
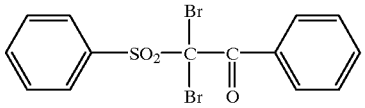
4-20
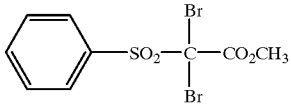
4-21
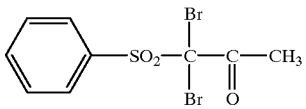
4-22
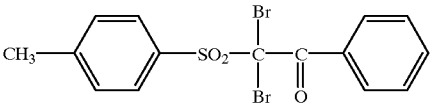
4-23
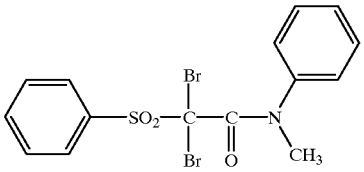
4-24
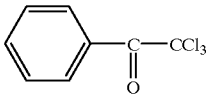
4-25
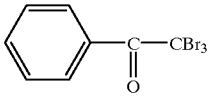
4-26
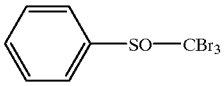
4-27
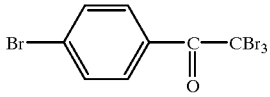
4-28
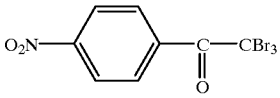
4-29
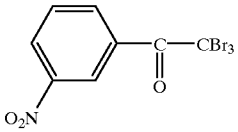
4-30
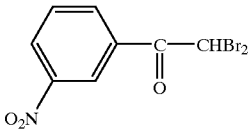
4-31
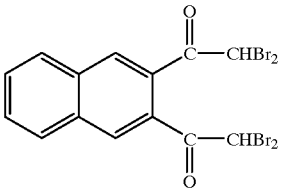
4-32
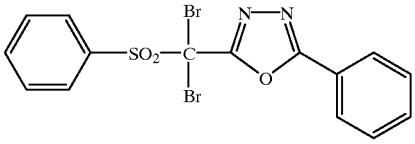
4-33
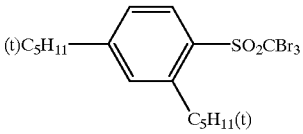

-continued
4-34
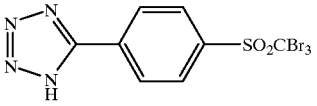
4-35
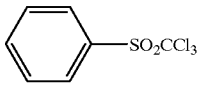
4-36
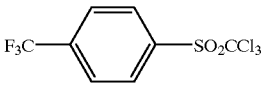
4-37
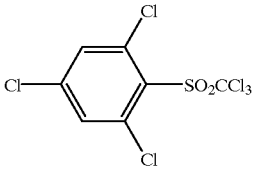
4-38
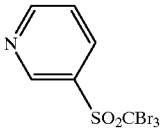
4-39
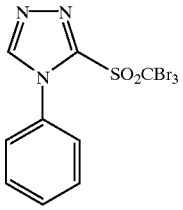
4-40
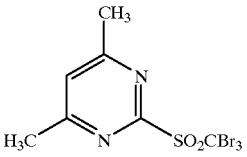
4-41
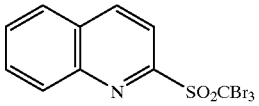
4-42
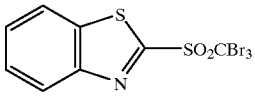
4-43
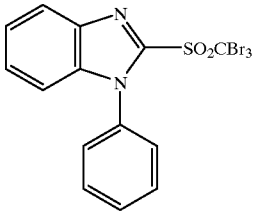
-continued
4-44
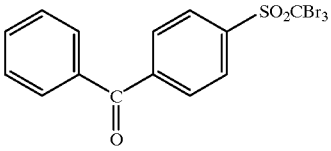
4-45
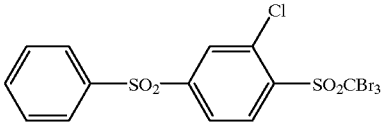
4-46
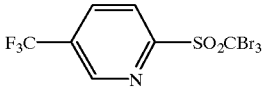
4-47
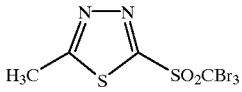
4-48
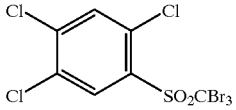
4-49
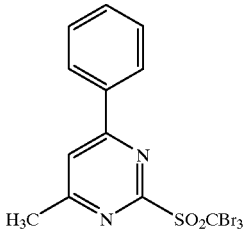
4-50
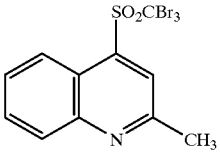
4-51
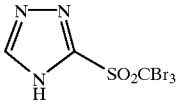
4-52
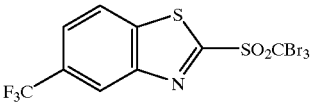
4-53
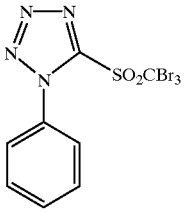

-continued 4-54

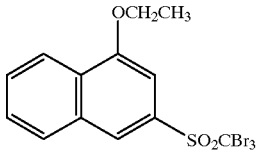

4-55

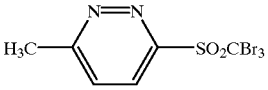

4-56

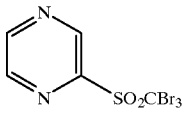

4-57

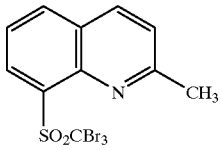

4-58

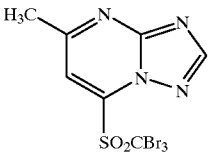

4-59

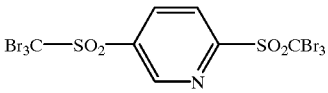

4-60

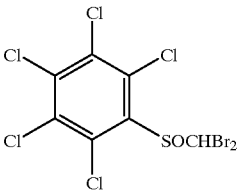

4-61

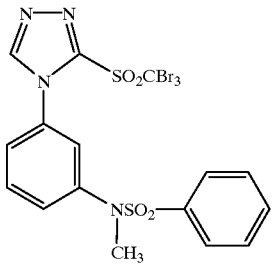

4-62

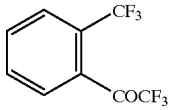

4-63

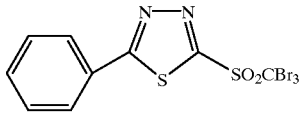

-continued 4-64

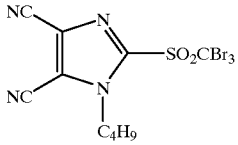

The amount of this compound to be incorporated is preferably within the range in which an increase of printed-out silver caused by formation of silver halide becomes substantially no problem, more preferably not more than 150% by weight and still more preferably not more than 100% by weight, based on the compound releasing no active halogen atom.

Further, in addition to the foregoing compounds, compounds commonly known as an antifoggant may be incorporated in the photothermographic imaging material used in the invention. In such a case, the compounds may be those which form a labile species similarly to the foregoing compounds or those which are different in antifogging mechanism. Examples thereof include compounds described in U.S. Pat. Nos. 3,589,903, 4,546,075 and 4,452,885; JP-A No. 59-57234; U.S. Pat. Nos. 3,874,946 and 4,756,999; and JP-A Nos. 9-288328 and 9-90550. Further, other antifoggants include, for example, compounds described in U.S. Pat. No. 5,028,523 and European patent Nos. 600,587, 605,981 and 631,176.

In one of preferred embodiments of the invention, at least two of the foregoing compounds releasing, upon exposure to ultraviolet or visible light, a labile species capable of oxidizing silver or a labile species capable of deactivating a reducing agent to inhibit reduction of an organic silver salt to silver by the reducing agent, and represented by formulas [1] through [4] are used in combination. Using the silver-saving agent according to the invention and at least two of the compounds of formulas [1] through [4], a photothermographic imaging material exhibiting more preferable image tone can be obtained.

With regard to image tone of the outputted image used for medical diagnosis, it has been supposed that more exact diagnostic observation results can be easily achieved with cold image tone. The cold image tone refers to pure black tone or bluish black tone and the warm image tone refers to a brownish black image exhibiting a warm tone.

The expression regarding to the tone, i.e., "colder tone" or "warmer tone can be determined based on a hue angle, $h_{ab}$ at a density of 1.0. The hue angle, $h_{ab}$ can be represented as $h_{ab}=\tan^{-1}(b^*/a^*)$, which is obtained using color coordinates a* and b* in CIE (1976) L*a*b* color system. In the invention the range of the $h_{ab}$ is $190° < h_{ab} < 260°$, preferably $195° < h_{ab} < 255°$, and more preferably $200° < h_{ab} < 250°$. It was proved that such a range led to enhanced recognition in relatively low density areas, specifically in the mediastinum portion of lung in diagnosis photographs.

Reducing agents are incorporated into the photothermographic material of the present invention. Examples of suitable reducing agents are described in U.S. Pat. Nos. 3,770,448, 3,773,512, and 3,593,863, and Research Disclosure Items 17029 and 29963, and an optimum reducing agent can be used by the selection from those commonly known in the art. In cases where fatty acid silver salts are used as an organic silver salt, polyphenols in which at least two phenyl groups are linked through an alkylene group or a sulfur atom and specifically, bisphenols in which two phenyl groups which are substituted, at the position adjacent to the hydroxy group-substituted position, with at least an alkyl group (e.g., methyl, ethyl, propyl, t-butyl, cyclohexyl, etc.) or an acyl group (e.g., acetyl, propionyl, etc.) are linked through an alkylene group or a sulfur atom. For example, the compound represented by the following formula(A) is preferred:

formula (A)

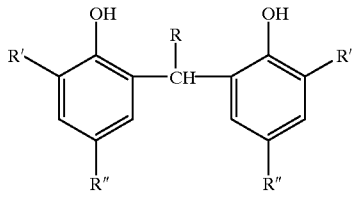

wherein R represents a hydrogen atom or an alkyl group having from 1 to 10 carbon atoms (for example, isopropyl, —$C_4H_9$, 2,4,4-trimethylpentyl), and R' and R" each represents an alkyl group having from 1 to 5 carbon atoms (for example, methyl, ethyl, t-butyl).

In addition to the foregoing compounds, examples of the reducing agents include polyphenol compounds described in U.S. Pat. Nos. 3.589,903 and 4,021,249; British patent No. 1,486,148; JP-A Nos. 51-51933, 50-36110, 50-116023 and 52-84727; JP-B No. 51-35727 (hereinafter, the term, JP-B means a published Japanese Patent); bisnaphthols described in U.S. Pat. No. 3,672,904, such as 2,2'-dihydroxy-1,1'-binaphthyl and 6,6'-dibromo-2,2'-dihydoxy-1,1'-binaphthyl; sulfonamidophenols and sulfonamidonaphthols described in U.S. Pat. No. 3,801,321, such as 4-benzenesulfonamidophenol, 2-benzenesulfonamidophenol, 2,6-dichloro-4-benzenesulfonamidophenol and 4-benzenesulfonamidonaphthol.

The amount of a reducing agent to be used, such as the compound represented by formula (A) is preferably $1\times10^{-2}$ to 10 mol and more preferably $1.5\times10^{-2}$ to 1.5 mol per mol silver.

The amount of the reducing agent used in the photothermographic imaging material is variable depending on the kind of an organic silver salt or reducing agent and is usually 0.05 to 10 mol, and preferably 0.1 to 3 mol per mol of organic silver salt. Two or more reducing agents may be used in combination, in an amount within the foregoing range.

Addition of the reducing agent to a light sensitive emulsion comprising a light sensitive silver halide, organic silver salt grains and a solvent immediately before coating the emulsion is often preferred, thereby minimizing variation in photographic performance during standing.

Silver halide grains used in the invention can be subjected to chemical sensitization. In accordance with methods described in Japanese Patent Application Nos. 2000-57004 and 2000-61942, for example, a chemical sensitization center (chemical sensitization speck) can be formed using compounds capable of releasing chalcogen such as sulfur or noble metal compounds capable of releasing a noble metal ion such as a gold ion. In the invention, it is preferred to conduct chemical sensitization with an organic sensitizer containing a chalcogen atom, as described below. Such a chalcogen atom-containing organic sensitizer is preferably a compound containing a group capable of being adsorbed onto silver halide and a labile chalcogen atom site. These organic sensitizers include, for example, those having various structures, as described in JP-A Nos. 60-150046, 4-109240 and 11-218874. Specifically preferred of these is at least a compound having a structure in which a chalcogen atom is attacked to a carbon or phosphorus atom through a double bond.

In the invention, such chalcogen compounds preferably are compounds represented by formula (1-1) or (1-2):

formula (1-1)

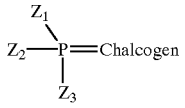

wherein $Z_1$, $Z_2$ and $Z_3$ each represent an aliphatic group, an aromatic group, a heterocyclic group, —$OR_7$, —$NR_8(R_9)$ —$SR_{10}$, —$SeR_{11}$, a halogen atom or a hydrogen atom; $R_7$, $R_{10}$ and $R_{11}$ each represent an aliphatic group, aromatic group, a heterocyclic group or a cation; $R_8$ and $R_9$ each represent an aliphatic group, an aromatic group, a heterocyclic group or a hydrogen atom.

The aliphatic groups represented by $Z_1$, $Z_2$, $Z_3$, $R_7$, $R_8$, $R_9$, $R_{10}$, and $R_{11}$ are each a straight chain or branched alkyl group, alkenyl group, aralkyl group (e.g., methyl, ethyl, propyl, isopropyl, t-butyl, n-butyl, n-octyl, n-decyl, n-hexadecyl, cyclopentyl, cyclohexyl, allyl, 2-butenyl, 3-pentenyl, propargyl, 3-penynyl, benzyl, phenethyl, etc.). The aromatic groups represented by $Z_1$, $Z_2$, $Z_3$, $R_7$, $R_8$, $R_9$, $R_{10}$, and $R_{11}$ are a monocyclic or condensed aryl group (e.g., phenyl, pentafluorophenyl, 4-chlorophenyl, 3-sulfophenyl, α-naphthyl, 4-methylphenyl, etc.). The heterocyclic groups represented by $Z_1$, $Z_2$, $Z_3$, $R_7$, $R_8$, $R_9$, $R_{10}$, and $R_{11}$ include a saturated or unsaturated, 3- to 10-membered heterocyclic ring containing at least one of nitrogen, oxygen and sulfur atoms (e.g., pyridyl, thienyl, furyl, thiazolyl, imidazolyl, benzimidazolyl, etc.). The cation represented by $R_7$, $R_{10}$, and $R_{11}$ represents an alkali metal atom oe ammonium; the halogen atom represented by X is a fluorine atom, chlorine atom, bromine atom or an iodine atom. In formula (1-1), $Z_1$, $Z_2$ and $Z_3$ are preferably an aliphatic group, aromatic group or —$OR_7$, in which $R_7$ is an aliphatic group or aromatic group. $Z_1$ and $Z_2$, $Z_2$ and $Z_3$, or $Z_3$ and $Z_1$, each pair may combine with each other to form a ring. "Chalcogen" represents a sulfur atom, selenium atom or a tellurium atom.

Formula (1-2)

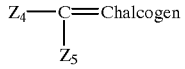

In formula (1-2), $Z_4$ and $Z_5$ represent an alkyl group (e.g., methyl, ethyl, t-butyl, adamantyl, t-octyl, etc.), an alkenyl group (e.g., vinyl, propenyl, etc.), an aralkyl group (e.g., benzyl, phenethyl, etc.), an aryl group (e.g., phenyl, pentafluorophenyl, 4-chlorophenyl, 3-nitrophenyl, 4-octylsulfamoylphenyl, α-naphthyl, etc.), a heterocyclic group (e.g., pyridyl, thienyl, furyl, imidazolyl, etc.), —$NR_1(R_2)$, —$OR_3$ or —$SR_4$, in which $R_1$, $R_2$, $R_3$ and $R_4$, which may be either the same or different, are an alkyl group, aralkyl group or aryl group. The alkyl group, aralkyl group and aryl group are the same as defined in $Z_1$ of formula (1-1), provided that $R_1$ and $R_2$ may be a hydrogen atom or an acyl group (e.g., acetyl, propanoyl, benzoyl, heptafluorobutanoyl, difluoroacetyl, 4-nitrobenzoyl, α-naphthoyl, 4-trifluoromethylbenzoyl, etc.). $Z_4$ and $Z_5$ may combine with each other to form a ring. "Chalcogen" represents sulfur, selenium or tellurium.

The chalcogen sensitizer represented by formula (1-1) or (1-2) is capable of forming a sensitization nucleus upon reaction with a silver ion in silver halide grains, thereby achieving chemical sensitization.

The compounds represented by formula (1-1) or (1-2) can readily be synthesized according to techniques known in the art. Exemplary examples of the compounds represented by formula (1-1) or (1-2) are shown below, but are by no means limited to these examples.

1-1

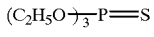

1-2

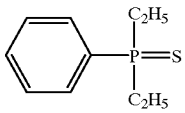

1-3

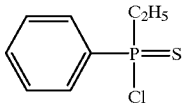

1-4

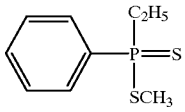

1-5

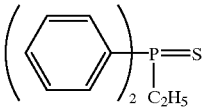

1-6

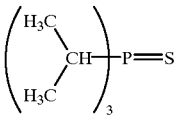

1-7

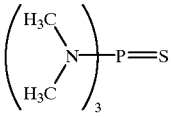

1-8

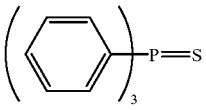

1-9

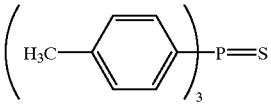

1-10

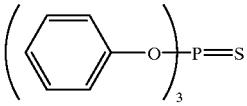

1-11

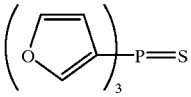

-continued 1-12

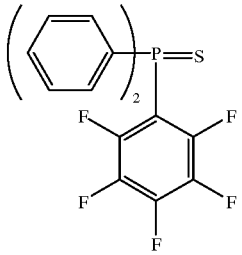

1-13

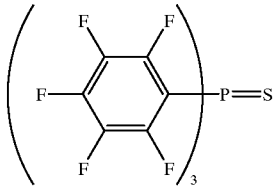

1-14

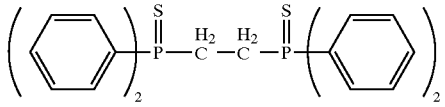

1-15

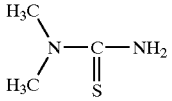

1-16

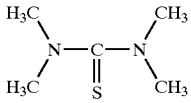

1-17

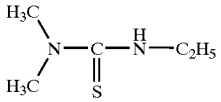

1-18

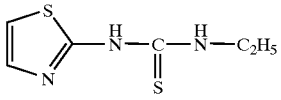

1-19

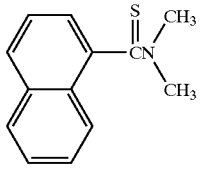

1-20

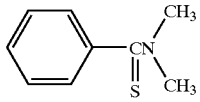

1-21

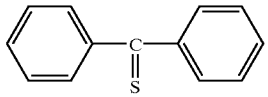

1-22

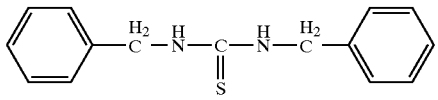

-continued
1-23
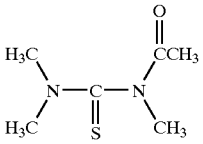
1-24
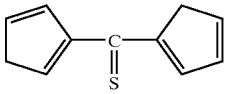
1-25
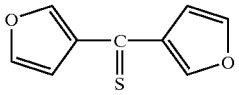
1-26
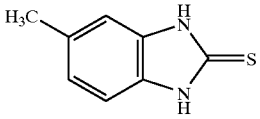
1-27
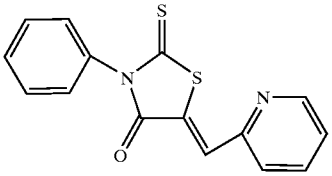
1-28
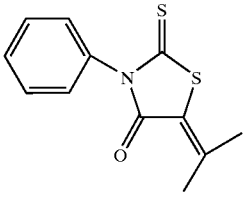
1-29
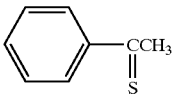
1-30
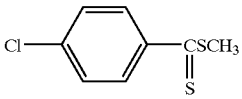
1-31
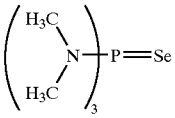
1-32
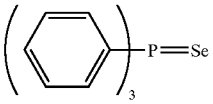
1-33
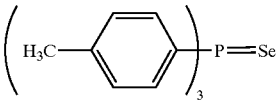
1-34
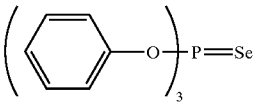
-continued
1-35
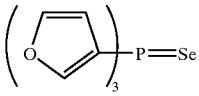
1-36
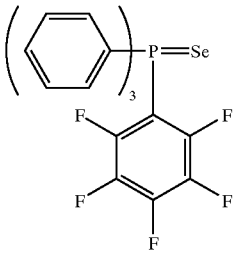
1-37
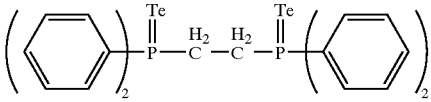
1-38
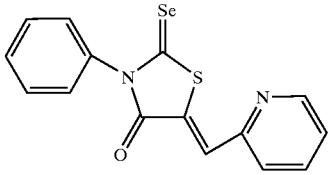
1-39
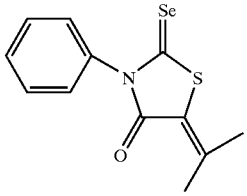
1-40
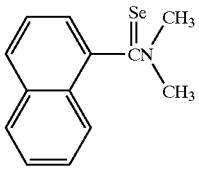
1-41
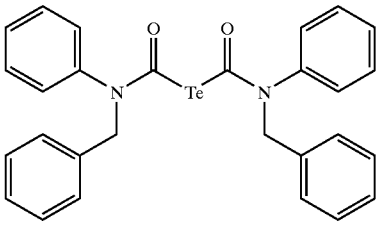
1-42
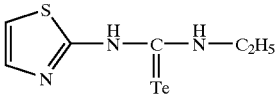
1-43
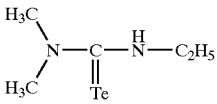
The amount of a chalcogen compound added as an organic sensitizer is variable, depending on the chalcogen compound to be used, silver halide grains and a reaction environment when subjected to chemical sensitization and is preferably $10^{-8}$ to $10^{-2}$ mol, and more preferably $10^{-7}$ to $10^{-3}$ mol per mol of silver halide. In the invention, the chemical sensitization environment is not specifically limited but it is preferred to conduct chemical sensitization in the presence of a compound capable of eliminating a silver chalcogenide or silver specks formed on the silver halide grain or reducing the size thereof, or specifically in the presence of an oxidizing agent capable of oxidizing the silver specks, using a chalcogen atom-containing organic sensitizer. To conduct chemical sensitization under preferred conditions, the pAg is preferably 6 to 11, and more preferably 7 to 10, the pH is preferably 4 to 10 and more preferably 5 to 8, and the temperature is preferably not more than 30° C.

In photothermographic imaging materials used in the invention, it is preferred to use a light sensitive emulsion, in which light sensitive silver halide has been subjected to chemical sensitization using a chalcogen atom-containing organic sensitizer at a temperature of 30° C. or higher, concurrently in the presence of an oxidizing agent capable of oxidizing silver specks formed on the silver halide grains, then, mixed with an organic silver salt, dehydrated and dried.

Chemical sensitization using the foregoing organic sensitizer is also preferably conducted in the presence of a spectral sensitizing dye or a heteroatom containing compound capable of being adsorbed onto silver halide grains. Thus, chemical sensitization in the present of such a silver halide-adsorptive compound results in prevention of dispersion of chemical sensitization center specks, thereby achieving enhanced sensitivity and minimized fogging. Although there will be described spectral sensitizing dyes used in the invention, preferred examples of the silver halide-adsorptive, heteroatom-containing compound include nitrogen containing heterocyclic compounds described in JP-A No. 3-24537. In the heteroatom-containing compound, examples of the heterocyclic ring include a pyrazolo ring, pyrimidine ring, 1,2,4-triazole ring, 1,2,3-triazole ring, 1,3,4-thiazole ring, 1,2,3-thiadiazole ring, 1,2,4-thiadiazole ring, 1,2,5-thiadiazole ring, 1,2,3,4-tetrazole ring, pyridazine ring, 1,2,3-triazine ring, and a condensed ring of two or three of these rings, such as triazolotriazole ring, diazaindene ring, triazaindene ring and pentazaindene ring. Condensed heterocyclic ring comprised of a monocycic hetero-ring and an aromatic ring include, for example, a phthalazine ring, benzimidazole ring indazole ring, and benzthiazole ring. Of these, an azaindene ring is preferred and hydroxy-substituted azaindene compounds, such as hydroxytriazaindene, tetrahydroxyazaindene and hydroxypentazaundene compound are more preferred. The heterocyclic ring may be substituted by substituent groups other than hydroxy group. Examples of the substituent group include an alkyl group, substituted alkyl group, alkylthio group, amino group, hydroxyamino group, alkylamino group, dialkylamino group, arylamino group, carboxy group, alkoxycarbonyl group, halogen atom and cyano group. The amount of the heterocyclic ring containing compound to be added, which is broadly variable with the size or composition of silver halide grains, is within the range of $10^{-6}$ to 1 mol, and preferably $10^{-4}$ to $10^{-1}$ mol per mol silver halide.

As described earlier, silver halide grains can be subjected to noble metal sensitization using compounds capable of releasing noble metal ions such as a gold ion. Examples of usable gold sensitizers include chloroaurates and organic gold compounds. In addition to the foregoing sensitization, reduction sensitization can also be employed and exemplary compounds for reduction sensitization include ascorbic acid, thiourea dioxide, stannous chloride, hydrazine derivatives, borane compounds, silane compounds and polyamine compounds. Reduction sensitization can also conducted by ripening the emulsion while maintaining the pH at not less than 7 or the pAg at not more than 8.3. Silver halide to be subjected to chemical sensitization may be one which has been prepared in the presence of an organic silver salt, one which has been formed under the condition in the absence of the organic silver salt, or a mixture thereof.

In the invention, commonly known antifoggants may be incorporated into the photothermographic materials. In one preferred embodiment of the invention, the compound represented by the following formula (3) is used as an antifoggant:

$$R_1—(S)_m—(SO_2)_n—R_2 \qquad \text{formula (3)}$$

wherein $R_1$ and $R_2$ each represent an aliphatic group, aromatic group, a heterocyclic group, $—SO_2—R_3$ (in which $R_3$ is the same as defined in $R_2$) or an atomic group capable of forming a ring by the combination with each other, provided that $R_1$ and $R_2$ may be either the same or different; m is an integer of 1 to 6; and n is 0 or 1.

The aliphatic group represented by $R_1$ and $R_2$ is a straight chain or branched alkyl having 1 to 30, and preferably 1 to 20 carbon atoms, an alkenyl group, an alkynyl or group, and a cycloalkyl group Examples thereof include methyl, ethyl, propyl, butyl, hexyl, decyl, dodecyl, isopropyl, t-butyl, 2-ethylhexyl, allyl, 2-butenyl, 7-octenyl, proppargyl, 2-butynyl, cyclopropyl, cyclopentyl, cyclohexyl and cyclododecyl. The aromatic group represented by $R_1$ and $R_2$ is one having 6 to 20 carbon atoms, and examples thereof include phenyl, naphthyl and anthranyl. The heterocyclic group represented by $R_1$ and $R_2$ may be monocyclic ring or condensed ring, which is a 5- or 6-membered heterocyclic group containing at least one of O, S and N atoms and an amineoxide group. Examples thereof include pyrrolidine, piperidine, tetrahydrofuran, tetrahydropyrane, oxylane, morpholine, thiomorpholine, thiopyrane, tetrahydrothiophene, pyrrole, pyridine, furan, thiophene, imidazole, triazole, tetrazole, thiadiazole, oxadiazole, and benzelog derived from them. The ring formed by the combination of $R_1$and $R_2$ is a 4- to 7-membered ring, and preferably 5- to 7-membered ring. $R_1$ and $R_2$ are preferably a heterocyclic group or an aromatic group, and more preferably a heterocyclic group.

The aliphatic group, aromatic group and heterocyclic group represented by $R_1$and $R_2$ may be substituted by a substituent group. Examples of the substituent group include a halogen atom (e.g., chlorine atom, bromine atom, etc.9, an alkyl group (e.g., methyl, ethyl, propyl, isopropyl, hydroxyethyl, methyoxymethyl, trifluoromethyl, t-butyl, etc.), a cycloalkyl group (e.g., cyclopentyl, cyclohexyl, etc.), an aralkyl group (e.g., benzyl, 2-phenethyl, etc.), an aryl group (e.g., phenyl, naphthyl, p-tolyl, p-chlorophenyl, etc.), an alkoxy group (e.g., methoxy, ethoxy, isopropoxy, butoxy, etc.), an aryloxy group (e.g., phenoxy, 4-methoxyphenoxy, etc.), cyano, an acylamino group (e.g., acetylamino, propionylamino, etc.), an alkylthio group (e.g., methylthio, ethylthuio, butylthio, etc.), an arylthio group (e.g., phenylthio, p-methylphenylthio, etc.), a sulfonylamino group (e.g., methanesulfonylamino, benzenesulfonylamino, etc.), an ureido group (e.g., 3-methylureido, 3,3-dimethylureido, 1,3-dimethylureido, etc.), a sulfamoylamino group (e.g., dimethylsulfamoylamino, diethylsulfamoylamino, etc.), a carbamoyl group (e.g., methylcarbamoyl, ethylcarbamoyl, dimethylcarbamoyl, etc.), a sulfamoyl group (e.g., ethylsulfamoyl, dimethylsulfamoyl, etc.), an alkoxycarbonyl group (e.g., methoxycarbonyl, ethoxycarbonyl, etc.), an aryloxycarbonyl group (e.g., phenoxycarbonyl, p-chlorophenoxycarbonyl, etc.), a sulfonyl group (e.g., methanesulfonyl, butanesulfonyl, phenysulfonyl, etc.), a thiosulfonyl (e.g., methanethiosulfonyl, phenylthiosulfonyl, etc.), an acyl group (e.g., acetyl,propanoyl, butyloyl, etc.), an aminogroup (e.g., methylamino, ethylamino, dimethylamino, etc.), hydroxy, nitro, nitroso, amineoxide group (e.g., pyridineoxide, etc.), an imido group (e.g., phthalimido, etc.), disulfide group (e.g., benzenedisulfide, benzthiazolyl-2-disulfide, etc.), and a heterocyclic group (e.g., pyridyl, benzimidazolyl, benzthiazolyl, benzoxazolyl, etc.). Specifically, substituent groups substituted by an electron-withdrawing group is preferred. R and R may be substituted by one or more of these substituent groups. The substituent group may be further substituted. Further, m is an integer of 1 to 6 and preferably 2 or 3.

Exemplary examples of the compounds represented by formula (3) are shown below but are by no means limited to these.

3-1

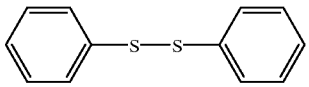

3-2

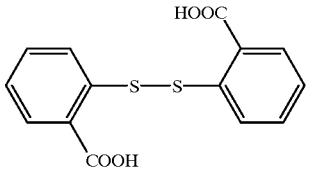

3-3

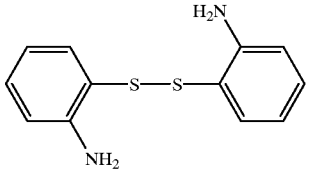

3-4

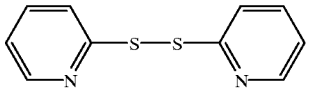

3-5

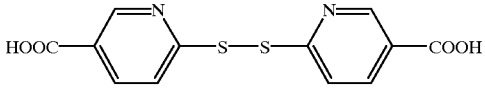

3-6

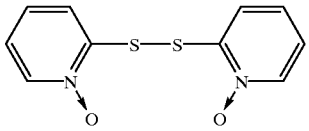

3-7

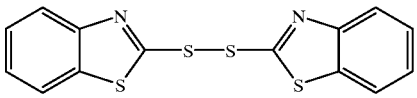

3-8

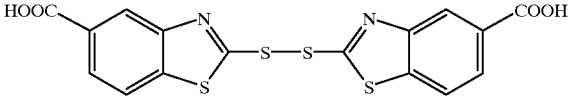

-continued 3-9

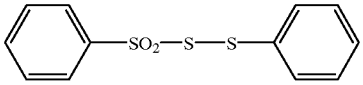

3-10

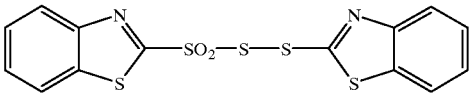

3-11

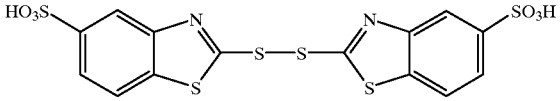

3-12

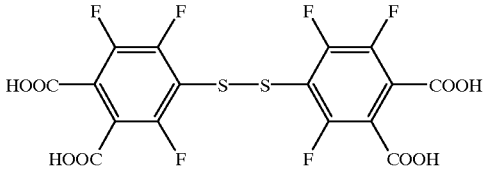

3-13

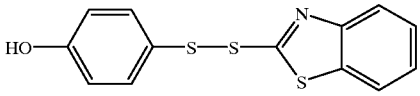

3-14

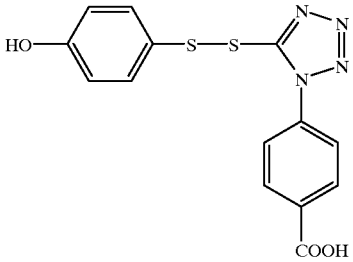

3-15

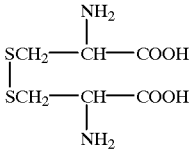

3-16

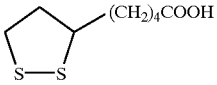

3-17

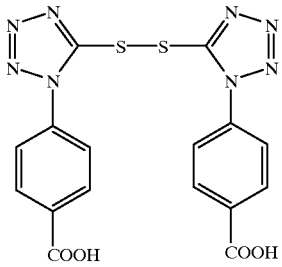

-continued
3-18
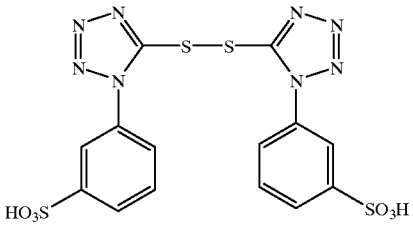
3-19
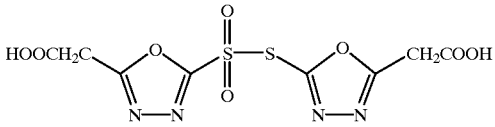
3-20
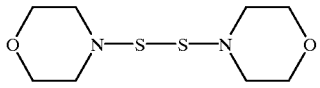
3-21
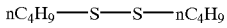
3-22
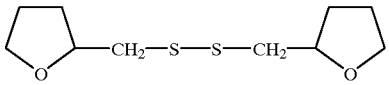
3-23
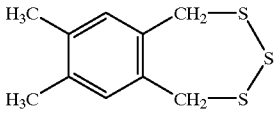
3-24
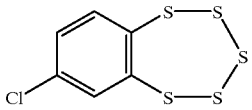
3-25
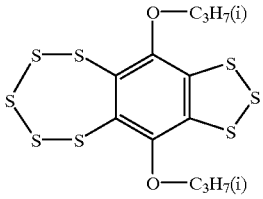
3-26
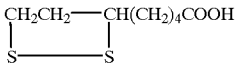
3-27
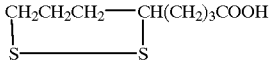
3-28
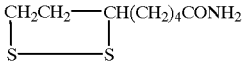
3-29
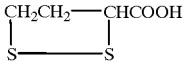
3-30
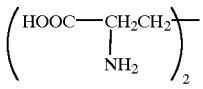
-continued
3-31
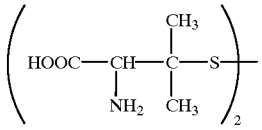
3-32
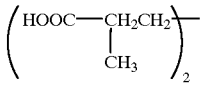
3-33
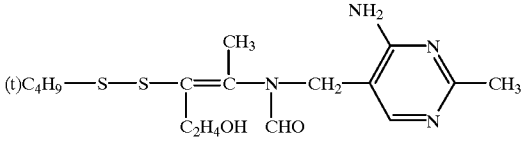
3-34
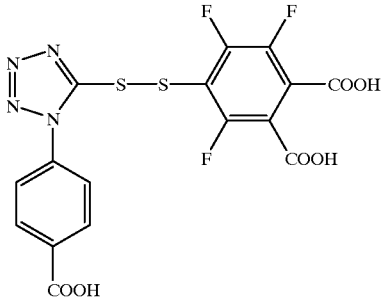
3-35
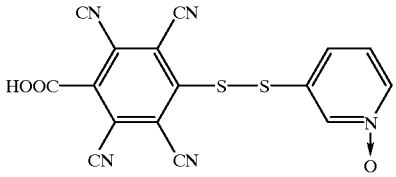
3-36
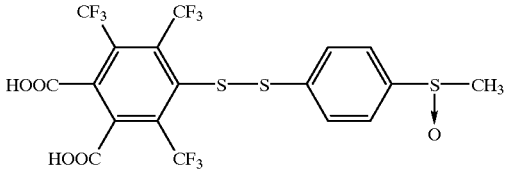
3-37
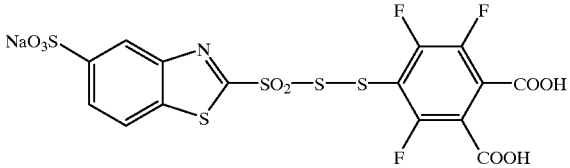
3-38
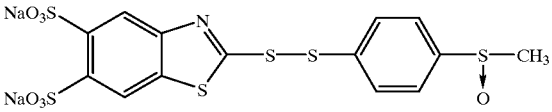

-continued 3-39

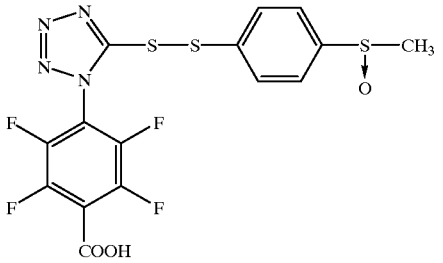

3-40

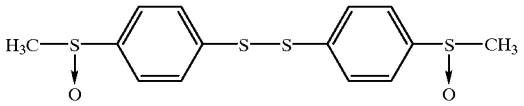

The compound represented by formula (3) can readily be synthesized in accordance with methods known in the art. The antifoggant represented by formula (3) can be added at any time of forming the light sensitive layer, including formation of light sensitive silver halide, and before and after chemical ripening, and preferably at the time of desalting a silver halide-containing emulsion or immediately before coating. The amount to be added is preferably $1\times10^{-8}$ to 10, and more preferably $1\times10^{-5}$ to 1 mol/Ag mol.

Light sensitive silver halide grains used in the invention are preferably subjected to spectral sensitization by allowing a spectral sensitizing dye to adsorb to the grains. Examples of the spectral sensitizing dye include cyanine, merocyanine, complex cyanine, complex merocyanine, holo-polar cyanine, styryl, hemicyanine, oxonol and hemioxonol dyes, as described in JP-A NOs. 63-159841, 60-140335, 63-231437, 63-259651, 63-304242, 63-15245; U.S. Pat. Nos. 4,639,414, 4,740,455, 4,741,966, 4,751,175 and 4,835,096. Usable sensitizing dyes are also described in Research Disclosure (hereinafter, also denoted as RD) 17643, page 23, sect. IV-A (December, 1978), and ibid 18431, page 437, sect. X (August, 1978). It is preferred to use sensitizing dyes exhibiting spectral sensitivity suitable for spectral characteristics of light sources of various laser imagers or scanners. Examples thereof include compounds described in JP-A Nos. 9-34078, 9-54409 and 9-80679.

Useful cyanine dyes include, for example, cyanine dyes containing a basic nucleus, such as thiazoline, oxazoline, pyrroline, pyridine, oxazole, thiazole, selenazole and imidazole nuclei. Useful merocyanine dyes preferably contain, in addition to the foregoing nucleus, an acidic nucleus such as thiohydatoin, rhodanine, oxazolidine-dione, thiazolinedione, barbituric acid, thiazolinone, malononitrile and pyrazolone nuclei. In the invention, there are also preferably used sensitizing dyes having spectral sensitivity within the infrared region. Examples of the preferred infrared sensitizing dye include those described in U.S. Pat. Nos. 4,536,478, 4,515,888 and 4,959,294.

Specifically, preferred sensitizing dyes are dyes represented by the following formulas (S1) to (S4):

Formula (S1)

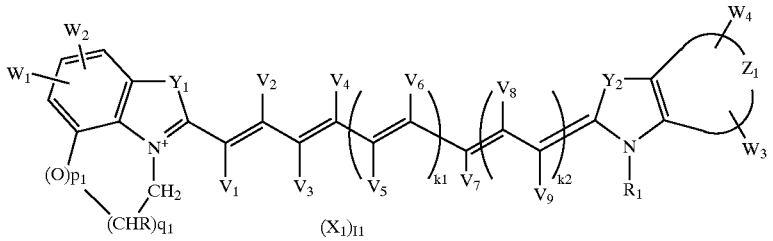

Formula (S2)

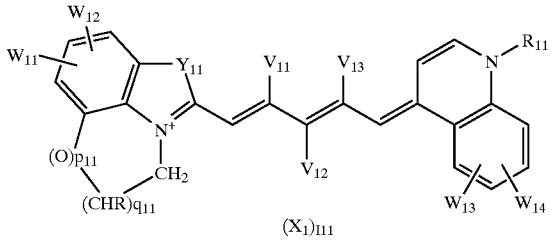

Formula (S3)

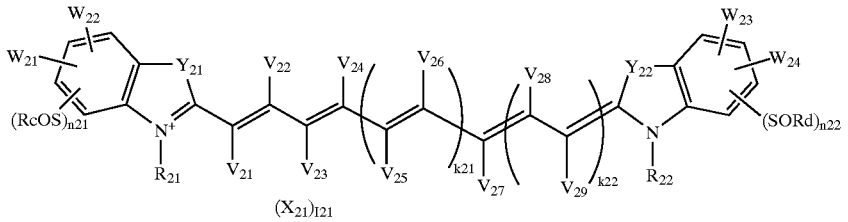

-continued

Formula (S4)

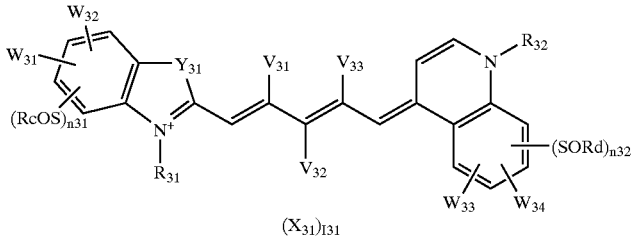

In formulas (S1) to (S4), $Y_1$, $Y_2$, $Y_{11}$, $Y_{21}$, $Y_{22}$ and $Y_{31}$ each are independently an oxygen atom, a sulfur atom, a selenium atom, —C(Ra)(Rb)— group or —CH═CH— group, in which Ra and Rb each are a hydrogen atom, an alkyl group (preferably having 1 to 5 carbon atoms) or a non-metallic atom group necessary to form an aliphatic spiro-ring; $Z_1$ is a non-metallic atom group necessary to form a 5- or 6-membered ring; $R_1$, $R_{11}$, $R_{21}$, $R_{22}$, $R_{31}$ and $R_{32}$ each are an aliphatic group or a non-metallic atom group necessary to form a condensed ring between $R_1$ and $W_3$ or between $R_{11}$ and $W_{14}$; Rc and Rd each are independently an unsubstituted lower alkyl group, a cycloalkyl group, an aralkyl group, an aryl group or a heterocyclic group; $W_1$, $W_2$, $W_3$, $W_4$, $W_{11}$, $W_{12}$, $W_{13}$, $W_{14}$, $W_{21}$, $W_{22}$, $W_{23}$, $W_{24}$, $W_{31}$, $W_{32}$, $W_{33}$ and $W_{34}$ each are independently a hydrogen atom, a substituent or a non-metallic atom group necessary to form a condensed ring by bonding between $W_1$ and $W_2$, $W_{11}$ and $W_{12}$, $W_{21}$ and $W_{22}$, $W_{23}$ and $W_{24}$, $W_{31}$ and $W_{32}$, or $W_{33}$ and $W_{34}$; $V_1$ to $V_9$, $V_{11}$ to $V_{13}$, $V_{21}$ to $V_{29}$, and $V_{31}$ to $V_{33}$ each are independently a hydrogen atom, a halogen atom, an amino group, an alkylthio group, an arylthio group, a lower alkyl group, a lower alkoxyl group, an aryl group, an aryloxyl group, a heterocyclic group or a non-metallic atom group necessary to form a 5- to 7-membered ring by bonding between $V_1$ and $V_3$, $V_2$ and $V_4$, $V_3$ and $V_5$, $V_2$ and $V_6$, $V_5$ and $V_7$, $V_6$ and $V_8$, $V_7$ and $V_9$, $V_{11}$ and $V_{13}$, $V_{21}$ and $V_{23}$, $V_{22}$ and $V_{24}$, $V_{23}$ and $V_{25}$, $V_{24}$ and $V_{26}$, $V_{25}$ and $V_{27}$, $V_{26}$ and $V_{28}$, $V_{27}$ and $V_{29}$, or $V_{31}$ and $V_{33}$; $X_{21}$ and $X_{31}$, provided that at least one of $V_1$ to $V_9$ and at least one of $V_{11}$ to $V_{13}$ are a group other than a hydrogen atom; $X_1$, $X_{11}$, $X_{21}$ and $X_{31}$ each are an ion necessary to compensate for an intramolecular charge; l1, l11, l21 and l31 each an ion necessary to compensate for an intramolecular charge; k1, k2, k31 and k32 each are 0 or 1; n21, n22, n31 and n32 each are 0, 1 or 2;, provided that n1 and n22, and n31 and n32 are not 0 at the same time; p1 and p11 are each 0 or 1; q1 and q11 each are 1 or 2, provided that the sum of p1 and q1 and the sum of p11 and q11 each are respectively not more than 2.

Of formulas (S1) and (S2), a compound represented by the following formula (S1-1) or (S2-1) is more preferred:

Formula (S1-1)

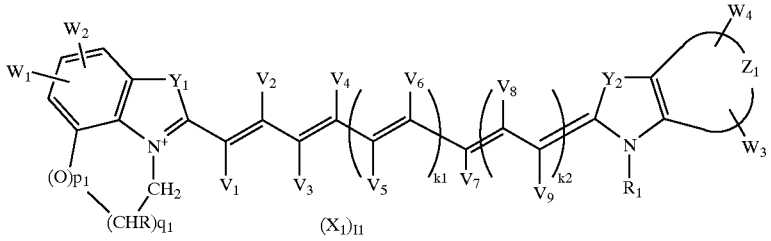

Formula (S2-1)

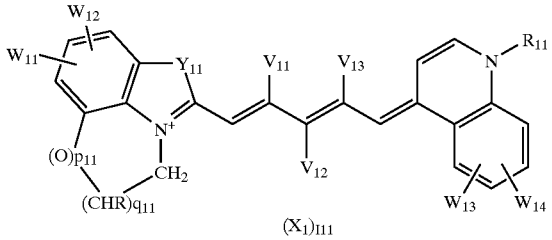

wherein $Y_1$, $Y_2$ and $Y_{11}$ each are independently an oxygen atom, a sulfur atom, a selenium atom, —C(Ra)(Rb)— group or —CH═CH— group, in which Ra and Rb each are a hydrogen atom, a lower alkyl group or an atomic group necessary to form an aliphatic spiro ring when Ra and Rb are linked with each other; $Z_1$ is an atomic group necessary to form a 5- or 6-membered ring; R is a hydrogen atom, a lower alkyl, a cycloalkyl group, an aralkyl group, a lower alkoxyl group, an aryl group, a hydroxy group or a halogen atom; $W_1$, $W_2$, $W_3$, $W_4$, $W_{11}$, $W_{12}$, $W_{13}$ and $W_{14}$ each are independently a hydrogen atom, a substituent or a non-metallic atom group necessary to form a condensed ring by bonding between $W_1$ and $W_2$ or $W_{11}$ and $W_{12}$; $R_1$ and $R_{11}$ are each an aliphatic group or a non-metallic atom group necessary to form a condensed ring by bonding between $R_1$ and $W_3$ or $R_{11}$ and $W_{14}$; $L_1$ to $L_9$, and $L_{11}$ to $L_{15}$ each are independently a methine group; $X_1$ and $X_{11}$ each are an ion necessary to compensate for an intramolecular charge; l1 and l11 each an ion necessary to compensate for an intramolecular charge; k1 and k2 each are 0 or 1; p1 and p11 are each 0 or 1; q1 and q11 each are 1 or 2, provided that the sum of p1 and q1 and the sum of p11 and q11 each are respectively not more than 2.

Substituents will be further described. Thus, substituents of the compounds represented by formulas (S1), (S2), (S1-1), (S2-1), (S3), and (S4) will be explained below.

The 5- or 6-membered condensed rings completed by an atomic group represented by $Z_1$ include a condensed cyclohexene ring, a condensed benzene ring, a condensed thiophene ring, a condensed pyridine ring, and a condensed naphthalene ring. Exemplary examples thereof include a benzoxazole ring, tetrahydrobenzoxazole ring, naphthooxazole ring, benzonephthooxazole ring, benzothiazole ring, tetrahydrobenzothiazole ring, naphthothiazole ring, benzonaphthothiazole ring; thienothiazole ring, thianaphthenothiazole ring, pyridothiazole ring, benzoselenazole ring, tetrahydrobenzoselenazole ring, naphthoselenazole ring, benzonaphthoselenazole ring, quinoline ring, 3,3-dialkylindolenine and 3,3-dialkylpyridopyrroline. Any substituent such as one represented by $W_1$ to $W_4$ described later can be substituted on the ring described above.

Examples of the aliphatic group represented by $R_1$, $R_{11}$, $R_{21}$, $R_{22}$, $R_{31}$, and $R_{32}$ include a branched or straight-chained alkyl group having 1 to 10 carbon atoms (e.g., methyl, ethyl, propyl, butyl, pentyl, i-pentyl, 2-ethyl-hexyl, octyl, decyl), an alkenyl group having 3 to 10 carbon atoms (e.g., 2-propenyl, 3-butenyl, 1-methyl-3-propenyl, 3-pentenyl, 1-methyl-3-butenyl, 4-hexenyl), and an aralkyl group having 7 to 10 carbon atoms (e.g., benzyl, phenethyl). These groups may further be substituted with a substituent, including groups such as a lower alkyl group (preferably having 1 to 5 carbon atoms, e.g., methyl, ethyl, propyl), a halogen atom (e.g., fluorine atom, chlorine atom, or bromine atom), a vinyl group, an aryl group (e.g., phenyl, p-tolyl, p-bromophenyl), trifluoromethyl, an alkoxyl group (e.g., methoxy, ethoxy, methoxyethoxy), an aryloxyl group (e.g., phenoxy, p-tolyloxy), cyano, a sulfonyl group (e.g., methanesulfonyl, trifluoromethansulfonyl), p-toluenesulfonyl), an alkoxycarbonyl group (e.g., ethoxycarbonyl, butoxycarbonyl), an amino group (e.g., amino, biscarboxymethylamino), an aryl group (e.g., phenyl, carboxyphenyl), a heterocyclic group (e.g., tetrahydrofurfuryl, 2-pyrrolidinone-1-yl), an acyl group (e.g., acetyl, benzoyl), an ureido group (e.g., ureido, 3-methylureido, 3-phenylureido), a thioureido group (e.g., thioureido, 3-methylthioureido), an alkylthio group (e.g., methylthio, ethylthio), an arylthio group (e.g., phenylthio), a heterocyclic-thio group (e.g., 2-thienythio, 3-thienylthio, 2-imidazolylthio), a carbonyloxy group (e.g., acetyloxy, propanoyloxy, benzoyloxy), an acylamino group (e.g., acetylamino, benzoylamino); and hydrophilic groups, such as a sulfo group, a carboxy group, a phosphono group, a sulfate group, hydroxy, mercapto, sulfino group, a carbamoyl group (e.g., carbamoyl, n-methylcarbamoyl, N,N-tetramethylenecarbamoyl), a sulfamoyl group (e.g., sulfamoyl, N,N-3-oxapentamethylenaminosulfonyl), a sulfonamido group (e.g., methanesulfonamido, butanesulfoneamido), a sulfonylaminocarbonyl group (e.g., methanesulfonylaminocarbonyl, ethanesulfonylaminocarbonyl), an acylaminosulfonyl group (e.g., acetoamidosulfonyl, methoxyacetoamidosulfonyl), an acylaminocarbonyl group (e.g., acetoamidocarbonyl, methoxyacetoamidocarbonyl), and a sulfinylaminocarbonyl group (e.g., methasulfinylaminocarbonyl, ethanesulfinylaminocarbonyl). Examples of aliphatic groups substituted by a hydrophilic group include carboxymethyl, carboxypentyl, 3-sulfatobutyl, 3-sulfopropyl, 2-hydroxy-3-sulfopropyl, 4-sulfobutyl, 5-sulfopentyl, 3-sulfopentyl, 3-sulfinobutyl, 3-phosphonopropyl, hydroxyethyl, N-methanesulfonylcarbamoylmethyl, 2-carboxy-2-propenyl, o-sulfobenzyl, p-sulfobenzyl and p-carboxybenzyl.

The lower alkyl group represented by R include a straight-chained or branched one having 1 to 5 carbon atoms, such as methyl, ethyl, propyl, pentyl and isopropyl. The cycloalkyl group includes, e.g., cyclopropyl, cyclobutyl and cyclopentyl. The aralkyl group includes, e.g., benzyl, phenethyl, p-methoxyphenylmethyl and o-acetylaminophenylethyl; the lower alkoxyl group includes one having 1 to 4 carbon atoms, including methoxy, ethoxy, propoxy and i-propoxy; the aryl group includes substituted or unsubstituted one, such as phenyl, 2-naphthyl, 1-naphthyl, o-tolyl, o-methoxyphenyl, m-chlorophenyl, m-bromophenyl, p-tolyl and p-ethoxyphenyl. These groups may be substituted by a substituent group, such as a phenyl group, a halogen atom (e.g., fluorine atom, chlorine atom, bromine atom, iodine atom), an alkoxyl group or hydroxy.

The lower alkyl group represented by Ra or Rb are the same as defined in R.

The lower alkyl group represented by Rc, and Rd includes a straight-chained or branched one having 1 to 5 carbon atoms, such as methyl, ethyl, propyl, pentyl and isopropyl. The cycloalkyl group includes, e.g., cyclopropyl, cyclobutyl and cyclopentyl. The aralkyl group includes, e.g., benzyl, phenethyl, p-methoxyphenylmethyl and o-acetylaminophenyl-ethyl; the aryl group includes substituted or unsubstituted one, such as phenyl, 2-naphthyl, 1-naphthyl, o-tolyl, o-methoxyphenyl, m-chlorophenyl, m-bromophenyl, p-tolyl and p-ethoxyphenyl; and the heterocyclic group includes substituted or unsubstituted one, such as 2-furyl, 5-methyl-2-furyl, 2-thienyl, 2-imidazolyl, 2-methyl-1-imidazolyl, 4-phenyl-2-thiazolyl, 5-hydroxy-2-benzothiazolyl, 2-pyridyl and 1-pyrrolyl. These groups, as described above, may be substituted by a substituent group, such as a phenyl group, a halogen atom, an alkoxyl group or hydroxy.

Examples of the substituents represented by $W_1$ to $W_4$, $W_{11}$ to $W_{14}$, $W_{21}$ to $W_{24}$, $W_{31}$ to $W_{34}$, $W_{41}$ to $W_{44}$ and $W_{51}$ to $W_{54}$ include an alkyl group (e.g., methyl, ethyl, butyl, I-butyl), an aryl group (including monocyclic and polycyclic ones such as phenyl and naphthyl), a heterocyclic group (e.g., thienyl, furyl, pyridyl, carbazolyl, pyrrolyl, indolyl), a halogen atom (e.g., fluorine atom, chlorine atom, bromine atom, iodine atom), a vinyl group, trifluoromethyl, an alkoxyl group (e.g., methoxy, ethoxy, methoxyethoxy), an aryloxyl group (e.g., phenoxy, p-tolyloxy), a sulfonyl group (e.g., methanesulfonyl, p-toluenesulfonyl), an alkoxycarbonyl group (e.g., ethoxycarbonyl, ethoxycarbonyl), an amino group (e.g., amino, biscarboxymethylamino), an acyl group (e.g., acetyl, benzoyl), an ureido group (e.g., ureido, 3-methylureido), a thioureido group (e.g., thioureido, 3-methylthioureido), an alkylthio group (e.g., methylthio, ethylthio), an alkenyl thio group, an arylthio group (e.g., phenylthio), hydroxy and styryl.

These groups may be substituted by the same substituents as described in the aliphatic group represented by $R_1$. Examples of substituted alkyl group include 2-methoxyethyl, 2-hydroxyethyl, 3-ethoxycarbonylpropyl, 2-carbamoylethyl, 2-methanesulfonylethyl, 3-methanesulfonylaminopropyl, benzyl, phenethyl, carboxymethyl, carboxymethyl, allyl, and 2-furylethyl. Examples of substituted aryl groups include p-carboxyphenyl, p-N,N-dimethylaminophenyl, p-morpholinophenyl, p-methoxyphenyl, 3,4-dimethoxyphenyl, 3,4-methylene-dioxyphenyl, 3-chlorophenyl, and p-nitrophenyl. Further, examples of substituted heterocyclic group include 5-chloro-2-pyridyl, 2-ethoxycarbonyl-2-pyridyl and 5-carbamoyl-2-pyridyl. $W_1$ and $W_2$, $W_3$ and $W_4$, $W_{11}$ and $W_{12}$, $W_{13}$ and $W_{14}$, $W_{21}$ and $W_{22}$, $W_{23}$ and $W_{24}$, $W_{31}$ and $W_{32}$, $W_{33}$ and $W_{34}$ each pair may combine to form a condensed ring, such as 5- or 6-membered saturated or unsaturated condensed carbon rings, which are further substituted by substituents as described in the aliphatic group.

Among the groups represented by $V_1$ to $V_9$, $V_{11}$ to $V_{13}$, $V_{21}$ to $V_{29}$, and $V_{31}$ to $V_{33}$, the halogen atom includes, e.g., a fluorine atom, chlorine atom, bromine atom and iodine atom; the amino group includes, e.g., amino, dimethylamino, diphenylamino, and methylphenylamino; the alkylthio group includes substituted and substituted ones, such as phenylthio or m-fluorphenylthio; the lower alkyl group includes straight-chained or branched one having five or less carbon atoms, such as methyl, ethyl, propyl, butyl, pentyl or isopropyl; the lower alkoxyl group includes one having four or less carbon atoms, such as methoxy, ethoxy, propoxy, or iso-propoxy; the aryl group includes substituted and unsubstituted ones, such as phenyl, 2-naphthyl, 1-naphthyl, o-tolyl, o-methoxyphenyl, m-chlorophenyl, m-bromophenyl, p-tolyl, and p-ethoxy phenyl; the aryloxyl group includes substituted and unsubstituted ones, such as phenoxy, p-tolyloxy, and m-carboxyphenyloxy; and the heterocyclic group includes substituted or unsubstituted ones, such as 2-furyl, 5-methyl-2-furyl2-thienyl, 2-imidazolyl, 2-methyl-1-imidazolyl, 4-phenyl-2-thiazolyl, 5-hydroxy-2-benzothiazolyl, 2-pyridyl, and 1-pyrrolyl. These groups may further be substituted by a substituent group, such as a phenyl group, a halogen atom, alkoxyl group, or hydroxy. $V_1$ and $V_3$, $V_2$ and $V_4$, $V_3$ and $V_5$, $V_4$ and $V_6$, $V_5$ and $V_7$, $V_6$ and $V_8$, $V_7$ and $V_9$, $V_{11}$ and $V_{13}$, $V_{21}$ and $V_{23}$, $V_{22}$ and $V_{24}$, $V_{23}$ and $V_{25}$, $V_{24}$ and $V_{26}$, $V_{25}$ and $V_{27}$, $V_{26}$ and $V_{28}$, $V_{27}$ and $V_{29}$, and $V_{31}$ and $V_{33}$ each pair may combine to form a 5- to 7-membered ring, such as a cyclopentene ring, cyclohexene ring, cycloheptene ring, and decalin ring, each of which may further be substituted by a lower alkyl group, lower alkoxyl group or aryl group, as described in R.

The methylene group represented by $L_1$ to $L_9$, $L_{11}$ to $L_{15}$ each are a substituted or unsubstituted methylene group. Examples of the substituent thereof include fluorine and chlorine atoms, a substituted or unsubstituted lower alkyl group (e.g., methyl, ethyl, I-propyl, benzyl), and a substituted or unsubstituted alkoxyl group (e.g., methoxy, ethoxy), a substituted or unsubstituted aryloxyl group (e.g., phenoxy, naphthoxy), a substituted or unsubstituted aryl group (e.g., phenyl, naphthyl, p-tolyl, o-carboxyphenyl), $N(U_1)(U_2)$, —SRg, a substituted or unsubstituted heterocyclic group [e.g., 2-thienyl, 2-furyl, N,N'-bis(methoxyethyl)barbituric acid], in which Rg is a lower alkyl group (preferably having 1 to 5 carbon atoms), an aryl group or a heterocyclic group and examples of —SRg include methylthio, ethylthio, benzylthio, phenylthio and tolylthio groups; $U_1$ and $U_2$ are each a substituted or unsubstituted lower alkyl group or aryl group, provided that $V_1$ and $V_2$ may combine to form a 5- or 6-membered nitrogen containing heterocyclic ring (e.g., pyrazole ring, pyrrol ring, pyrrolidine ring, morpholine ring, pyperizine ring, pyridine, pyrimidine ring, etc.). Methylene groups which are adjacent or distant by one may combine to form a 5- or 6-membered ring.

In cases where the compound represented by formula (1), (1-1), (2-1), (3) or (4) is substituted with a cationic- or anionic-charged group, a counter ion is formed by an anionic or cationic equivalent to compensate an intramolecular charge. As an ion necessary to compensate the intramolecular charge, which is represented by $X_1$, $X_{11}$, $X_{21}$, or $X_{31}$, examples of cations include a proton, an organic ammonium ion (e.g., triethylammonium, triethanolammonium) and inorganic cations (e.g., cations of lithium, sodium and potassium); and examples of acid anions include halide ions (e.g., chloride ion, bromide ion, iodide ion), p-toluenesulfonate ion, perchlorate ion, tetrafluoroborate ion, sulfate ion, methylsulfate ion, ethylsulfate ion, methanesulfonate ion, trifluoromethanesulfonate ion).

The infrared sensitizing dye according to the invention is preferably a dye characterized in that a three ring-condensed heterocyclic nucleus is formed by bonding between a nitrogen atom contained in a benzothiazole ring and a carbon atom at a peri-position; or that the dye is a long chain polymethine dye, in which a sulfonyl group is substituted on the benzene ring of the benzothiazole ring.

The infrared sensitizing dyes and spectral sensitizing dyes described above can be readily synthesized according to the methods described in F. M. Hammer, The Chemistry of Heterocyclic Compounds vol.18, "The cyanine Dyes and Related Compounds" (A. Weissberger ed. Interscience Corp., New York, 1964).

The infrared sensitizing dyes can be added at any time after preparation of silver halide. For example, the dye can be added to a light sensitive emulsion containing silver halide grains/organic silver salt grains in the form of by dissolution in a solvent or in the form of a fine particle dispersion, so-called solid particle dispersion. Similarly to the heteroatom containing compound having adsorptivity to silver halide, after adding the dye prior to chemical sensitization and allowing it to be adsorbed to silver halide grains, chemical sensitization is conducted, thereby preventing dispersion of chemical sensitization center specks and achieving enhanced sensitivity and minimized fogging.

These sensitizing dyes may be used alone or in combination thereof. The combined use of sensitizing dyes is often employed for the purpose of supersensitization. A supersensitizing compound, such as a dye which does not exhibit spectral sensitization or substance which does not substantially absorb visible light may be incorporated, in combination with a sensitizing dye, into the emulsion containing silver halide grains and organic silver salt grains used in photothermographic imaging materials of the invention.

Useful sensitizing dyes, dye combinations exhibiting super-sensitization and materials exhibiting supersensitization are described in RD17643 (published in December, 1978), IV-J at page 23, JP-B 9-25500 and 43-4933 (herein, the term, JP-B means published Japanese Patent) and JP-A 59-19032, 59-192242 and 5-341432. In the invention, an aromatic heterocyclic mercapto compound represented by the following formula (6) is preferred as a supersensitizer:

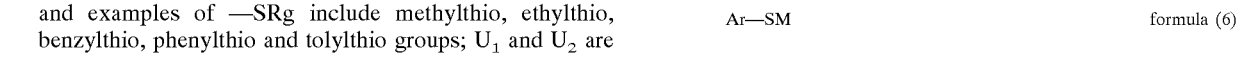

Ar—SM formula (6)

wherein M is a hydrogen atom or an alkali metal atom; Ar is an aromatic ring or condensed aromatic ring containing a nitrogen atom, oxygen atom, sulfur atom, selenium atom or tellurium atom. Such aromatic heterocyclic rings are preferably benzimidazole, naphthoimidazole, benzthiazole, naphthothiazole, benzoxazole, naphthooxazole, benzoselenazole, benzotellurazole, imidazole, oxazole, pyrazole, triazole, triazines, pyrimidine, pyridazine, pyrazine, pyridine, purine, and quinoline. Other aromatic heterocyclic rings may also be included.

A disulfide compound which is capable of forming a mercapto compound when incorporated into a dispersion of an organic silver salt and/or a silver halide grain emulsion is also included in the invention. In particular, a preferred example thereof is a disulfide compound represented by the following formula:

Ar—S—S—Ar Formula (7)

wherein Ar is the same as defined in formula (6).

The aromatic heterocyclic rings described above may be substituted with a halogen atom (e.g., Cl, Br, I), a hydroxy group, an amino group, a carboxy group, an alkyl group (having one or more carbon atoms, and preferablyl to 4 carbon atoms) or an alkoxy group (having one or more carbon atoms, and preferablyl to 4 carbon atoms).

In addition to the foregoing supersensitizers, a compound described in Japanese Patent Application No. 2000-70296, represented by the following formula (1) and a macrocyclic compound can also employed as a supersensitizer in the invention:

formula (1)

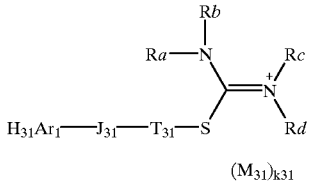

wherein $H_{31}Ar$ represent an aromatic hydrocarbon group or an aromatic heterocyclic group; $T_{31}$ represents a bivalent aliphatic hydrocarbon linkage group or a direct bond; $J_{31}$ represents a bivalent linking group containing at least one of an oxygen atom, sulfur atom and nitrogen atom or a direct bond; Ra, Rb, Rc and Rd each represent a hydrogen atom, an acyl group, an aliphatic hydrocarbon group, an aryl group or a heterocyclic group, or Ra and Rb, Rc and Rd, Ra and Rc, or Rb and Rd combine with each other to form a nitrogen containing ring; $M_{31}$ represents an ion necessary to neutralize an intramolecular charge; and $k_{31}$ represents the number of the ion necessary to neutralize an intramolecular charge.

The bivalent, aliphatic hydrocarbon linkage group represented by $T_{31}$ include a straight-chain, branched cyclic alkylene group (preferably having 1 to 20 carbon atoms, more preferably 1 to 16 carbon atoms, and still more preferably 1 to 12 carbon atoms), an alkenylene group (preferably having 2 to 20 carbon atoms, more preferably 2 to 16 carbon atoms, and still more preferably 2 to 12 carbon atoms), an alkynylene group (preferably having 2 to 20 carbon atoms, more preferably 2 to 16 carbon atoms, and still more preferably 2 to 12 carbon atoms), each of which may be substituted by substituent group(s). The aliphatic hydrocarbon group represented by Ra, Rb, Rc, Rd, Re and Rf include, for example, an alkyl group (preferably having 1 to 20 carbon atoms, more preferably 1 to 16 carbon atoms and still more preferably 1 to 12 carbon atoms), an alkenyl group (preferably having 2 to 20 carbon atoms, more preferably 2 to 16 carbon atoms, and still more preferably 2 to 12 carbon atoms), an alkynyl (preferably having 2 to 20 carbon atoms, more preferably 2 to 16 carbon atoms , and still more preferably 2 to 12 carbon atoms) an aryl group (preferably having 6 to 30 carbon atoms, more preferably 6 to 20 carbon atoms, and still more preferably 6 to 12 carbon atoms, e.g., phenyl, naphthyl), and a heterocyclic group (e.g., 2-thiazolyl, 1-piperadynyl, 2-pyridyl, 3-pyridyl,2-thienyl, 2-benzimidazolyl, carbazolyl, etc.). The heterocyclic group may be a monocyclic ring or a ring condensed with other ring. These groups each may be substituted at any position. Examples of such substituent groups include an alkyl group (including a cycloalkyl group and an aralkyl group, and preferably having 1 to 20 carbon atoms, more preferably 1 to 12 carbon atoms and still more preferably 1 to 8 carbon atoms, such as methyl, ethyl, n-propyl, isopropyl, n-butyl, tert-butyl, n-heptyl, n-octyl, n-decyl, n-undecyl, n-hexadecyl, cyclopropyl, cyclopentyl, cyclohexyl, benzyl, phenethyl), an alkenyl group (preferably having 2 to 20 carbon atoms, more preferably 2 to 12 carbon atoms, and still more preferably 2 to 8 carbon atoms, e.g., vinyl, allyl, 2-butenyl, 3-pentenyl, etc.), an alkynyl (preferably having 2 to 20 carbon atoms, more preferably 2 to 12 carbon atoms, and still more preferably 2 to 8 carbon atoms, e.g., propargyl, 3-pentynyl, etc.), aryl group (preferably having 6 to 30 carbon atoms, more preferably 6 to 20 carbon atoms, and still more preferably 6 to 12 carbon atoms, e.g., phenyl, p-tolyl, o-aminophenyl, naphthyl), an amino group (preferably having 0 to 20 carbon atoms, more preferably 0 10 carbon atoms, and still more preferably 0 to 6 carbon atoms, e.g., amino, methylamino, ethylamino, dimethylamino, diethylamino, diphenylamino, dibenzylamino, etc.), an imino group (preferably having 1 to 20 carbon atoms, more preferably 1 to 18 carbon atoms, and still more preferably 1 to 12 carbon atoms, e.g., methylimono, ethylimono, propylimino, phenylimino), an alkoxy group (preferably having 1 to 20 carbon atoms, more preferably 1 to 12 carbon atoms, and still more preferably 1 to 8 carbon atoms, e.g., methoxy, ethoxy, butoxy, etc.), an aryloxy group (preferably having 6 to 20 carbon atoms, more preferably 6 to 16 carbon atoms, and still more preferably 6 to 12 carbon atoms, e.g., phenyloxy, 2-naphthyloxy, etc.), an acyl group (preferably having 1 to 20 carbon atoms, more preferably 1 to 16 carbon atoms, and still more preferably 1 to 12 carbon atoms, e.g., acetyl, formyl, pivaloyl, benzoyl, etc.), an alkoxycarbonyl group (preferably having 2 to 20 carbon atoms, more preferably 2 to 16 carbon atoms, and still more preferably 2 to 12 carbon atoms, e.g., methoxycarbonyl, ethoxycarbonyl, etc.), an aryloxycarbonyl group (preferably having 7 to 20 carbon atoms, more preferably 7 to 16 carbon atoms, and still more preferably 7 to 10 carbon atoms, e.g., phenyloxycarbonyl, etc.), an acyloxy group (preferably having 1 to 20 carbon atoms, more preferably 1 to 16 carbon atoms, and still more preferably 1 to 10 carbon atoms, e.g., acetoxy, benzoyloxy, etc.), an acylamino group (preferably having 1 to 20 carbon atoms, more preferably 1 to 16 carbon atoms, and still more preferably 1 to 10 carbon atoms, e.g., acetylamino, benzoylamino, etc.), an alkoxycarbonylamino group (preferably having 2 to 20 carbon atoms, more preferably 2 to 16 carbon atoms, and still more preferably 2 to 12 carbon atoms, e.g., methoxycarbonylamino, etc.), an aryloxycarbonylamino group (preferably having 7 to 20 carbon atoms, more preferably 7 to 16 carbon atoms, and still more preferably 7 to 12 carbon atoms, e.g., phenyloxycarbonylamino, etc.), a sulfonylamino group (preferably having 1 to 20 carbon atoms, more preferably 1 to 16 carbon atoms, and still more preferably 1 to 12 carbon atoms, e.g., methanesulfonylamino, benzenesulfonylamino, etc.), a sulfamoyl group (preferably having 0 to 20 carbon atoms, more preferably 0 to 16 carbon atoms, and still more preferably 0 to 12 carbon atoms, e.g.,sulfamoyl, methylsulfamoyl, dimethylsulfamoyl, phenylsulfamoyl, etc.), a carbamoyl group (preferably having 1 to 20 carbon atoms, more preferably 1 to 16 carbon atoms, and still more preferably 1 to 12 carbon atoms, e.g., carbamoyl, methylcarbamoyl, diethylcarbamoyl, phenylcarbamoyl, etc.), an alkylthio group (preferably having 1 to 20 carbon atoms, more preferably 1 to 16 carbon atoms, and still more preferably 1 to 12 carbon atoms, e.g., methylthio, ethylthio, etc.), arylthio group (preferably having 6–20 carbon atoms, more preferably 6 to 16 carbon atoms and still more preferably 6 to 12 carbon atoms, e.g., phenylthio), an alkylsulfonyl or arylsulfonyl group (preferably having 1 to 20 carbon atom, more preferably 1 to 16 carbon atoms, and still more preferably 1 to 12 carbon atoms, e.g., methanesulfonyl, tosyl) an alkylsulfonyl or arylsulfinyl group (preferably having 1 to 20 carbon atoms, more preferably 1 to 16 carbon atoms, and still more preferably 1 to 12 carbon atoms, e.g., methanesulfinyl, benzenesulfinyl, etc.), an ureido group (preferably having 1 to 20 carbon atoms, more preferably 1 to 16 carbon atoms, and still more preferably 1 to 12 carbon atoms, e.g., ureido, methylureido, phenylureido ,etc.), a phosphoric acid amide group (preferably having 1 to 20 carbon atoms, more preferably 1 to 16 carbon atoms, and still more preferably 1 to 12 carbon atoms, e.g., diethylphosphoric acid amido, phenylphosphoric acid amido, etc.), hydroxy group, mercapto group, a halogen atom (e.g., fluorine atom, chlorine atom, bromine atom, iodine atom), cyano group, sulfo group, sulfino group, carboxy group, phosphono group, phosphono group, nitro group, hydroxamic acid group, hydrazino group, and a heterocyclic group (e.g., imidazolyl, benzimidazolyl, thiazolyl, benzothiazolyl, carbazolyl, pyridyl, furyl, piperidyl, morphoryl. etc.).

Of these substituent groups described above, hydroxy group, mercapto group, sulfo group, sulfino group, carboxy group, phosphono group, and phosphino group include their salts. The substituent group may be further substituted. In this case, plural substituent may be the same or different. The preferred substituent groups include an alkyl group, aralkyl group, alkoxy group, aryl group, alkylthio group, acyl group, acylamino group, imino group, sulfamoyl group, sulfonyl group, sulfonylamino group, ureido group, amino group, halogen atom, nitro group, heterocyclic group, alkoxycarbonyl group, hydroxy group, sulfo group, carbamoyl group, and carboxy group. Specifically, an alkyl group, alkoxy group, aryl group, alkylthio group, acyl group, acylamino group, imino group, sulfonylamino group, ureido group, amino group, halogen atom nitro group, heterocyclic group, alkoxycarbonyl group, hydroxy group, sulfo group, carbamoyl group and carboxy group are more preferred; and an alkyl group, alkoxy group, aryl group, alkylthio group, acylamino group, imino group, ureido group, amino group, heterocyclic group, alkoxycarbonyl group, hydroxy group, sulfo group, carbamoyl group and carboxy group are still more preferred.

The amidino group include a substituted one and examples of the substituent group include an alkyl group (e.g., methyl, ethyl, pyridylmethyl, benzyl, phenethyl, carboxybenzyl, aminophenylmethyl, etc.), an aryl group (e.g., phenyl, p-tolyl, naphthyl, o-aminophenyl, o-methoxyphenyl, etc.), and a heterocyclic group (e.g., 2-thiazolyl, 2-pyridyl, 3-pyridyl, 2-furyl, 3-furyl, 2-thieno, 2-imidazolyl, benzothiazolyl, carbazolyl, etc.).

Examples of a bivalent linking group containing at least one of an oxygen atom, sulfur atom and nitrogen atom, represented by $J_{31}$ include the following groups, which may be combined:

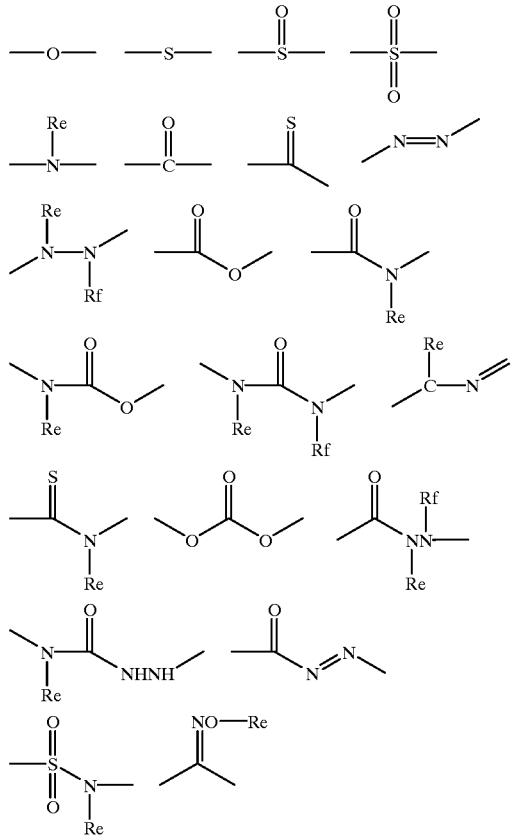

wherein Re and Rf are the same as defined in Ra through Rd. The aromatic hydrocarbon group represented by $ArH_{31}$ is a monocyclic or condensed aryl group (preferably having 6 to 30 carbon atoms, and more preferably 6 to 20 carbon atoms). Examples thereof include phenyl and naphthyl, and phenyl is preferred.

The aromatic heterocyclic group represented by $ArH_{31}$ is a 5- to 10-membered unsaturated heterocyclic group containing at least one of N, O and S, which may be monocyclic or condensed with other ring. A heterocyclic ring of the heterocyclic group is preferably a 5- or 6-membered aromatic heterocyclic ring or its benzo-condensed ring, more preferably a nitrogen-containing, 5- or 6-membered aromatic heterocyclic ring or its benzo-condensed ring, and still more preferably one or two nitrogen-containing, 5- or 6-membered aromatic heterocyclic ring or its benzo-condensed ring.

Examples of the aromatic heterocyclic group include groups derived from thiophene, furan, pyrrole, imidazole, pyrazolo, pyridine, pyrazine, pyridazine, triazole, triazine, indole, indazole, purine, thiadiazole, oxadiazole, quinoline, phthalazine, naphthylizine, quinoxaline, quinazolone, cinnoline, pteridine, acrydine, phenathroline, phenazine, tetrazole, thiazole, oxazole, benzimidazole, benzoxazole, benzthiazole, benzothiazoline, benzotriazole, tetrazaindene, and carbazole. Of these, groups derived from imidazole, pyrazolo, pyridine, pyrazine, indole, indazole, thiadiazole, oxadiazole, quinoline, phenazine, tetrazole, thiazole, oxazole, benzimidazole, benzoxazole, benzthiazole, benzothiazoline, benzotriazole, tetrazaindene, and carbazole are preferred; and groups derived from imidazole, pyridine, pyrazine, quinoline, phenazine, tetrazole, thiazole, benzoxazole, benzoimidazole, benzthiazole, benzothiazoline, benzotriazole, and carbazole are more preferred.

The aromatic hydrocarbon group and aromatic heterocyclic group represented by $ArH_{31}$ may be substituted. The substituent group is the same as the substituent groups defined in $T_{31}$. The substituent group may be further substituted, and plural substituting group may be the same or different. Further, the group represented by $ArH_{31}$ is preferably an aromatic heterocyclic group.

The aliphatic hydrocarbon group represented by Ra, Rb, Rc, Rd, Re and Rf include, for example, an alkyl group (preferably having 1 to 20 carbon atoms, more preferably 1 to 16 carbon atoms and still more preferably 1 to 12 carbon atoms), an alkenyl group (preferably having 2 to 20 carbon atoms, more preferably 2 to 16 carbon atoms, and still more preferably 2 to 12 carbon atoms), an alkynyl (preferably having 2 to 20 carbon atoms, more preferably 2 to 16 carbon atoms, and still more preferably 2 to 12 carbon atoms) an aryl group (preferably having 6 to 30 carbon atoms, more preferably 6 to 20 carbon atoms, and still more preferably 6 to 12 carbon atoms, e.g., phenyl, naphthyl), and a heterocyclic group (e.g., 2-thiazolyl, 1-piperadynyl, 2-pyridyl, 3-pyridyl,2-thienyl, 2-benzimidazolyl, carbazolyl, etc.). The heterocyclic group may be a monocyclic ring or a ring condensed with other ring. The acyl group represented by Ra, Rb, Rc, Rd, Re and Rf includes an aliphatic or aromatic one, such as acetyl, benzoyl, formyl, and pivaloyl. The nitrogen containing heterocyclic group formed by combination of Ra and Rb, Rc and Rd, Ra and Rc, or Rb and Rd includes a 3- to 10-membered , saturated or unsaturated heterocyclic ring (e.g., ring groups such as piperidine ring, piperazine ring, acridine ring, pyrrolidine ring, pyrrol ring and morphorine ring).

Examples of acid anions used as the ion necessary to neutralize an intramolecular charge, represented by $M_{31}$ include a halide ion (e.g., chloride ion, bromide ion, iodide ion, etc.), p-toluenesulfonate ion, perchlorate ion, tetrafluorobarate ion, sulfate ion, methylsulfate ion, ethylsulfate ion, methansufonic acid ion and trifluoromethanesulfonic acid ion.

The supersensitizer is incorporated into the emulsion layer containing an organic silver salt and silver halide grains, preferably in an amount of 0.001 to 1.0 mol, and more preferably 0.01 to 0.5 mol per mol of silver.

Bonders used in the image forming layer are transparent or translucent and generally colorless, including natural polymers, synthetic polymers or copolymers and film forming mediums. Exemplary examples thereof include gelatin, gum Arabic, polyvinyl alcohol, hydroxyethyl cellulose, cellulose acetate, cellulose acetate butyrate, polyvinyl pyrrolidine, casein, starch, polyacrylic acid, poly(methyl methacrylate), poly(methylmethacrylic acid), polyvinyl chloride, polymethacrylic acid, copoly(styrene-anhydrous maleic acid), copoly(styrene-acrylonitrile), copoly(styrene-butadiene9, polyvinyl acetals (e.g., polyvinyl formal, polyvinyl butyral), polyesters, polyurethanes, phenoxy resin, polyvinylidene chloride, polyepoxides, polycarbonates, polyvinyl acetate, cellulose esters, and polyamides, these of which may be hydrophilic or hydrophobic.

Of these, polyvinyl acetals are preferred as a binder used for the light sensitive layer, and polyvinyl acetal is specifically preferred binder. Further, for a light insensitive layer such as an over-coating layer or a sublayer, specifically, a protective layer or a back coating layer are preferred cellulose esters exhibiting a relatively high softening temperature, such as triacetyl cellulose and cellulose acetate-butyrate. The foregoing binders may optionally be used in combination.

The binder is used in an amount within the range effective to function as a binder. The effective range can be readily determined by one skilled in the art. As a measure to hold an organic silver salt in the light sensitive layer, the ratio by weight of a binder to an organic silver salt is preferably 15:1 to 1:2, and more preferably 8:1 to 1:1. Thus, the amount of a binder in the light sensitive elayer is preferably 1.5 to 6 $g/m^2$, and more preferably 1.7 to 5 $g/m^2$. The amount of less than 1.5 $g/m^2$ results in an increase in unexposed areas, leading to levels unacceptable in practical use.

In cases where a coating solution to form a light sensitive layer of the photothermographic imaging material contains an aqueous-dispersed polymer latex, at least 50% by weight of a total binder content of the light sensitive layer-coating solution is preferably accounted for by the aqueous-dispersed polymer latex. Alternatively, in cases where the light sensitive layer contains a polymer latex, the polymer latex preferably accounts for at least 50% by weigh, and more preferably at least 70% by weight of a total binder content of the light sensitive layer.

Herein, the polymer latex is a water-insoluble polymeric material which is dispersed in an aqueous dispersing medium in the form of fine particles. The dispersion form thereof may be any one of a form in which a polymer is emulsified in a dispersing medium, a form of being emulsion-polymerized, being dispersed in the form of a micell and a form in which a polymer has a hydrophilic partial structure and its molecular chain is in the form of a molecular dispersion.

The mean particle size of dispersing particles is 1 to 50,000 nm, and preferably 5 to 1,000 nm. The particle size distribution thereof is not specifically limited and may be of broad size distribution or monodisperse.

The polymeric latexes used in the invention may be those having a uniform structure as well as core/shell type latexes. In this case, it is sometimes preferred that the glass transition temperature is different between the core and shell. The minimum film-forming (or tarnishing) temperature (MFT) of the polymeric latexes is preferably −30 to 90° C., and more preferably 0 to 70° C. A tarnishing aid is also called a plasticizer, which is an organic compound (conventionally, an organic solvent) capable of lowering the MFT of a polymeric latex and described in "Chemistry of Synthetic Latex" (S. Muroi, published by KOBUNSHI-KANKOKAI, 1970).

Polymers used for polymeric latexes include acryl resin, vinyl acetate resin, polyester resin, polyurethane resin, rubber type resin, vinyl chloride resin, vinylidene chloride resin, polyolefin resin and their copolymers. Polymers may be a straight-chained polymer or branched polymer, or a cross-linked polymer, including homopolymers and copolymers. The copolymer may be a random copolymer or a block copolymer. The number-averaged molecular weight of the copolymer is preferably 5,000 to 1000,000, and more preferably 10,000 to 100,000. In cases where the molecular weight is excessively small, mechanical strength of an light sensitive layer such as a light-sensitive layer is insufficient, excessively large molecular weight results in deterioration in film forming property.

The polymer latex used in the invention preferably exhibits an equlibrium moisture content at 25° C. and 60% RH (relative humidity) of 0.01 to 2%, and more preferably 0.01 to 1% by weight. The definition and measurement of the equlibrium moisture content are described, for example, in "KOBUNSHIKOGAKU-KOZA 14: KOBUNSHI-ZAIRYO SHIKENHO" (Polymer Engineering Series 14.: Polymer Material Test Method), edited by Kobunshi Gakkai, published by Chijin Shoin.

Exemplary examples of polymer latexes used as binder include a latex of methylmethacrylate/ethylmethacrylate/methacrylic acid copolymer, a latex of methylmethacrylate/2-ethylhexylacrylate/styrene/acrylic acid copolymer, a latex of styrene/butadiene/acrylic acid copolymer, a latex of styrene/butadiene/divinylbenzene/methacrylic acid copolymer, a latex of methylmethacrylate/vinyl chloride/acrylic acid copolymer, and a latex of vinylidene chloride/ethylacrylate/acrylonitrile/methacrylic acid copolymer. These polymers may be used alone or may be blended.

The polymer latex used in the invention preferably contains, as polymer species, 0.1 to 10% by weight of a carboxylic acid component, such as an acrylate or methacrylate component. Further, a hydrophilic polymer such as gelatin, polyvinyl alcohol, methyl cellulose, hydroxypropyl cellulose, carboxymethyl cellulose and hydroxypropylmethyl cellulose may be added within the range of not more than 50% by weight of the total binder. The hydrophilic binder is added preferably in an amount of not more than 30% by weight, based on the total binder of the light sensitive layer.

In preparation of a coating solution to form the light sensitive layer, an organic silver salt and an aqueous-dispersed polymer latex may be added in any order, i.e., either one may be added in advance or both ones may be simultaneously added, but the polymer latex is preferably added later. It is further preferred that the organic silver salt is mixed with a reducing agent prior to addition of the polymer latex. After mixing the organic silver salt and polymer latex, the coating solution is preferably maintained at a temperature of 30 to 65° C., more preferably 35 to 60° C., and still more preferably 35 to 55° C. since there are problems such that an excessively low temperature often vitiates the coat surface and an excessively high temperature results in increased fogging. To maintain such a temperature, a vessel to prepare the coating solution may be maintained a prescribed temperature. In coating a coating solution of the light sensitive layer, after mixing the organic silver salt and aqueous-dispersed polymer latex, a coating solution aged for 30 min to 24 hrs. is preferably used and a coating solution aged for 1 to 12 hrs. is more preferred. Herein, the expression "after mixing" refers to after the organic silver salt and the aqueous-dispersed polymer latex are added and additives are homogeneously dispersed.

Although it is commonly known that the use of a crosslinking agent in such a binder as described above improves layer adhesion and lessens unevenness in development, the use of the crosslinking agent is also effective in fog inhibition during storage and prevention of print-out after development.

Crosslinking agents usable in the invention include various commonly known crosslinking agents used for photographic materials, such as aldehyde type, epoxy type, vinylsulfon type, sulfonester type, acryloyl type, carbodiimide type crosslinking agents, as described in JP-A 50-96216. Specifically preferred are an isocyanate type compound, epoxy compound and acid anhydride, as shown below. One of the preferred crosslinking agents is an isocyanate or thioisicyanate compound represented by the following formula:

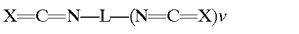

$$X{=}C{=}N{-}L{-}(N{=}C{=}X)_v \qquad \text{Formula (8)}$$

wherein v is 1 or 2; L is a bivalent linkage group of an alkylene, alkenylene, arylene or alkylarylene group; and X is an oxygen atom or a sulfur atom. An arylene ring of the arylene group may be substituted. Preferred substituents include a halogen atom (e.g., bromine atom, chlorine atom), hydroxy, amino, carboxy, alkyl and alkoxyl.

The isocyanate crosslinking agent is an isocyanate compound containing at least two isocyanate group and its adduct. Examples thereof include aliphatic isocyanates, alicyclic isocyanates, benzeneisocyanates, naphthalenediisocyanates, biphenyldiisocyanates, diphenylmethandiisocyanates, triphenylmethanediisocyanates, triisocyanates, tetraisocyanates, their adducts and adducts of these isocyanates and bivalent or trivalent polyhydric alcohols. Exemplary examples are isocyanate compounds described in JP-A 56-5535 at pages 10–12, including: ethanediisocyanate, butanediisocyanate, hexanediisocyanate, 2,2-dimetylpentanediisocyanate, 2,2,4-trimethylpentanediisocyanate, decanediisocyanate, ω,ω'-diisocyanate-1,3-dimethylbenzol, ω,ω'-diisocyanate-1,2-dimethylcyclohexanediisocyanate, ω,ω'-diisocyanate-1,4-diethylbenzol, ω,ω'-diisocyanate-1,5-dimethylnaphthalene, ω,ω'-diisocyanate-n-propypbiphenyl, 1,3-phenylenediisocyanate, 1-methylbenzol-2,4-diisocyanate, 1,3-dimethylbenzol-2,6-diisocyanate, naphthalene-1,4-diisocyanate, 1,1'-naphthyl-2,2'-diisocyanate, biphenyl-2,4'-diisocyanate, 3,3'-dimethylbiphenyl-4,4'-diisocyanate, diphenylmethane-4,4'-diisocyanate, 2,2'-dimethyldiphenylmethane-4,4'-diisocyanate, 3,3'-dimethoxydiphenylmethane-4,4'-diisocyanate, 4,4'-diethoxydiphenylmethane-4,4'-diisocyanate, 1-methylbenzol-2,4,6-triisocyanate, 1,3,5-trimethylbenzene-2,4,6-triisocyanate, diphenylmethane-2,4,4'-triisocyanate, triphenylmethane-4,4',4'-triisocyanate, tolylenediisocyanate, 1,5-naphthylenediisocyanate; dimmer or trimer adducts of these isocyanate compounds (e.g., adduct of 2-mole hexamethylenediisocyanate, adduct of 3 mole hexamethylenediisicyanate, adduct of 2 mole 2,4-tolylenediisocyanate, adduct of 3 mole 2,4-tolylenediisocyanate); adducts of two different isocyanates selected from these isocyanate compounds described above; and adducts of these isocyanate compounds and bivalent or trivalent polyhydric alcohol (preferably having up to 20 carbon atoms, such as ethylene glycol, propylene glycol, pinacol, and trimethylol propane), such as adduct of tolylenediisocyanate and trimethylolpropane, or adduct of hexamethylenediisocyanate and trimethylolpropane of these, adduct of isocyanate and polyhydric alcohol improves adhesion between layers, exhibiting high capability of preventing layer peeling, image slippage or production of bubbles. These polyisocyanate compounds may be incorporated into any portion of the photothermographic material, for example, into the interior of a support (e.g., into size of a paper support) or any layer on the photosensitive layer-side of the support, such as a photosensitive layer, surface protective layer, interlayer, antihalation layer or sublayer. Thus it may be incorporated into one or plurality of these layers.

The thioisocyanate type crosslinking agent usable in the invention is to be a compound having a thioisocyanate structure, corresponding to the isocyanates described above.

The crosslinking agents described above are used preferably in an amount of 0.001 to 2 mol, and more preferably 0.005 to 0.5 mol per mol of silver.

The isocyanate compounds and thiisocyanate compounds used in the invention are preferably those which are capable of functioning as a hardener. Even when "v" of formula (8) is zero, i.e., even a compound containing only one functional group provides favorable effects.

Examples of silane compounds used as a crosslinking agent include the compounds described in Japanese Patent Application No. 2000-77904, represented by the following formula (1) or (2):

formula( 1)

$$(R^1O)_m—Si—(L_1—R^2)_n$$

formula (2)

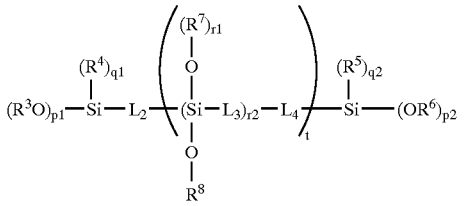

In the formulas, $R^1$, $R^2$, $R^3$, $R^4$, $R^5$, $R^6$, $R^7$ and $R^8$ are each a straight chain, branched or cyclic alkyl group having 1 to 30 carbon atoms (e.g., methyl, ethyl, butyl, octyl, dodecyl, cycloalkyl, alkenyl group (e.g., propenyl, butenyl, nonanyl), an alkynyl group (e.g., acetylene group, bisacetylene group, phenylacetylene group), an aryl group (e.g., phenyl, naphthyl) or a heterocyclic group (e.g., tetrahydropyran, pyridyl group, furyl, thiophenyl, imidazolyl, thiazolyl, thiazolyl, oxadiazolyl). These groups may be substituted and substituent groups include any one of electron-withdrawing and electron-donating groups. Examples of the substituent groups include an alkyl group having 1 to 25 carbon atoms (e.g., methyl, ethyl, propyl, isopropyl, tert-butyl, pentyl, hexyl, cyclohexyl), halogenated alkyl group (e.g., trifluoromethyl, perfluorooctyl), cycloalkyl group (e.g., cyclohexyl, cyclopentyl), alkynyl group (e.g., propargyl group), glycidyl group, acrylate group, methacrylate group, aryl group (e.g., phenyl), heterocyclic group (e.g., pyridyl, thiazolyl, oxazolyl, imidazolyl, furyl, pyrrolyl, pirazinyl, pyrimidinyl, pirydazinyl, selenazolyl, sulforanyl, piperidinyl, pyrazolyl, tetrazolyl), halogen atom (chlorine, brominem iodine, fluorine), alkoxy group (methoxy, ethoxy, propyloxy, pentyloxy, hexyloxy), aryloxy (e.g., phenoxy), alkoxycarbonyl group (e.g., methyloxycarbonyl, ethyloxycarbonyl, butyloxycarbonyl), aryloxycarbonyl (phenyloxycarbonyl), sulfonamido group (methanesulfonamido, ethanesulfonamido, butanesulfoneamido, hexanesulfonamido, cyclohexanesulfonamido, benzenesulfonamido), sulfamoyl group (e.g., aminosulfonyl, methylaminosulfonyl, dimethylaminosulfonyl, butylaminosulfonyl, hexylaminosulfonyl, cyclohexylaminosulfonyl, phenylaminosulfonyl, 2-pyridylaminosulfonyl), urethane group (e.g., methylureido, ethylureido, pentylureido, cyclohexylureido, phenylureido, 2-pyridylureido), acyl group (e.g., acetyl, propionyl, butanoyl, hexanoyl, cyclohexanoyl, benzoyl, pyridinoyl), carbamoyl group (e.g., amiocarbonyl, methylaminocarbonyl, dimethylaminocarbonyl, propylaminocarbonyl, pentylaminocarbonyl, cyclohexylaminocarbonyl, phenylaminocarbonyl, 2-pyridylamonpcarbonyl), amido group (acetoamide, propionamido, butaneamido, hexaneamido, benzamido), sulfonyl group (e.g., methylsulfinyl, ethylsulfinyl, butylsulfonyl, cyclohexylsulfonyl, phenylsulfinyl, 2-pyridylsulfonyl), amino group (e.g., amino, ethylamino, dimethylamino, butylamino, cyclopentylamino, anilino, 2-pyridylamino), cyano group, nitro group, sulfo group, carboxy group, hydroxy group and oxamoyl group. These substituent groups may be further substituted with the foregoing substituent groups. $L_1$, $L_2$, $L_3$ and $L_4$ are each a bivalent linkage group, including an alkylene group (e.g., ethylene, propylene, butylenes, hexamethylene), oxyalkylene group (e.g., oxyethylene, oxypropylene, oxybutylene, oxyhexamethylene, or group comprised of plural these repeating units), aminoalkylene group (e.g., aminoethylene, aminopropylene, aminohexamethylene, or a group comprised of plural these repeating units), and carboxyalkylene group (e.g., carboxyethylene, carboxypropylene, carboxybutylene), thioether group, oxyether group, sulfonamido group and carbamoyl group. At least one of $R^1$ and $R^2$ in formula (1), or at least one of $R^3$, $R^4$, $R^5$, $R^6$, $R^7$ and $R^8$ in formula (2) preferably is a ballast group (or a diffusion-proof group) or an adsorption-promoting group, and more preferably, $R^2$ is a ballast group or an adsorption-promoting group. The ballast group is preferably an aliphatic group having 6 or more carbon atoms or an aryl group substituted with an alkyl group having 3 or more carbon atoms. Introduction of the ballast group, depending on the amount of a binder or crosslinking agent, restrains diffusion at room temperature, preventing reaction during storage.

The epoxy compound usable in the invention may be any one containing at least one epoxy group and is not limited with respect to the number of the epoxy group, molecular weight and other parameters. The epoxy group is preferably contained in the form of a glycidyl group through an ether bond or an imino bond in the molecule. The epoxy compound may be any one of a monomer, oligomer and polymer, in which the number of the epoxy group in the molecule is preferably 1 to 10 and more preferably 2 to 4. In cases where the epoxy compound is a polymer, it may be either one of a homopolymer and a copolymer. The number-averaged molecular weight (Mn) thereof is preferably 2,000 to 20,000. The epoxy compound used in the invention is preferably a compound represented by the following formula (9):

Formula (9)

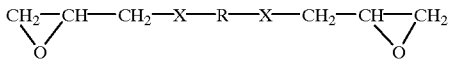

wherein an alkylene group or arylene group represented by R in formula (9) may be substituted by a substituent selected from a halogen atom, a hydroxyalkyl group and an amino group; R in formula (9) preferably contains an amide linkage, ether linkage or thioether linkage; a bivalent linkage group represented by X is preferably $—SO_2—$, $—SO_2NH—$, —S—, —O— or —NR'—, in which R' is a univalent linkage group and preferably an electron-withdrawing group.

The epoxy compound may be used alone or combination thereof. The amount to be added is not specifically limited, but preferably $1\times10^{-6}$ to $1\times10^{-2}$ mol/m$^2$, and more preferably $1\times10^{-5}$ to $1\times10^{-3}$ mol/m$^2$. The epoxy compound may be added to any layer of a photosensitive layer, surface protective layer, interlayer, antihalation layer and subbing layer provided on the photosensitive layer-side of the support and may be added to one or plurality of these layers. Further, it may be added to a layer provided on the opposite side of the support, in combination with the photosensitive layer-side. In the case of a photothermographic material having photosensitive layers on both sides of the support, it may be added to any one of the layers.

The acid anhydride used in the invention is preferably a compound containing at least an acid anhydride group represented as below:

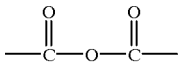

The acid anhydride usable in the invention may be any compound containing one or more acid anhydride group, the number of the acid anhydride group, molecular weight or other parameters are not specifically limited, and a compound represented by the following formula (B) is preferred:

Formula (B)

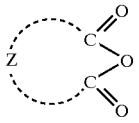

wherein Z is an atomic group necessary to form a monocyclic or polycyclic ring, which may be substituted. Examples of substituent include an alkyl group (e.g., methyl, ethyl, hexyl, an alkoxyl group (e.g., methoxy, ethoxy, octyloxy), an aryl group (e.g., phenyl, naphtyl, tolyl), hydroxy group, an aryloxy group (e.g., phenoxy), an alkylthio group (e.g., methylthio, butylthio, an arylthio group (e.g., phenylthio), an acyl group (e.g., acetyl, propionyl, butylyl), a sulfonyl group (e.g., methylsulfonyl, phenylsulfonyl), an acylamino group, a sulfonylamino group, an acyloxy group (e.g., acetoxy, benzoxy), carboxy group, cyano group, sulfo group and an amino group. It is preferred not to contain a halogen atom as a substituent.

Exemplary examples of the acid anhydride compound are shown below but are not to these.

B-1

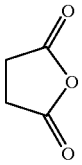

B-2

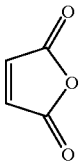

B-3

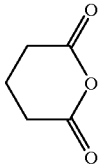

B-4

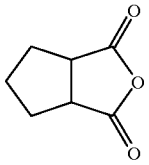

-continued

B-5

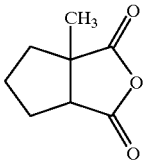

B-6

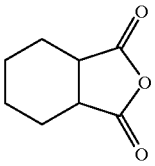

B-7

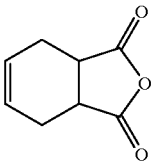

B-8

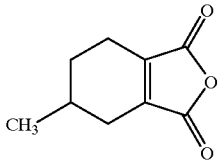

B-9

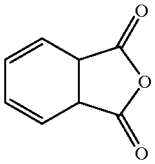

B-10

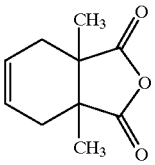

B-11

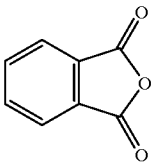

B-12

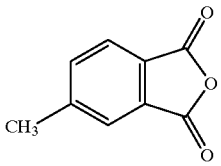

B-13

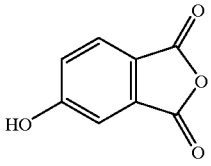

-continued

B-14

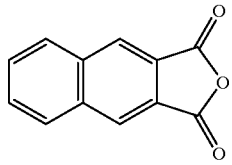

B-15

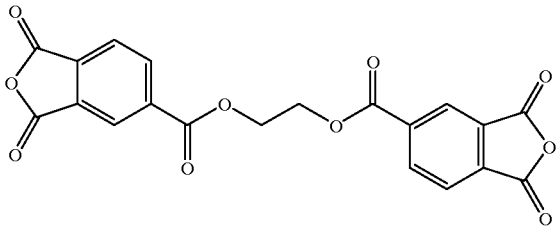

B-16

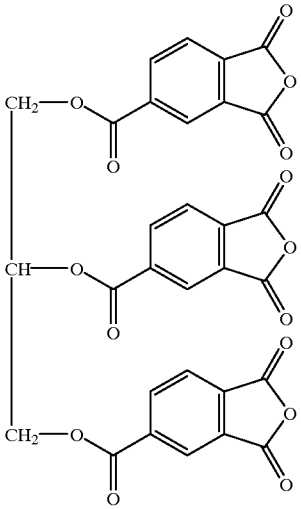

B-17

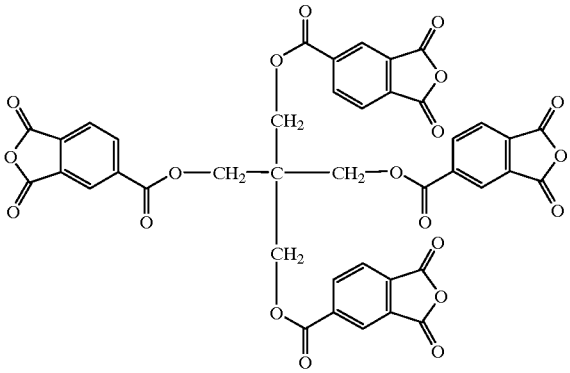

The acid anhydride compound may be used alone or combination thereof. The amount to be added is not specifically limited, but preferably $1\times10^{-6}$ to $1\times10^{-1}$ mol/m$^2$, and more preferably $1\times10^{-4}$ to $1\times10^{-2}$ mol/m$^2$. The acid anhydride compound may be added to any layer of a photosensitive layer, surface protective layer, interlayer, antihalation layer and subbing layer provided on the photosensitive layer-side of the support and may be added to one or plurality of these layers. Further, it may be added to a layer containing the foregoing epoxy compound.

Photothermographic imaging materials of the invention, which form photographic images on thermal development, comprises a reducible silver source (such as organic silver salts), light sensitive silver halide grains, a reducing agent, and optionally a color toning agent for adjusting silver image color tone, which are contained in the form of a dispersion in a binder matrix. Exemplary preferred toning agents are described in RD17029, U.S. Pat. Nos. 4,123,282, 3,994,732, 3,846,136 and, 4,021,249. Examples thereof include imides (succinimide, phthalimide, naphthalimide, N-hydroxy-1,8-naphthalimide, etc.); mercaptanes (e.g., 3-mercapto-1,2,4-triazole, etc.); phthalazinone derivatives and their metal salt [e.g., phthalazinone, 4-(1-naphthyl) phthalazinone, 6-chlorophthalazinone, 5,7-dimethyloxyphthalazinone, 2,3-dihydroxy-1,4-phthalzinedione, etc.]; combinations of phthalazine and phthalic acids (e.g., phthalic acid, 4-methylphthalic acid, 4-nitrophthalic acid, tetrachlorophthalic acid, etc.); and combinations of phthalazine and at least one selected from maleic acid anhydride, phthalic acid, 2,3,-naphthalenedicarboxylic acid, and o-phenyleneacid derivatives and their anhydrides (e.g., phthalic acid, 4-methyphthalic acid, 4-nitrophthalic acid, tetrachlorophthalic acid, etc.). Specifically preferred toning agents include phthalazinone, a combination of phthalazine, and phthalic acids or phthalic acid anhydrides.

In the present invention, a matting agent is preferably incorporated into the surface layer of the photothermographic imaging material (on the light sensitive layer side or even in cases where a light insensitive layer is provided on the opposite side of the support to the light sensitive layer). In order to minimize the image abrasion after thermal development, the matting agent is provided on the surface of a photosensitive material and the matting agent is preferably incorporated in an amount of 1 to 30% by weight of the binder.

Materials of the matting agents employed in the invention may be either organic substances or inorganic substances. Examples of the inorganic substances include silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Examples of the organic substances include starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The matting agent used in the invention preferably has an average particle diameter of 0.5 to 10 $\mu$m, and more preferably of 1.0 to 8.0 $\mu$m. Furthermore, the variation coefficient of the size distribution is preferably not more than 50%, is more preferably not more than 40%, and is still more preferably not more than 30%. The variation coefficient of the grain size distribution as described herein is a value represented by the following formula:

$$(\text{standard deviation of particle size}/\text{average particle size})\times100.$$

Addition methods of the matting agent include those in which a matting agent is previously dispersed into a coating composition and is then coated, and prior to the completion of drying, a matting agent is sprayed. When plural matting agents are added, both methods may be employed in combination.

Suitable supports used in the photothermographic imaging materials of the invention include various polymeric materials, glass, wool cloth, cotton cloth, paper, and metals (such as aluminum). Flexible sheets or roll-convertible one are preferred. Examples of preferred support used in the invention include plastic resin films such as cellulose acetate film, polyester film, polyethylene terephthalate film, polyethylene naphthalate film, polyamide film, polyimide film, cellulose triacetate film and polycarbonate film, and biaxially stretched polyethylene terephthalate (PET) film is specifically preferred. The support thickness is 50 to 300 μm, and preferably 70 to 180 μm.

To improve electrification properties of photothermographic imaging materials, metal oxides and/or conductive compounds such as conductive polymers may be incorporated into the constituent layer. These compounds may be incorporated into any layer and preferably into a sublayer, a backing layer, interlayer between the light sensitive layer and the sublayer. Conductive compounds described in U.S. Pat. No. 5,244,773, col. 14–20.

It is preferred to form a filter layer on the same side as or on the opposite side to the light sensitive layer or to allow a dye or pigment to be contained in the light sensitive layer to control the amount of wavelength distribution of light transmitted through the light sensitive layer of photothermographic imaging materials relating to the invention. Commonly known compounds having absorptions in various wavelength regions can used as a dye, in response to spectral sensitivity of the photothermographic material.

In cases where the photothermographic imaging material relating to the invention are applied as a image recording material using infrared light is preferred the use of squarilium dye containing a thiopyrylium nucleus (also called as thiopyrylium squarilium dye), squarilium dye containing a pyrylium nucleus (also called as pyrylium squarilium dye), thiopyrylium chroconium dye similar to squarilium dye or pyrylium chroconium. The compound containing a squarilium nucleus is a compound having a 1-cyclobutene-2-hydroxy-4one in the molecular structure and the compound containing chroconium nucleus is a compound having a 1-cyclopentene-2-hydroxy,4,5-dione in the molecular structure, in which the hydroxy group may be dissociated. Hereinafter, these dyes are collectively called a squarilium dye. Compounds described in JP-A 8-201959 are also preferable dyes.

The developing conditions for photographic materials are variable, depending on the instruments or apparatuses used, or the applied means and typically accompany heating the imagewise exposed photothermographic imaging material at an optimal high temperature. Latent images formed upon exposure are developed by heating the photothermographic material at an intermediate high temperature (ca. 80 to 200° C., and preferably 100 to 200° C.) over a sufficient period of time (generally, ca. 1 sec. to ca. 2 min.). Sufficiently high image densities cannot be obtained at a temperature lower than 80° C. and at a temperature higher than 200° C., the binder melts and is transferred onto the rollers, adversely affecting not only images but also transportability or the thermal processor. An oxidation reduction reaction between an organic silver salt (functioning as an oxidant) and a reducing agent is caused upon heating to form silver images. The reaction process proceeds without supplying any processing solution such as water from the exterior.

Heating instruments, apparatuses and means include typical heating means such as a hot plate, hot iron, hot roller or a heat generator employing carbon or white titanium. In the case of a photothermographic imaging material provided with a protective layer, it is preferred to thermally process while bringing the protective layer side into contact with a heating means, in terms of homogeneous-heating, heat efficiency and working property. It is also preferred to conduct thermal processing while transporting, while bringing the protective layer side into contact with a heated roller.

One feature of the invention is that an image obtained through thermal development at a heating temperature of 123° C. for 13.5 sec. exhibits an average contrast of 2.0 to 4.0 within the diffuse density range of 0.25 to 2.5 on a characteristic curve represented on orthogonal coordinates in which the unit length of the diffuse density (Y-coordinate) and that of common logarithmic exposure (X-coordinate) are equivalent to each other. Such a contrast enables obtaining enhanced diagnosis recognition, even in the case of a relatively low silver coverage.

Exposure of photothermographic imaging materials desirably uses a light source suitable to the spectral sensitivity of the photothermographic materials. An infrared-sensitive photothermographic material, for example, is applicable to any light source in the infrared light region but the use of an infrared semiconductor laser (780 nm, 820 nm) is preferred in terms of being relatively high power and transparent to the photothermographic material.

In the invention, exposure is preferably conducted by laser scanning exposure and various methods are applicable to its exposure. One of the preferred embodiments is the use of a laser scanning exposure apparatus, in which scanning laser light is not exposed at an angle substantially vertical to the exposed surface of the photothermographic material. The expression "laser light is not exposed at an angle substantially vertical to the exposed surface" means that laser light is exposed preferably at an angle of 55 to 88°, more preferably 60 to 86°, still more preferably 65 to 84°, and optimally 70 to 82°. When the photothermographic material is scanned with laser light, the beam spot diameter on the surface of the photosensitive material is preferably not more than 200 μm, and more preferably not more than 100 μm. Thus, the smaller spot diameter preferably reduces the angle displaced from verticality of the laser incident angle. The lower limit of the beam spot diameter is 10 μm. The thus configured laser scanning exposure can reduce deterioration in image quality due to reflected light, such as occurrence of interference fringe-like unevenness.

In the second preferred embodiment of the invention, exposure applicable in the invention is conducted preferably using a laser scanning exposure apparatus producing longitudinally multiple scanning laser light, whereby deterioration in image quality such as occurrence of interference fringe-like unevenness is reduced, as compared to scanning laser light with longitudinally single mode. Longitudinal multiplication can be achieved by a technique of employing backing light with composing waves or a technique of high frequency overlapping. The expression "longitudinally multiple" means that the exposure wavelength is not a single wavelength. The exposure wavelength distribution is usually not less than 5 nm and not more than 10 nm. The upper limit of the exposure wavelength distribution is not specifically limited but is usually about 60 nm.

In the third preferred embodiment of the invention, it is preferred to form images by scanning exposure using at least two laser beams. The image recording method using such plural laser beams is a technique used in image-writing means of a laser printer or a digital copying machine for writing images with plural lines in a single scanning to meet requirements for higher definition and higher speed, as described in JP-A 60-166916. This is a method in which laser light emitted from a light source unit is deflection-scanned with a polygon mirror and an image is formed on the photoreceptor through an fθ lens, and a laser scanning optical apparatus similar in principle to an laser imager.

In the image-writing means of laser printers and digital copying machines, image formation with laser light on the photoreceptor is conducted in such a manner that displacing one line from the image forming position of the first laser light, the second laser light forms an image from the desire of writing images with plural lines in a single scanning. Concretely, two laser light beams are close to each other at a spacing of an order of some ten μm in the sub-scanning direction on the image surface; and the pitch of the two beams in the sub-scanning direction is 63.5 μm at a printing density of 400 dpi and 42.3 μm at 600 dpi (in which the printing density is represented by "dpi", i.e., the number of dots per inch). As is distinct from such a method of displacing one resolution in the sub-scanning direction, one feature of the invention is that at least two laser beams are converged on the exposed surface at different incident angles to form images. In this case, when exposed with N laser beams, the following requirement is preferably met: when the exposure energy of a single laser beam (of a wavelength of λ nm) is represented by E, writing with N laser beam preferably meets the following requirement:

$$0.9\times E \leqq En\times N \leqq 1.1\times E$$

in which E is the exposure energy of a laser beam of a wavelength of λ nm on the exposed surface when the laser beam is singly exposed, and N laser beams each are assumed to have an identical wavelength and an identical exposure energy (En). Thereby, the exposure energy on the exposed surface can be obtained and reflection of each laser light onto the image forming layer is reduced, minimizing occurrence of an interference fringe. In the foregoing, plural laser beams having a single wavelength are employed but lasers having different wavelengths may also be employed. In such a case, the wavelengths preferably fall within the following range:

$$(\lambda-30)<\lambda_1, \lambda_2, \ldots \lambda_n<(\lambda+30).$$

In the first, second and third preferred embodiments of the image recording method of the invention, lasers for scanning exposure used in the invention include, for example, solid-state lasers such as ruby laser, YAG laser, and glass laser; gas lasers such as He—Ne laser, Ar laser, Kr ion laser, $CO_2$ laser, Co laser, He—Cd laser, $N_2$ laser and eximer laser; semiconductor lasers such as InGa laser, AlGaAs laser, GaAsP laser, InGaAs laser, InAsP laser, $CdSnP_2$ laser, and GSb laser; chemical lasers; and dye lasers. Of these, semiconductor lasers of wavelengths of 600 to 1200 nm are preferred in terms of maintenance and the size of the light source. When exposed onto the photothermographic imaging material in the laser imager or laser image-setter, the beam spot diameter on the exposed surface is 5 to 75 μm as a minor axis diameter and 5 to 100 μm as a major axis diameter. The laser scanning speed is set optimally for each photothermographic material, according to its sensitivity at the laser oscillation wavelength and the laser power.

It is preferred that when subjected to thermal development, the photothermographic imaging material contains an organic solvent of 5 to 1000 mg/m$^2$. The organic solvent content is more preferably 100 to 500 mg/m$^2$. The solvent content within the range described above leads to a thermally developable photosensitive material with low fog density as well as high sensitivity. Examples of solvents include ketones such as acetone, isophorone, ethyl amyl ketone, methyl ethyl ketone, methyl isobutyl ketone; alcohols such as methyl alcohol, ethyl alcohol, n-propyl alcohol, isopropyl alcohol, n-butyl alcohol, isobutyl alcohol, diacetone alcohol, cyclohexanol, and benzyl alcohol; glycols such as ethylene glycol, dimethylene glycol, triethylene glycol, propylene glycol and hexylene glycol; ether alcohols such as ethylene glycol monomethyl ether, and dimethylene glycol monomethyl ether; ethers such as ethyl ether, dioxane, and isopropyl ether; esters such as ethyl acetate, butyl acetate, amyl acetate, and isopropyl acetate; hydrocarbons such as n-pentane, n-hexane, n-heptane, cyclohexene, benzene, toluene, xylene; chlorinated compounds such as chloromethyl, chloromethylene, chloroform, and dichlorobenzene; amines such as monomethylamine, dimethylamine, triethanol amine, ethylenediamine, and triethylamine; and water, formaldehyde, dimethylformaldehyde, nitromethane, pyridine, toluidine, tetrahydrofuran and acetic acid. The solvents are not to be construed as limiting these examples. These solvents may be used alone or in combination.

The solvent content in the photothermographic material can be adjusted by varying conditions such as temperature conditions at the drying stage, following the coating stage. The solvent content can be determined by means of gas chromatography under conditions suitable for detecting the solvent.

EXAMPLES

The present invention will be further described based on examples but embodiments of the invention are by no means limited to these examples.

Example 1

Preparation of a Subbed PET Photographic Support

Both surfaces of a biaxially stretched thermally fixed 175 μm PET film, available on the market, was subjected to corona discharging at 8 w/m$^2$·min. Onto one side of the film, the subbing coating composition a-1 described below was applied so as to form a dried layer thickness of 0.8 μm, which was then dried. The resulting coating was designated Subbing Layer A-1. Onto the opposite surface, the subbing coating composition b-1 described below was applied to form a dried layer thickness of 0.8 μm. The resulting coating was designated Subbing Layer B-1.

| | |
|---|---|
| Subbing Coating Composition a-1 | |
| Latex solution (solid 30%) of a copolymer consisting of butyl acrylate (30 weight %), t-butyl acrylate (20 weight %) styrene (25 weight %) and 2-hydroxy ethyl acrylate (25 weight %) | 270 g |
| (C-1) | 0.6 g |
| Hexamethylene-1,6-bis(ethyleneurea) | 0.8 g |
| Water to make | 1 liter |
| Subbing Coating Composition b-1 | |
| Latex liquid (solid portion of 30%) of a copolymer consisting of butyl acrylate (40 weight %) styrene (20 weight %) glycidyl acrylate (25 weight %) | 270 g |
| (C-1) | 0.6 g |
| Hexamethylene-1,6-bis(ethyleneurea) | 0.8 g |
| Water to make | 1 liter |

Subsequently, the surfaces of Subbing Layers A-1 and B-1 were subjected to corona discharging with 8 w/m$^2$·minute. Onto the Subbing Layer A-1, the upper subbing layer coating composition a-2 described below was applied so as to form a dried layer thickness of 0.8 μm, which was designated Subbing Layer A-2, while onto the Subbing Layer B-1, the upper subbing layer coating composition b-2 was applied so at to form a dried layer thickness of 0.8 $\mu$m, having a static preventing function, which was designated Subbing Upper Layer B-2.

| Upper Subbing Layer Coating Composition a-2 | |
|---|---|
| Gelatin in an amount (weight) to make | 0.4 g/m$^2$ |
| (C-1) | 0.2 g |
| (C-2) | 0.2 g |
| (C-3) | 0.1 g |
| Silica particles (av. size 3 $\mu$m) | 0.1 g |
| Water to make | 1 liter |
| **Upper Subbing Layer Coating Composition b-2** | |
| (C-4) | 60 g |
| Latex solution (solid 20% comprising) (C-5) as a substituent | 80 g |
| Ammonium sulfate | 0.5 g |
| (C-6) | 12 g |
| Polyethylene glycol (average molecular weight of 600) | 6 g |
| Water to make | 1 liter |

(C-1)

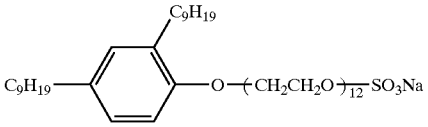

(C-2)

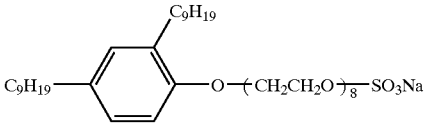

(C-3)

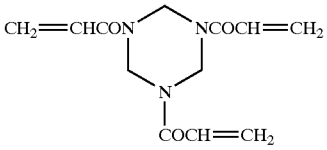

(C-4)

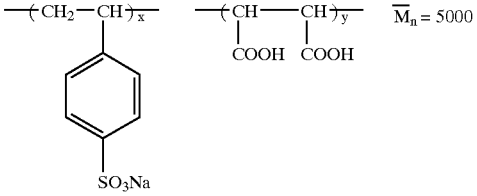

($\overline{M}$n is a number average molecular weight)
x:y = 75:25 (weight ratio)

-continued (C-5)

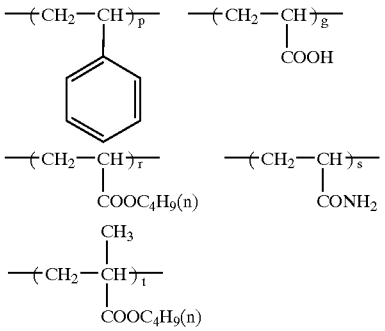

p:g:r:s:t = 40:5:10:5:40 (weight ratio)

(C-6)

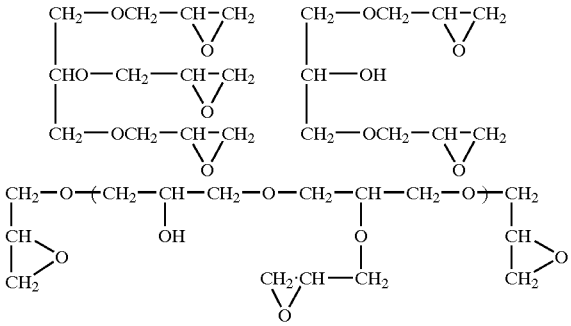

Mixture consisting of the three compounds illustrated above

Back Layer-side Coating

To 830 g of methyl ethyl ketone (hereinafter, also denoted as MEK), 84.2 g of cellulose acetate-butylate (CAB381-20, available from Eastman Chemical Co.) and 4.5 g of polyester resin (Vitel PE2200B, available from Bostic Corp.) were added with stirring and dissolved therein. To the resulting solution was added 0.30 g of infrared dye 1 and 4.5 g fluorinated surfactant (Surflon KH40, available from ASAHI Glass Co. Ltd.) and 2.3 g fluorinated surfactant (Megafag F120K, available from DAINIPPON INK Co. Ltd.) which were dissolved in 43.2 g methanol, were added thereto and stirred until being dissolved. Then, 75 g of silica (Siloid 64X6000, available from W. R. Grace Corp.), which was dispersed in methyl ethyl ketone in a concentration of 1 wt % using a dissolver type homogenizer, was further added thereto with stirring to obtain a coating solution A for backing layer.

Infrared senstizing dye-1

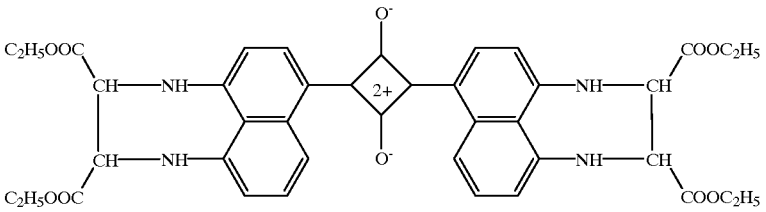

The thus prepared coating solution for a backing layer was coated on the back side of each of samples 1 through 5 by an extrusion coater and dried so as to have dry thickness of 3.5 μm. Drying was carried out at a dry-bulb temperature of 100° C. and a wet-bulb temperature of 10° C. over a period of 5 min.

Preparation of Light-sensitive Silver Halide Emulsion A

| | |
|---|---|
| Solution A1 | |
| Phenylcarbamoyl gelatin | 88.3 g |
| Compound (A) (10% methanol solution) | 10 ml |
| Potassium bromide | 0.32 g |
| Water to make | 5429 ml |
| Solution B1 | |
| 0.67 mol/l Aqueous silver nitrate solution | 2635 ml |
| Solution C1 | |
| Potassium bromide | 51.55 g |
| Potassium iodide | 1.47 g |
| Water to make | 660 ml |
| Solution D1 | |
| Potassium bromide | 154.9 g |
| Potassium iodide | 4.41 g |
| Iridium chloride (1% solution) | 0.93 ml |
| Water to make | 1982 ml |
| Solution E1 | |
| 0.4 mol/l aqueous potassium bromide solution | |
| Amount necessary to adjust silver potential | |
| Solution F1 | |
| Potassium hydroxide | 0.71 g |
| Water to make | 20 ml |
| Solution G1 | |
| Aqueous 56% acetic acid solution | 18 ml |
| Solution H1 | |
| Anhydrous sodium carbonate | 1.72 g |

Compound (A)

$HO(CH_2CH_2O)_n—(CH(CH_3)CH_2O)_{17}—CH_2CH_2O)_mH$ (m + n = 5 to 7)

Using a stirring mixer described in JP-B 58-58288 and 58-58289, ¼ of solution B1, the total amount of solution C1 were added to solution A1 by the double jet addition for 4 min 45 sec. to form nucleus grain, while maintaining a temperature of 45° C. and a pAg of 8.09. After 1 min., the total amount of solution F1 was added thereto. After 6 min, ¾ of solution B1 and the total amount of solution D1 were further added by the double jet addition for 14 min 15 sec., while mainlining a temperature of 45° C. and a pAg of 8.09. After stirring for 5 min., the reaction mixture was lowered to 40° C. and solution G1 was added thereto to coagulate the resulting silver halide emulsion. Remaining 2000 ml of precipitates, the supernatant was removed and after adding 10 lit. water with stirring, the silver halide emulsion was again coagulated. Remaining 1500 ml of precipitates, the supernatant was removed and after adding 10 lit. water with stirring, the silver halide emulsion was again coagulated. Remaining 1500 ml of precipitates, the supernatant was removed and solution H1 was added. The temperature was raised to 60° C. and stirring continued for 120 min. Finally, the pH was adjusted to 5.8 and water was added there to so that the weight per mol of silver was 1161 g, and light-sensitive silver halide emulsion A was thus obtained. It was proved that the resulting emulsion was comprised of mono-disperse silver iodobromide cubic grains having an average grain size of 0.058 μm, a coefficient of variation of grain size of 12% and a [100] face ratio of 92%.

To the thus prepared emulsion were added 240 ml of a 0.5% methanol solution of sulfur sensitizer S-5 and a 0.5% methanol solution of 1/20 mole equivalent gold sensitizer Au-5 and the emulsion was chemically sensitized at 55° C. for 120 min.

Preparation of Powdery Organic Silver Salt A

In 4720 ml water were dissolved 130.8 g of behenic acid, 67.7 g of arachidic acid, 43.6 g of stearic acid and 2.3 g of palmitic acid at 80° C. The, after adding 540.2 ml of 1.5M aqueous sodium hydroxide solution with stirring and further adding 6.9 ml of concentrated nitric acid, the solution was cooled to a temperature of 55° C. to obtain an aqueous organic acid sodium salt solution. To the solution were added the silver halide emulsion obtained above (equivalent to 0.038 mol silver) and 450 ml water and stirring further continued for 5 min., while maintained at a temperature of 55° C. Subsequently, 760 ml of 1M aqueous silver nitrate solution was added in 2 min. and stirring continued further for 20 min., then, the reaction mixture was filtered to remove aqueous soluble salts. Thereafter, washing with deionized water and filtration were repeated until the filtrate reached a conductivity of 2 μS/cm.

Using a flush jet dryer (produced by Seishin Kigyo Co., Ltd.), the thus obtained cake-like organic silver salt was dried under an atmosphere of inert gas (i.e., nitrogen gas) having a volume ratio shown in Table 1, according to the operation condition of a hot air temperature at the inlet of the dryer until reached a moisture content of 0.1%. The moisture content was measured by an infrared ray aquameter.

Preparation of Pre-dispersion A

In 1457 g MEK was dissolved 14.57 g of polyvinyl butyral powder (Butvar B-79, available from Monsanto Corp.) and further thereto was gradually added 500 g of the powdery organic silver salt to obtain pre-dispersion A, while stirring by a dissolver type homogenizer (DISPERMAT Type CA-40, available from VMA-GETZMANN).

Preparation of Light-sensitive Emulsion 1

Thereafter, using a pump, the pre-dispersion A was transferred to a media type dispersion machine (DISPERMAT Type SL-C12 EX, available from VMA-GETZMANN), which was packed 1 mm Zirconia beads (TORESELAM, available from Toray Co. Ltd.) by 80%, and dispersed at a circumferential speed of 8 m/s and for 1.5 min. Of a retention time with a mill to obtain light-sensitive emulsion 1.

Preparation of Stabilizer Solution

In 4.97 g methanol were dissolved 1.0 g of Stabilizer-1 and 0.31 g of potassium acetate to obtain stabilizer solution.

Stabilizer-1

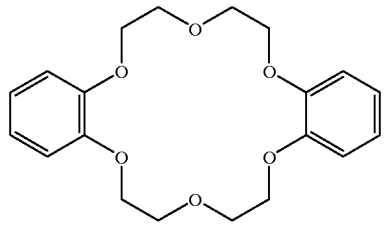

Preparation of Infrared Sensitizing Dye Solution A

In 31.3 ml MEK were dissolved 19.2 mg of infrared sensitizing dye (SD-1), 1.488 g of 2-chlorobenzoic acid, 2.779 g of Stabilizer-2 and 365 mg of 5-methyl-2-mercaptobenzimidazole in a dark room to obtain an infrared sensitizing dye solution A.

SD-1

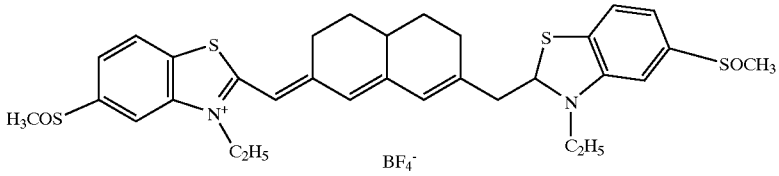

Stabilizer-2

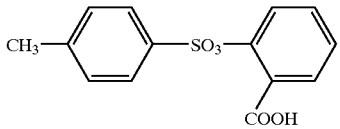

Preparation of Additive Solution a

In 110 g MEK were dissolved 27.98 g of developer 1,1-bis(2-hydroxy-3,5-dimethylphenyl)-2-methylpropane, 1.54 g of 4-methylphthalic acid and 0.48 g of the infrared dye-1 to obtain additive solution a.

Preparation of Additive Solution b

Antifoggants-1 and -2 each of 1.78 g were dissolved in 40.9 g MEK to obtain additive solution b.

Antifoggant-1

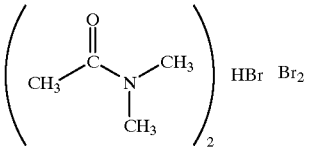

Antifoggant-2

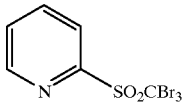

Preparation of Additive Solution c

Silver-saving agent H-94 of 5.0 g was dissolved in 45.0 g MEK to obtain additive solution c.

Preparation of Light-sensitive Layer Coating Solution A

Under inert gas atmosphere (97% nitrogen), 50 g of the light-sensitive emulsion 1 and 15.11 g MEK were maintained at 21° C. with stirring, and after adding 390 μl of antifoggant-2 (10% methanol solution) thereto, the emulsion was further stirred for 1 hr. Further thereto, 494 μm of calcium bromide (10% methanol solution) was added and the emulsion was stirred for 10 min. Subsequently, 167 ml of the stabilizer solution was added and after stirring for 10 min., 1.32 g of the infrared sensitizing dye solution A was added and stirred for 1 hr. Then, the mixture was cooled to 13° C. and stirred for 30 min. Further thereto, 13.31 g of polyvinyl butyral (Butvar B-79, available from Monsant Co.) was added and stirred for 30 min, while maintaining the temperature at 13° C., and 1.084 g of tetrachlorophthalic acid (9.4% MEK solution) and stirred for 15 min. Then, 12.43 g of additive solution a and 1.6 ml of 10% MEK solution of Desmodur N3300 (aliphatic isocyanate, product by Movey Co.) were successively added with stirring to obtain coating solution A of the light-sensitive layer.

Preparation of Light-sensitive Layer Coating Solution B

Under inert gas atmosphere (97% nitrogen), 50 g of the light-sensitive emulsion 1 and 15.11 g MEK were maintained at 21° C. with stirring, 1000 μl of chemical sensitizer S-5 (10% methanol solution) was added thereto and after 2 min., 390 μm of antifoggant-2 (10% methanol solution) was added and stirred for 1 hr. Further thereto, 494 μm of calcium bromide (10% methanol solution) was added and after stirring for 10 min., gold sensitizer Au-5 of 1/20 equimolar amount of the chemical sensitizer was added and stirred for 20 min. Subsequently, 167 ml of the stabilizer solution was added and after stirring for 10 min., 1.32 g of the infrared sensitizing dye solution A was added and stirred for 1 hr. Then, the mixture was cooled to 13° C. and stirred for 30 min. Further thereto, 13.31 g of polyvinyl butyral (Butvar B-79, available from Monsant Co.) was added and stirred for 30 min, while maintaining the temperature at 13° C., and 1.084 g of tetrachlorophthalic acid (9.4% MEK solution) and stirred for 15 min. Then, 12.43 g of additive solution a, 1.6 ml of 10% MEK solution of Desmodur N3300 (aliphatic isocyanate, product by Movey Co.) and 4.27 g of additive solution b were successively added with stirring to obtain coating solution B of the light-sensitive layer.

S-5

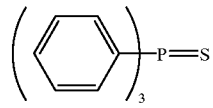

Au-5

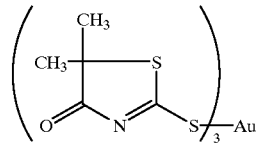

Preparation of Light-sensitive Layer Coating Solution C

Under inert gas atmosphere (97% nitrogen), 50 g of the light-sensitive emulsion 1 and 15.11 g MEK were maintained at 21° C. with stirring, 1000 μl of chemical sensitizer S-5 (10% methanol solution) was added thereto and after 2 min., 390 μm of antifoggant-2 (10% menthanol solution) was added and stirred for 1 hr. Further thereto, 494 μm of calcium bromide (10% methanol solution) was added and after stirring for 10 min., gold sensitizer Au-5 of 1/20 equimolar amount of the chemical sensitizer was added and stirred for 20 min. Subsequently, 167 ml of the stabilizer solution was added and after stirring for 10 min. 1.32 g of the infrared sensitizing dye solution A was added and stirred for 1 hr. Then, the mixture was cooled to 13° C. and stirred for 30 min. Further thereto, 13.31 g of polyvinyl butyral (Butvar B-79, available from Monsant Co.) was added and stirred for 30 min, while maintaining the temperature at 13° C., and 1.084 g of tetrachlorophthalic acid (9.4% MEK solution) and stirred for 15 min. Then, 12.43 g of additive solution a, 1.6 ml of 10% MEK solution of Desmodur N3300 (aliphatic isocyanate, product by Movey Co.), 4.27 g of additive solution b and 10.0 g of additive solution c were successively added with stirring to obtain coating solution C of the light-sensitive layer.

Preparation of Matting Agent Solution

In 42.5 g MEK was dissolved cellulose acetate-butyrate (CAB 171-15, available from Eastman Chemical Co.) and further thereto, 5 g of calcium carbonate (Super-Pflex 200, available from Special Minerals Co.) was added and dispersed using a dissolver type homogenizer at 8000 rpm for 30 min. to obtain a matting agent dispersion.

Preparation of Surface Protective Layer Coating Solution

In 865 g MEK were dissolved with stirring 96 g of cellulose acetate-butyrate (CAV 171-15), 4.5 g of polymethyl methacrylic acid (Paraloid A-21, Rohm & Haas Co.). 4.5 g of vinylsulfone compound, 1.0 g of benztriazole and 1.0 g of fluorinated surfactanr (Surflon KH 40). Then, 30 g of the matting agent dispersion was added with stirring to obtain a coating solution of the surface protective layer.

HD-1: $(CH_2{=}CHSO_2CH_2)_2CHOH$

Preparation of Photothermographic Imaging Material Sample 100

Using an extrusion coater, as shown in FIG. 1, the foregoing light-sensitive layer coating solution A and surface protective layer coating solution were simultaneously coated to form light sensitive layer A and protective layer so that photothermographic imaging material 100 was obtained, in which the silver coverage of the light sensitive layer A was 2.0 g/m$^2$ and the dry thickness of the protective layer was 2.5 $\mu$m. Drying was conducted using dried air at a drying temperature of 50° C. and a dew point of 10° C. over a period of 10 min.

Preparation of Sample 101A

Using an extrusion coater, as shown in FIG. 1, the foregoing light-sensitive layer coating solutions B, C and surface protective layer coating solution were simultaneously coated to form light sensitive layers B and C, and a protective layer so that photothermographic imaging material Sample 101A was obtained, in which the silver coverage of the light sensitive layer B was 0.7 g/m$^2$ and the dry thickness of the protective layer was 2.5 $\mu$m. Drying was conducted using dried air at a drying temperature of 50° C. and a dew point of 10° C. over a period of 10 min.

Preparation of Sample 101B

Using an extrusion coater, as shown in FIG. 1, the foregoing light-sensitive layer coating solution B and surface protective layer coating solution were simultaneously coated to form light sensitive layers B and a protective layer, and the light sensitive coating solution C was coated on the opposite side of the support so that photothermographic imaging material Sample 101B was obtained, in which the silver coverage of the light sensitive layer B was 0.7 g/m$^2$ and the dry thickness of the protective layer was 2.5 $\mu$m. Drying was conducted using dried air at a drying temperature of 50° C. and a dew point of 10° C. over a period of 10 min.

Preparation of Samples 102A, 102B through 104A and 104B

Samples 102A and 102B through 104A and 104B were prepared similarly to Samples 101A and 101B, except that the silver saving agent contained in additive solution c was varied. In the designation of each sample, "A" denotes a coat having two or more light sensitive layers on one side of the support and "B" denotes a coat having light sensitive layers on both side of the support.

Preparation of Samples 105A, 105B, 106A and 106B

Samples 105A, 105B, 106A and 106B 4B were prepared similarly to Samples 101A and 101B, except that the antifoggant contained in additive solution b was varied.

Example 2

Preparation of Organic Silver Salt Dispersion

To a mixture of 7 g of stearic acid, 4 g of arachidic acid, 36 g of behenic acid and 850 ml distilled water at 90° C., 187 ml of aqueous 1 mol/l sodium hydroxide solution was added with stirring to undergo reaction for 120 min. and after adding 71 ml of 1 mol/l nitric acid solution, the temperature was lowered to 50° C. Then, 125 ml aqueous solution containing 21 g of silver nitrate was added in 100 sec., while vigorously stirring and allowed to stand for 20 min. Thereafter, solids were filtered by suction filtration to remove soluble salts and washed with water until the filtrate reached a conductivity of 30 $\mu$S/cm. To the thus obtained solids was added 100 g of aqueous 10% solution of PVA 205 (polyvinyl alcohol, available from KURARE Co., Ltd.) and after adding water to make the total amount of 270 g, the mixture was preliminarily dispersed by an automatic mortar to obtain a coarse dispersion of an organic silver salt. The dispersion was further dispersed using Nanomizer (available from NONOMIZER Co.) at a collision pressure of 98.07 MPa to obtain an organic silver salt dispersion. The thus obtained dispersion was comprised of needle-form organic silver salt particles exhibiting a mean breadth of 0.04 $\mu$m. a mean length of 0.8 $\mu$m and a coefficient of variation of 30%.

Preparation of Reducing Agent Dispersion

To 850 g of water, 100 g of 1,1-bis(2-hydroxy-3,5-dimethylphenyl)-3,5,5-trimethylhexane (reducing agent) and 50 g of hydroxypropyl cellulose were added and sufficiently mixed to obtain slurry. The slurry was put into a vessel, together with 840 g of zirconia beads having a mean diameter of 0.5 mm and dispersed using a dispersion machine (¼ G Sandgrinder Mill, available from IMEX Co.) bovver a period of 5 hrs. to obtain a reducing agent dispersion.

Preparation of Organic Polyhalogenide Dispersion

To 940 g of water, 50 g (0.127 moles) of tribromomethylsulfonylbenzene and 10 g of hydroxypropyl cellulose were added and sufficiently mixed to obtain slurry. The slurry was put into a vessel, together with 840 g of zirconia beads having a mean diameter of 0.5 mm and dispersed using a dispersion machine (¼ G Sandgrinder Mill, available from IMEX Co.) bovver a period of 5 hrs. to obtain an organic polyhalogenide dispersion.

Preparation of Silver-saving Agent Dispersion

To 940 g of water, 10 g of silver-saving agent H-94 and 10 g of hydroxypropyl cellulose were added and sufficiently mixed to obtain slurry. The slurry was put into a vessel, together with 840 g of zirconia beads having a mean diameter of 0.5 mm and dispersed using a dispersion machine (¼ G Sandgrinder Mill, available from IMEX Co.) bovver a period of 5 hrs. to obtain an organic polyhalogenide dispersion.

Preparation of Light-sensitive Silver Halide Emulsion

In 1000 ml water were dissolved 20 g of phthalated gelatin and 30 mg of potassium bromide. After adjusting the temperature and the pH to 35° C. and 5.0, respectively, 159 ml of an aqueous solution containing 18.6 g of silver nitrate and 0.9 g of ammonium nitrate and 159 ml of an equimolar aqueous solution containing potassium bromide, potassium iodide (in a molar ratio of 98 to 2) were added over a period of 10 minutes by the controlled double-jet method, while the pAg was maintained at 7.7. Then, 476 ml of an aqueous solution containing 55.4 g of silver nitrate and 2 g of ammonium nitrate and an aqueous solution containing dipotassium hexachloroiridate of 10 $\mu$mol/l and potassium bromide of 1 mol/l were added over a period of 30 minutes by the controlled double-jet method, while the pAg was maintained at 7.7. Thereafter, 1 g of 4-hydroxy-6-methyl-1,3,3a, 7-tetraazaindene (stabilizer) was added and the pH was lowered to perform coagulation washing to remove soluble salts. Then, 0.1 g of phenoxyethanol was added and the pH and pAg were adjusted to 5.9 and 8.2, respectively to obtain a cubic silver iodobromide grain emulsion (having an average core iodide content of 8 mol %, an overall average iodide content of 2 mol %, an average grain size of 0.05 μm, a coefficient of variation of grain projected area of 8% and a [100] face proportion of 85%).

The thus obtained silver halide grain emulsion was heated to 60° C. and adding sodium thiosulfate of 85 μmol, 2,3,4, 5,6-pentafluorophenyldiphenylphosphine selenide of 11 μmol, a tellurium compound of 15 μmol, chloroauric acid of 3 μmol and thiocyanic acid of 270 μmol, each per mol of silver, the emulsion was ripened for 120 min. After completion of ripening, the emulsion was rapidly cooled to 40° C. and 100 μmol of a sensitizing dye was added and after stirring for 30 min., the emulsion was rapidly cooled to 30° C. to obtain a silver halide emulsion.

Tellurium compound

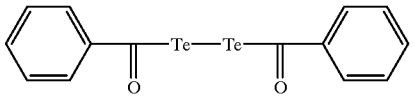

Preparation of Emulsion Layer Coating Solution

To 1350 g of the organic silver salt dispersion were added 140 ml of 20% aqueous PVA solution, 37 ml of 10% aqueous phthalazine solution, 220 g of the reducing agent dispersion and 61 g of the organic polyhalogenide, then was mixed 1100 g of LACSTAR3307B (available from DAINIPPON INK Co., Ltd., SBS latex mainly comprised of styrene-butadine copolymer having an average dispersing particle size of 0.1 to 0.15 μm and an equilibrium moisture content 0.6% at 25° C.), and 120 g of the foregoing silver halide emulsion was further mixed to prepare a coating solution for the emulsion layer, in which the pH was adjusted to 5.0 with 11 mol/l sulfuric acid.

Preparation of Emulsion-layer-side Interlayer Coating Solution

In 900 ml water was dissolved 100 g of MP203 (modified polyvinyl alcohol, available from KURARE Co., Ltd.) and 2 ml of 5% aqueous sodium di(2-ethylhexyl)-sulfosuccinate solution was further added thereto.

Preparation of Protective Layer Coating solution

In 1110 ml warm water was dissolved 145 g of inert gelatin, and 400 g of 20% polyethylacrylate latex, 57 ml of 1 mol/l sulfuric acid, 10 ml of 5% aqueous sodium di(ethylhexyl)-sulfosuccinate solution and 280 ml of 10% phthalic acid methanol solution were added thereto to prepare a coating solution of the emulsion layer side protective layer.

Preparation of Over-coat Layer Coating Solution

In 1650 ml warm water was dissolved 129 g of inert gelatin, and 130 g of 12% polyethylacrylate fine particles (having an average particle size of 2.5 μm), 65 ml of 1 mol/l sulfuric acid, 20 ml of 1 mol/l sulfuric acid and 20 ml of 5% aqueous sodium di(ethylhexyl)-sulfosuccinate solution and 280 ml of 10% phthalic acid methanol solution were added thereto to prepare a solution. The thus prepared solution was continuously mixed with 2% aqueous solution of potassium chromate (III) sulfate (hardener) in a ratio of 1:0.3 to prepare a coating solution of the over-coat layer.

Preparation of Back Layer Coating Solution

Using 1/16 sand grinder mill (product by Imex Co.), 10 g of a mixture of Solid base, N,N',N", N'"-tetraethylguanidine and 4-carboxysulfonyl-phenylsulfone in a molar ratio of 1:2 was dispersed in 88 g water to obtain a base solution. An organic solvent phase in which 2.1 g of a basic dye precursor and 7.9 g of a acidic material, 0.1 g ($1.990\times10^{-4}$ moles) of an antihalation dye and 10 g of ethyl acetate were dissolved was mixed with an aqueous phase comprised of 10 g of polyvinyl alcohol and 80 g water and emulsified at ordinary temperature to obtain a dye solution (having an average particle size of 2.5 μm). The forgoing base solution of 39 g, 26 g of the dye solution and 36 g of 10% aqueous polyvinyl alcohol solution were mixed to obtain a coating solution for a back layer.

Anti-halation dye

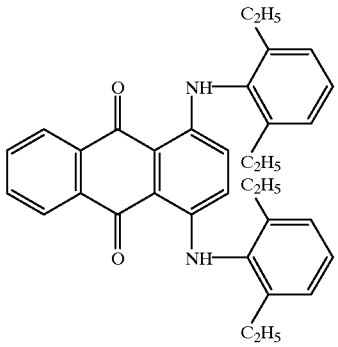

Basic dye precursor

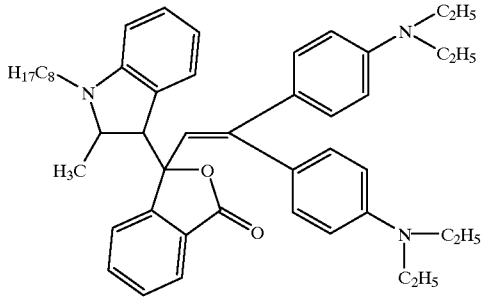

Acidic material

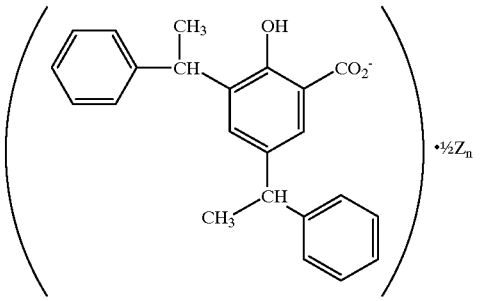

Coating Solution of Protective Layer of Back Layer

In 480 g water were dissolved 20 g of gelatin, 0.6 g of polymethyl methacrylate (having an average particle size of 7 μm), 0.4 g of sodium dodecylbenzenesulfonate and 1 g of X-22-2809 (silicone compound, available from SHINETSU Silicone Co., Ltd.) to obtain a coating solution of a protective layer for the back layer.

Preparation of Sublayer Coating Solution A

To 200 ml of polyester copolymer dispersion, PESRESIN A-515GB (30%, available from TAKAMATSU YUSHI Co., Ltd.) were added 50 g of fine polystyrene particles (having an average particle size of 0.2 μm) and 20 ml of Surfactant A (1% solution) and 1000 ml distilled water was further added to obtain a sublayer coating solution.

Surfactant A

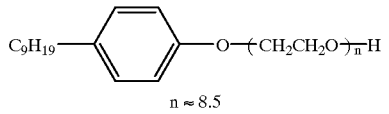

n ≈ 8.5

Preparation of Sublayer Coating Solution B

To 680 ml distilled water were added 200 ml of styrene-butadiene copolymer dispersion (styrene/butadiene/itaconic acid=47/50/3 by weight ratio, and a concentration of 30%) and 0.1 g of fine polystyrene particles (having an average particle size of 2.5 μm) were added and distilled water was further added to make 1000 ml to obtain a sublayer coating solution B.

Preparation of Sublayer Coating Solution C

Inert gelatin of 10 g was dissolved in 500 ml distilled water and 40 g of an aqueous dispersion of stannous oxide/antimony oxide composite particles (40%) was added thereto, then, was ter was further added to make the total amount of 1000 mo to obtain a sublayer coating solution C.

Preparation of Subbed Support

One side (light sensitive layer side) of a 175 μm thick, biaxially stretched polyethylene terephthalate support tinted with a blue dye shown below was subjected to a corona discharge treatment and further thereon, the foregoing sublayer coating solution A was coated using a bar coater so as to form a wet coating coverage of 5 ml/m$^2$ and dried at 180° C. for 5 min to form a dry thickness of 0.3 μm. Subsequently, the opposite side (back side) of the support was also subjected to a corona discharge treatment, the foregoing sublayer coating solution B was coated using a bar coater so as to form a wet coating coverage of 5 ml/m$^2$ and a dry thickness of 0.03 μm and dried at 180° C. for 5 min to obtain a subbed support.

Blue dye

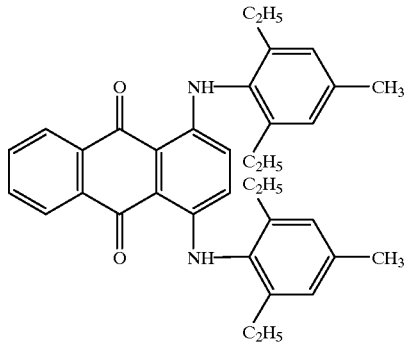

Preparation of Sample 107

On the opposite side of the subbed support to the emulsion layer side, the foregoing back layer coating solution was coated at a flow rate giving an optical density of 0.8 at 810 nm, simultaneously with a coating solution of a back layer-side protective layer; then, on the support opposite to the back layer, the emulsion layer coating solution, interlayer coating solution, protective layer coating solution and overcoat layer coating solution were simultaneously coated in this order from the support, in amounts of 82 ml/m$^2$, 6.5 ml/m$^2$, 12.5 ml/m$^2$ and 12 ml/m$^2$, respectively, allowed to pass through a chilled zone at 10° C. (and at a dew point of 0° C. or lower), and then dried at 30° C. and 40% RH and at a wind-velocity of 20 m/sec.

Preparation of sample 108

Sample 108 was prepared similarly to Sample 107, except that 10.0 g of a silver saving agent was added to the emulsion layer coating solution.

Exposure and Processing

The thus prepared photothermographic material samples Nos. 101 through 108 were each subjected to laser scanning exposure from the emulsion side using an exposure apparatus having a light source of 800 to 820 nm semiconductor laser of a longitudinal multi-mode, which was made by means of high frequency overlapping. In this case, exposure was conducted at an angle of 75° between the exposed surface and exposing laser light. The exposed photothermographic material was subjected to thermal development at 123° C. for 13.5 sec., using a modified Dry Pro 722 (available from Konica Corp.), while bringing the protective layer surface of the photothermographic material into contact with the heated drum surface. Exposure and thermal development were carried out in an atmosphere of 23° C. and 50% RH.

The thus obtained images were evaluated according to the following procedure.

Evaluation of Photographic Performance

Each sample was processed and subjected to sensitometry. Thus, Samples 100 through 108 were each allowed to stand at 25° C. and 55% RH for 10 days and using Dry Pro 722 at room temperature, samples were stepwise exposed at decreasing exposure energy levels by log E of 0.5, step by step from the maximum output and automatically developed at 123° C. for 13.5 sec. The thus processed samples were subjected to sensitometry using a transmission densitometer, PDM65 (available from Konica Corp.) and the obtained results were subjected to computer processing to obtain characteristic curves. From the characteristic curve obtained by plotting the diffuse density (Y-axis) against the common logarithm of the exposure (X-axis), the mean gradation, Ga between densities of 0.25 and 2.5 was determined. Sensitivity was represented by a relative value of the reciprocal of exposure giving a density of 1.0 plus the minimum density (Dmin), based on the sensitivity of Sample 100 being 100. Results are shown in Table 1.

The hue angle ($h_{ab}$) was determined in such a manner that processed samples were measured with respect to areas corresponding to the minimum density and an optical density (D) of 1.0, using an ordinary light source, D65 as defined in CIE and a spectral calorimeter CM-508d (available from Minolta Co., Ltd.) at a visual field of 2°.

The correlated color temperature was measured in such a manner that each film sample having an optical density of 1.0 was placed on a viewing box (using a white fluorescent lamp and a diffusion plate) and measured using a spectral radiation luminance meter (SR-1, available from TOPCON Co., Ltd.). As is well known, the color temperature is of a solid surface, which is the temperature of a black body from which the radiant energy has essentially the same spectral distribution as that from the surface. The term, the correlated color temperature is a definite name of simply being called a color temperature. The color of a light source, which is not completely the same as spectral distribution of emission of a complete black body exhibiting temperature $T_c$ (K) is represented by approximation of an emission temperature of a complete black body exhibiting temperature $T_{cp}$ (K). Such a correlated color temperature, in general, is not related with the temperature of a light source and color of the light source is represented in term of a temperature of a complete black body, through the temperature of the complete black body. The correlated color temperature related to color rendering.

Evaluation of Storage Stability

Samples 100 through 108 were aged for 10 days under the following condition A or B, exposed and processed, and the obtained images were subjected to densitometry, then, the difference between densities under the conditions A and B, i.e., Dmin(B)−Dmin(A) was determined as a measure of storage stability:

Condition A: 25° C. and 55% RH

Condition B: 40° C. and 80% RH.

Evaluation of Image Storage Stability

Similarly to the evaluation of photographic performance, after being allowed to stand for 10 days under condition A, samples were each exposed and processed and after allowed to stand for 7 days at 25° C. and 55% RH under a fluorescent lamp, each sample was evaluated with respect to image color tone, based on the following criteria:

5: No problem in image tone,

4: Substantially no problem in image for practical use,

3: Slightly yellowish but acceptable levels to practical use

2: Unpleasant image tone and possibly problems in practical use,

1: Marked changes in image tone and unacceptable levels to practical use.

Results are shown in Table 1.

TABLE 1

| Sample No. | | Silver-saving Agent | Antifoggant | | Fog Variation*2 | Image Tone Fresh | Image Tone Aged | Sensitivity | Gradation (Ga) | Hue Angle ($h_{ab}$) Dmin | Hue Angle ($h_{ab}$) D = 1.0 | Color Temperature (° K.) |
|---|---|---|---|---|---|---|---|---|---|---|---|---|
| 100 | (comp.) | — | 2*1 | — | 0.300 | 4 | 2 | 100 | 2.5 | 185 | 265 | 4500 |
| 101A | (inv.) | H-94 | 2*1 | I-1 | 0.025 | 4 | 4 | 105 | 3.3 | 200 | 240 | 5600 |
| 101B | (inv.) | H-94 | 2*1 | I-1 | 0.021 | 5 | 4 | 99 | 3.2 | 205 | 245 | 5550 |
| 102A | (inv.) | H-64 | 2*1 | I-1 | 0.022 | 4 | 4 | 104 | 3.4 | 203 | 247 | 5650 |
| 102B | (inv.) | H-64 | 2*1 | I-1 | 0.020 | 5 | 4 | 100 | 3.1 | 202 | 245 | 5550 |
| 103A | (inv.) | H-37 | 2*1 | I-1 | 0.030 | 4 | 4 | 106 | 3.2 | 202 | 243 | 5700 |
| 103B | (inv.) | H-37 | 2*1 | I-1 | 0.028 | 5 | 4 | 101 | 3.1 | 201 | 239 | 5650 |
| 104A | (inv.) | H-21 | 2*1 | I-1 | 0.031 | 4 | 4 | 103 | 3.2 | 206 | 245 | 5400 |
| 104B | (inv.) | H-21 | 2*1 | I-1 | 0.027 | 5 | 4 | 97 | 3.2 | 207 | 247 | 5350 |
| 105A | (inv.) | H-94 | 2*1 | BI-4 | 0.022 | 4 | 4 | 103 | 3.1 | 204 | 244 | 5450 |
| 105B | (inv.) | H-94 | 2*1 | BI-4 | 0.020 | 5 | 4 | 99 | 3.2 | 205 | 245 | 5500 |
| 106A | (inv.) | H-94 | 2*1 | Q-41 | 0.018 | 4 | 4 | 105 | 3.5 | 204 | 241 | 5550 |
| 106B | (inv.) | H-94 | 2*1 | Q-41 | 0.021 | 5 | 4 | 100 | 3.2 | 201 | 240 | 5600 |
| 107 | (comp.) | — | 2*1 | — | 0.400 | 4 | 1 | 90 | 2.0 | 180 | 265 | 4300 |
| 108 | (inv.) | H-94 | 2*1 | I-1 | 0.040 | 4 | 3 | 95 | 2.9 | 200 | 248 | 5100 |

*1Antifoggant-2

*2Dmin (B) − Dmin (A)

H-94

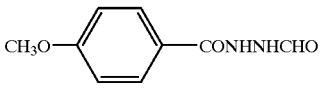

H-64

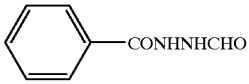

H-37

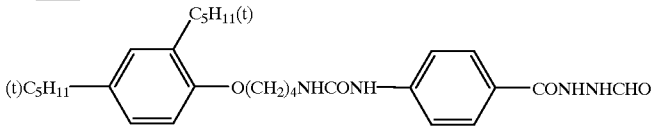

H-21

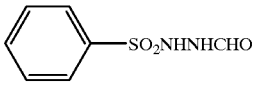

I-1

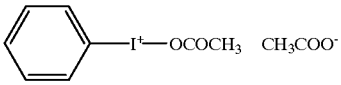

BI-4

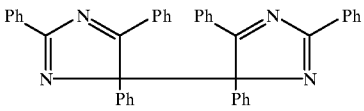

Ph: phenyl group

Q-41

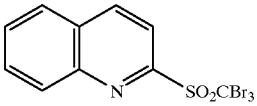

As is apparent from Table 1, it was proved that photothermographic imaging materials according to this invention, irrespective of their lower silver coverage, exhibited superior photographic performance such as image tone and gradation; and unexposed and processed samples of this invention also exhibiting superior storage stability, compared to the comparative samples.

Example 3

Preparation of Photothermographic Material Sample

Photothermographic material samples No. 201 through 230 were prepared in accordance with the following procedure.

Surface Treatment of Support

Both sides of a blue-tinted, 175 μm thick polyethylene terephthalate film exhibiting a density of 0.160 (measured by a densitometer, PDA-65, available from Konica Corp.) were subjected to corona discharge treatment at 8 $W/m^2 \cdot min$.

Preparation of Silver Halide Emulsion

In 900 ml of deionized water were dissolved 7.5 g of gelatin and 10 mg of potassium bromide. After adjusting the temperature and the pH to 35° C. and 3.0, respectively, 370 ml of an aqueous solution containing 74 g silver nitrate and an equimolar aqueous solution containing potassium bromide, potassium iodide (in a molar ratio of 98 to 2) and $1\times10^{-4}$ mol/mol Ag of iridium chloride were added over a period of 10 minutes by the controlled double-jet method, while the pAg was maintained at 7.7. Thereafter, 4-hydroxy-6-methyl-1,3,3a,7-tetraazaindene was added and the pH was adjusted to 5 using NaOH. There was obtained cubic silver iodobromide grains having an average grain size of 0.06 μm, a variation coefficient of the projection area equivalent diameter of 11 percent, and the proportion of the {100} face of 87 percent. The resulting emulsion was flocculated to remove soluble salts, employing a flocculating agent and after desalting, 0.1 g of phenoxyethanol was added and the pH and pAg were adjusted to 5.9 and 7.5, respectively to obtain silver halide emulsion A.

Preparation of Organic Silver Salt/Silver Halide Mixture

In 4720 ml water were dissolved 111.4 g of behenic acid, 83.8 g of arachidic acid and 54.9 g of stearic acid at 80° C. The, after adding 540.2 ml of 1.5M aqueous sodium hydroxide solution with stirring and further adding 6.9 ml of concentrated nitric acid, the solution was cooled to a temperature of 55° C. to obtain an aqueous organic acid sodium salt solution. To the solution were added the silver halide emulsion obtained above (equivalent to 0.038 mol silver) and 450 ml water and stirring further continued for 5 min., while maintained at a temperature of 55° C. Subsequently, 760 ml of 1M aqueous silver nitrate solution was added in 2 min. and stirring continued further for 20 min., then, the reaction mixture was filtered to remove aqueous soluble salts. Thereafter, washing with deionized water and filtration were repeated until the filtrate reached a conductivity of 2 μS/cm, and after subjecting to centrifugal dehydration, the reaction product was dried with heated air at 37° C. until no reduction in weight was detected to obtain a powdery organic silver salt and silver halide.

Preparation of Light Sensitive Emulsion-dispersing Solution

In 1457 g methyl ethyl ketone was dissolved 14.57 g of polyvinyl butyral powder (Butvar B-79, available from Monsanto Corp.) and further thereto was gradually added 500 g of the powdery organic silver salt with stirring by a dissolver type homogenizer. Thereafter, the mixture was dispersed using a media type dispersion machine (available from Gettzmann Corp.), which was packed 1 mm Zr beads (available from Toray Co. Ltd.) by 80%, at a circumferential speed of 13 m and for 3 min. Of a retention time with a mill to obtain photosensitive emulsion dispersing solution.

Preparation of Light Sensitive Layer Coating Solution Em-1A

To 500 g of the foregoing light sensitive emulsion-dispersing solution, 100 g of methyl ethyl ketone (hereinafter, also denoted simply as MEK) was added under a nitrogen gas stream and maintained at a temperature of 17° C., while stirring. After 30 min., 2.50 ml of a 10% methanol solution of bis(dimethylacetoamide)dibromobromate was added and stirred for 1 hr., then, 4 ml of a 10% methanol solution of calcium bromide was added and stirred for 15 min. Subsequently, 1.8 ml of a mixture solution of dye stabilizer-1 and potassium acetate (by weight ratio of 1:5, a 20 wt % methanol solution of the dye stabilizer-1) was added and stirred for 15 min. Next, 7 ml of a mixture solution of an infrared sensitizing dye, Dye-1 and dye stabilizer-2 (by weight ratio of 1:250, a 0.1% MEK solution of the sensitizing dye) was added and stirred for 1 hr.; then, the temperature was lowered to 13° C. and stirred further for 30 min. Further, 18 ml of a 0.2% methanol solution of dye stabilizer-3 was added. After 5 min., 48 g of polyvinyl butyral was added and sufficiently dissolved therein, while being maintained at 13° C. and then the following additives were added thereto to prepare a coating solution of the light sensitive layer, Em-1A. The foregoing procedure was carried out in a nitrogen gas stream.

| | |
|---|---|
| Desmodur N3300 (aliphatic isocyanate, available from Movey Co.) | 1.10 g |
| Antifoggant [2-(tribromomethylsulfonyl)-pyridine] | 1.55 g |
| 1,1-bis(2-hydroxy-3,5-dimethylphenyl)-2-methylpropane | 15 g |
| Tetrachlorophthalic acid | 0.5 g |
| 4-Methylphthalic acid | 0.5 g |
| Infrared dye in amount giving an absorbance of 0.9 at the maximum absorption of the overall light sensitive layer. | |

Preparation of Light Sensitive Layer Coating Solution Em-1B

Coating solution EM-1B of the light sensitive layer was prepared similarly to coating solution Em-1A, except that after adding 100 g MEK to 500 g of light sensitive emulsion-dispersing solution with maintaining the temperature at 17° C., the emulsion was chemically ripened for 30 min. by adding $8\times10^{-4}$ mol/mol Ag of sodium thiosulfate (0.25% methanol solution).

Preparation of Coating Solutions Em-1C through Em-1H

Coating solutions of the light sensitive layer, Em-1C through Em-1H were each prepared similarly to coating solution Em-1B, except that the chemical sensitizer was replaced by chalcogen sensitizers, with respect to the kind or its amount, as shown in Tables 2-1 to 2-4.

Preparation of Coating Solution Em-2A

Coating solution Em-2A was prepared similarly to coating solution Em-1A, except that a comparative maximum density-enhancing agent-1 of $3\times10^{-4}$ mol/mol Ag (10 wt % methanol solution) was added.

Preparation of Coating Solutions Em-2B through Em-2H

Coating solutions of the light sensitive layer, Em-2B through Em-2H were each prepared similarly to coating solution Em-2A, except that chalcogen sensitizers were added, maximum density-enhancing agent-1 was replaced by maximum density-enhancing agents of formula (2) and antifoggants of formula (3) were further added, as shown in Tables 1 to 4.

Preparation of Coating Solution Em-3A

To 500 g of the foregoing light sensitive emulsion-dispersing solution, 100 g of methyl ethyl ketone (hereinafter, also denoted simply as MEK) was added under a nitrogen gas stream and maintained at a temperature of 17° C., while stirring. Then, 4 ml of a 0.2% methanol solution of potassium thiocyanate and 2 ml of a 0.1% methanol solution of chloroauric acid were added thereto and stirred 90 min., then, 4 ml of a 10% methanol solution of calcium bromide was added and stirred for 15 min. Subsequently, 1.8 ml of a mixture solution of dye stabilizer-1 and potassium acetate (by weight ratio of 1:5, a 20 wt % methanol solution of the dye stabilizer-1) was added and stirred for 15 min. Next, 7 ml of a mixture solution of an infrared sensitizing dye, Dye-1 and dye stabilizer-2 (by weight ratio of 1:250, a 0.1% MEK solution of the sensitizing dye) was added and stirred for 1 hr.; then, the temperature was lowered to 13° C. and stirred further for 30 min. Further, 18 ml of a 0.2% methanol solution of dye stabilizer-3 was added. After 5 min., 48 g of polyvinyl butyral was added and sufficiently dissolved therein, while being maintained at 13° C. and then the following additives were added thereto to prepare a coating solution of the light sensitive layer, Em-3A. The foregoing procedure was carried out in a nitrogen gas stream.

| | |
|---|---|
| Desmodur N3300 (aliphatic isocyanate, available from Movey Co.) | 1.10 g |
| Antifoggant [2-(tribromomethylsulfonyl)-pyridine] | 1.55 g |
| 1,1-bis(2-hydroxy-3,5-dimethylphenyl)-2-methylpropane | 15 g |
| Tetrachlorophthalic acid | 0.5 g |
| 4-Methylphthalic acid | 0.5 g |
| Infrared dye in amount giving an absorbance of 0.9 at the maximum absorption of the overall light sensitive layer. | |

Preparation of Coating Solution Em-3B

A coating solution of the light sensitive layer, Em-3B was prepared similarly to coating solution Em-3A, except that after adding 4 ml of a 0.2% methanol solution of potassium thiocyanate and 2 ml of a 0.1% methanol solution of chloroauric acid, $6\times10^{-4}$ mol/mol Ag of sodium thiosulfate, the emulsion was chemically ripened for 30 min. by adding $8\times10^{-4}$ mol/mol Ag of sodium thiosulfate (0.25% methanol solution) and a MEK solution of a compound of formula (3) was added, as shown in Tables 2-1 to 2-4.

Preparation of Coating Solution Em-3C through Em-3G

Coating solutions of the light sensitive layer, Em-3C through 3G were prepared similarly to coating solution Em-3b, except that the chalcogen sensitizer and antifoggant of formula (3) were varied with respect to the kind and its amount, as shown in Table 2-3 and 2-4.

Preparation of coating Solution Em-4A

A coating solution of the light sensitive layer, Em-4A was prepared similarly to coating solution Em-3A, except that a comparative maximum density-enhancing agent-1 of $3\times10^{-4}$ mol/mol Ag (10 wt % methanol solution) was added.

Preparation of Coating Solutions Em-4B through Em-4G

Coating solutions Em-4B through Em-4G were prepared similarly to coating solution Em-4B, except that the chalcogen sensitizer and antifoggant of formula (3) were varied with respect to the kind and its amount, and the comparative maximum density-enhancing agent was replaced by maximum density-enhancing agents of formula (2) with respect to its kind and amount, as shown in Table 2-2 and 2-4.

Preparation of Coating Solution Em-5A

To 500 g of the light sensitive emulsion-dispersing solution which was prepared similarly to foregoing light sensitive emulsion, except that the preparation of a mixture of an organic silver salt and silver halide was varied as below, 100 g of methyl ethyl ketone (hereinafter, also denoted simply as MEK) was added in a nitrogen gas stream and maintained at a temperature of 17° C., while stirring. After 30 min., an antifoggant of formula (3) was added, as shown in Table 4. Subsequently, 1.8 ml of a mixture solution of dye stabilizer-1 and potassium acetate (by weight ratio of 1:5, a 20 wt % methanol solution of the dye stabilizer-1) was added and stirred for 15 min. Next, 7 ml of a mixture solution of an infrared sensitizing dye, Dye-1 and dye stabilizer-2 (by weight ratio of 1:250, a 0.1% MEK solution of the sensitizing dye) was added and stirred for 1 hr.; then, the temperature was lowered to 13° C. and stirred further for 30 min. Further, 18 ml of a 0.2% methanol solution of dye stabilizer-3 was added. After 5 min., 48 g of polyvinyl butyral was added and sufficiently dissolved therein, while being maintained at 13° C. and then the following additives were added thereto to prepare a coating solution of the light sensitive layer, Em-3A. The foregoing procedure was carried out in a nitrogen gas stream.

| | |
|---|---|
| Desmodur N3300 (aliphatic isocyanate, available from Movey Co.) | 1.10 g |
| Antifoggant [2-(tribromomethylsulfonyl)-pyridine] | 1.55 g |
| 1,1-bis(2-hydroxy-3,5-dimethylphenyl)-2-methylpropane | 15 g |
| Tetrachlorophthalic acid | 0.5 g |
| 4-Methylphthalic acid | 0.5 g |
| Infrared dye in amount giving an absorbance of 0.9 at the maximum absorption of the overall light sensitive layer. | |
| Maximum density-enhancing agent,as shown in table 2-4 | |

Preparation of Organic Silver Salt/Silver Halide Mixture

In 4720 ml water were dissolved 111.4 g of behenic acid, 83.8 g of arachidic acid and 54.9 g of stearic acid at 80° C. The, after adding 540.2 ml of 1.5M aqueous sodium hydroxide solution with stirring and further adding 6.9 ml of concentrated nitric acid, the solution was cooled to a temperature of 55° C. to obtain an aqueous organic acid sodium salt solution. To the solution were added the silver halide emulsion obtained above (equivalent to 0.038 mol silver), 450 ml water and a chalcogen sensitizer of formula (1-1) or (1-2), as shown in Table 2-1, and stirring further continued for 5 min., while maintained at a temperature of 55° C. Subsequently, 760 ml of 1M aqueous silver nitrate solution was added in 2 min. and stirring continued further for 20 min., then, the reaction mixture was filtered to remove aqueous soluble salts. Thereafter, washing with deionized water and filtration were repeated until the filtrate reached a conductivity of 2 $\mu$S/cm, and after subjecting to centrifugal dehydration, the reaction product was dried with heated air at 37° C. until no reduction in weight was detected to obtain a powdery mixture of an organic silver salt and silver halide.

Preparation of Coating Solutions Em-5B through Em-5D

Coating solution of the light sensitive layer, Em-5B through Em-5D were prepared similarly to coating solution Em-5A, except that in the preparation of a mixture of an organic silver salt and silver halide, the amount of the chalcogen sensitizer of formula (1-1) or (2-2) was varied as shown in Table 4; and after adding 100 g MEK to 500 g of the light sensitive emulsion in a nitrogen gas stream while stirring and being maintained at 17° C., an antifoggant of formula (3) and a maximum density-enhancing agent of formula (2) were varied with respect of their amounts, as shown in Table 2-4.

Dye stabilizer-1

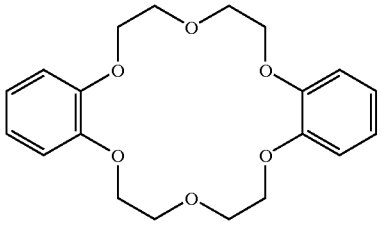

Dye stabilizer-2

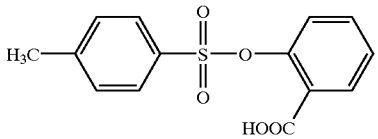

Dye stabilizer-3

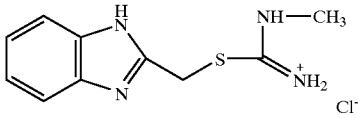

-continued

Dye-1

(810 nm)

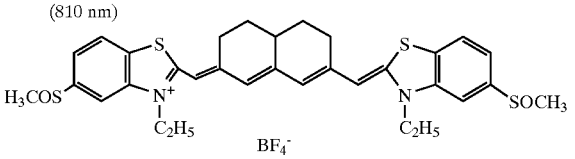

Infrared dye

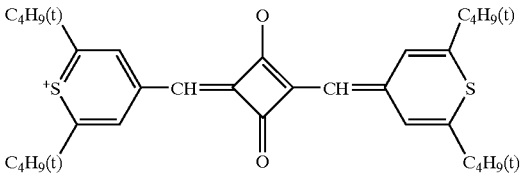

(MDEA-1)

Maximum density-enhancing agent-1

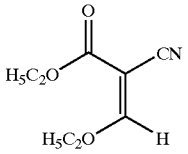

Using the thus prepared coating solutions of the light sensitive later, two, upper and lower light sensitive layers were coated on the support described earlier and dried to prepare photothermographic material samples No. 201 to 230. The combination of coating solutions of the upper and lower light sensitive layers are in Tables 2-1 to 2-4.

TABLE 2

| Sample No. | Light Sensitive Layer | Emulsion | Chalcogen Sensitizer (mol/mol Ag) | Silver-saving Agent (mol/mol Ag) | Antifoggant (mol/mol Ag) | Remark |
|---|---|---|---|---|---|---|
| 1 | Upper | Em-1A | — | — | — | Comp. |
| | Lower | Em-1A | — | — | — | |
| 2 | Upper | Em-1B | $Na_2S_2O_3$ ($6.0 \times 10^{-4}$) | — | — | Comp. |
| | Lower | Em-2A | — | — | — | |
| 3 | Upper | Em-2A | — | MDEA-1*1 ($3.0 \times 10^{-4}$) | — | Comp. |
| | Lower | Em-2A | — | MDEA-1 ($3.0 \times 10^{-4}$) | — | |
| 4 | Upper | Em-1B | $Na_2S_2O_3$ ($6.0 \times 10^{-4}$) | — | — | Comp. |
| | Lower | Em-2A | — | MDEA-1 ($3.0 \times 10^{-4}$) | — | |
| 5 | Upper | Em-1B | $Na_2S_2O_3$ ($6.0 \times 10^{-4}$) | — | — | Inv. |
| | Lower | Em-2B | $Na_2S_2O_3$ ($6.0 \times 10^{-4}$) | 2-3 ($3.0 \times 10^{-2}$) | 3-6 ($1.0 \times 10^{-5}$) | |
| 6 | Upper | Em-1C | $S_8$ ($3.0 \times 10^{-4}$) | — | — | Inv. |
| | Lower | Em-2C | $S_8$ ($3.0 \times 10^{-4}$) | 2-7 ($3.0 \times 10^{-2}$) | 3-9 ($1.0 \times 10^{-5}$) | |
| 7 | Upper | Em-1D | 1-8 ($8.0 \times 10^{-4}$) | — | — | Inv. |
| | Lower | Em-2D | 1-8 ($8.0 \times 10^{-4}$) | 2-34 ($3.0 \times 10^{-2}$) | 3-12 ($1.0 \times 10^{-5}$) | |
| 8 | Upper | Em-1E | 1-8 ($1.2 \times 10^{-3}$) | — | — | Inv. |
| | Lower | Em-2E | 1-8 ($1.2 \times 10^{-3}$) | 2-17 ($3.0 \times 10^{-2}$) | 3-6 ($1.0 \times 10^{-5}$) | |
| 9 | Upper | Em-1F | 1-13 ($6.0 \times 10^{-4}$) | — | — | Inv. |
| | Lower | Em-2F | 1-13 ($6.0 \times 10^{-4}$) | 2-11 ($3.0 \times 10^{-2}$) | 3-5 ($1.0 \times 10^{-5}$) | |
| 10 | Upper | Em-1G | 1-27 ($1.2 \times 10^{-3}$) | — | — | Inv. |
| | Lower | Em-2G | 1-27 ($1.2 \times 10^{-3}$) | 2-14 ($3.0 \times 10^{-2}$) | 3-10 ($1.0 \times 10^{-5}$) | |
| 11 | Upper | Em-1H | 1-28 ($1.0 \times 10^{-3}$) | — | — | Inv. |
| | Lower | Em-2H | 1-28 ($1.0 \times 10^{-3}$) | 2-35 ($3.0 \times 10^{-2}$) | 3-18 ($1.0 \times 10^{-5}$) | |
| 12 | Upper | Em-1A | — | — | — | Comp. |
| | Lower | Em-4A | — | MDEA-1*1 ($3.0 \times 10^{-2}$) | 3-6 ($1.0 \times 10^{-5}$) | |
| 13 | Upper | Em-1B | $Na_2S_2O_3$ ($6.0 \times 10^{-4}$) | — | — | Inv. |
| | Lower | Em-4B | $Na_2S_2O_3$ ($6.0 \times 10^{-4}$) | 2-3 ($3.0 \times 10^{-2}$) | 3-9 ($1.0 \times 10^{-5}$) | |
| 14 | Upper | Em-1C | $S_8$ ($3.0 \times 10^{-4}$) | — | — | Inv. |
| | Lower | Em-4C | $S_8$ ($3.0 \times 10^{-4}$) | 2-7 ($3.0 \times 10^{-2}$) | 3-12 ($1.0 \times 10^{-5}$) | |
| 15 | Upper | Em-1D | 1-8 ($8.0 \times 10^{-4}$) | — | — | Inv. |
| | Lower | Em-4D | 1-8 ($8.0 \times 10^{-4}$) | 2-34 ($3.0 \times 10^{-2}$) | 3-6 ($1.0 \times 10^{-5}$) | |
| 16 | Upper | Em-1E | 1-8 ($1.2 \times 10^{-3}$) | — | — | Inv. |
| | Lower | Em-4E | 1-8 ($1.2 \times 10^{-3}$) | 2-17 ($3.0 \times 10^{-2}$) | 3-5 ($1.0 \times 10^{-5}$) | |
| 17 | Upper | Em-1F | 1-13 ($6.0 \times 10^{-4}$) | — | — | Inv. |
| | Lower | Em-4F | 1-13 ($6.0 \times 10^{-4}$) | 2-11 ($3.0 \times 10^{-2}$) | 3-10 ($1.0 \times 10^{-5}$) | |

TABLE 2-continued

| Sample No. | Light Sensitive Layer | Emulsion | Chalcogen Sensitizer (mol/mol Ag) | Silver-saving Agent (mol/mol Ag) | Antifoggant (mol/mol Ag) | Remark |
|---|---|---|---|---|---|---|
| 18 | Upper | Em-1G | 1-28 ($1.0 \times 10^{-4}$) | — | — | Inv. |
| | Lower | Em-4G | 1-28 ($1.0 \times 10^{-4}$) | 2-14 ($3.0 \times 10^{-2}$) | 3-18 ($1.0 \times 10^{-5}$) | |
| 19 | Upper | Em-3A | — | — | — | Comp. |
| | Lower | Em-4A | — | MDEA-1*1 ($3.0 \times 10^{-2}$) | — | |
| 20 | Upper | Em-3B | $Na_2S_2O_3$ ($6.0 \times 10^{-4}$) | — | 3-6 ($1.0 \times 10^{-5}$) | Inv. |
| | Lower | Em-4B | $Na_2S_2O_3$ ($6.0 \times 10^{-4}$) | 2-3 ($3.0 \times 10^{-2}$) | 3-6 ($1.0 \times 10^{-5}$) | |
| 21 | Upper | Em-3C | $S_8$ ($3.0 \times 10^{-4}$) | — | 3-9 ($1.0 \times 10^{-5}$) | Inv. |
| | Lower | Em-4C | $S_8$ ($3.0 \times 10^{-4}$) | 2-7 ($3.0 \times 10^{-2}$) | 3-9 ($1.0 \times 10^{-5}$) | |
| 22 | Upper | Em-3D | 1-8 ($8.0 \times 10^{-4}$) | — | 3-12 ($1.0 \times 10^{-5}$) | Inv. |
| | Lower | Em-4D | 1-8 ($8.0 \times 10^{-4}$) | 2-34 ($3.0 \times 10^{-2}$) | 3-12 ($1.0 \times 10^{-5}$) | |
| 23 | Upper | Em-3E | 1-8 ($1.2 \times 10^{-3}$) | — | 3-6 ($1.0 \times 10^{-5}$) | Inv. |
| | Lower | Em-4E | 1-8 ($1.2 \times 10^{-3}$) | 2-17 ($3.0 \times 10^{-2}$) | 3-6 ($1.0 \times 10^{-5}$) | |
| 24 | Upper | Em-3F | 1-13 ($6.0 \times 10^{-4}$) | — | 3-5 ($1.0 \times 10^{-5}$) | Inv. |
| | Lower | Em-4F | 1-13 ($6.0 \times 10^{-4}$) | 2-11 ($3.0 \times 10^{-2}$) | 3-5 ($1.0 \times 10^{-5}$) | |
| 25 | Upper | Em-3G | 1-28 ($1.0 \times 10^{-4}$) | — | 3-10 (0.03) | Inv. |
| | Lower | Em-4G | 1-28 ($1.0 \times 10^{-4}$) | 2-34 ($3.0 \times 10^{-2}$) | 3-10 ($1.0 \times 10^{-5}$) | |
| 26 | Upper | Em-3E | 1-8 ($1.2 \times 10^{-3}$) | — | 3-18 (0.03) | Inv. |
| | Lower | Em-4B | $Na_2S_2O_3$ ($6.0 \times 10^{-4}$) | 2-3 ($3.0 \times 10^{-2}$) | 3-18 ($1.0 \times 10^{-5}$) | |
| 27 | Upper | Em-3F | 1-13 ($6.0 \times 10^{-4}$) | — | 3-6 (0.03) | Inv. |
| | Lower | Em-4C | 1-27 ($1.0 \times 10^{-4}$) | 2-7 ($3.0 \times 10^{-2}$) | 3-6 ($1.0 \times 10^{-5}$) | |
| 28 | Upper | Em-3G | 1-28 ($1.0 \times 10^{-4}$) | — | 3-6 (0.03) | Inv. |
| | Lower | Em-4D | 1-8 ($1.2 \times 10^{-3}$) | 2-34 ($3.0 \times 10^{-2}$) | 3-6 ($1.0 \times 10^{-5}$) | |
| 29 | Upper | Em-5A | 1-8 ($1.2 \times 10^{-3}$) | — | — | Inv. |
| | Lower | Em-5B | — | 2-3 ($3.0 \times 10^{-2}$) | 3-12 ($1.0 \times 10^{-9}$) | |
| 30 | Upper | Em-5C | 1-8 ($1.2 \times 10^{-5}$) | — | 3-12 ($1.0 \times 10^{-9}$) | Inv. |
| | Lower | Em-5D | 1-8 ($0.4 \times 10^{-5}$) | 2-3 ($3.0 \times 10^{-2}$) | 3-12 ($1.0 \times 10^{-9}$) | |

*1Maximum density-enhancing agent-1

2-3

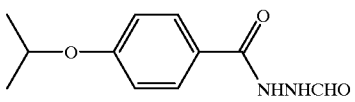

2-7

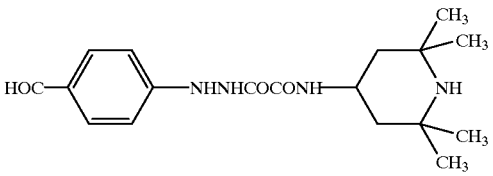

2-11

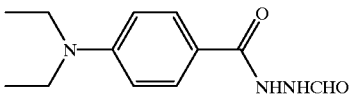

2-14

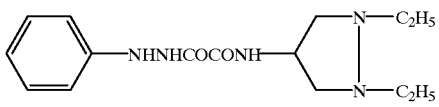

2-17

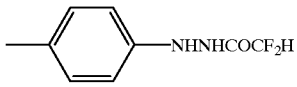

2-34

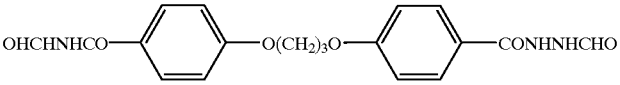

2-35

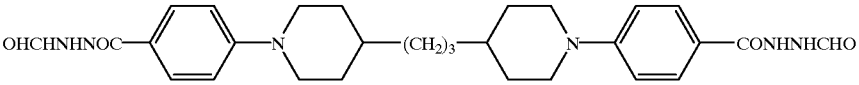

Preparation of Surface Protective Layer Coating Solution

In 865 g MEK were dissolved with stirring 96 g of cellulose acetate-butyrate (CAV 171-15, available from Eastman Chemical Co.), 4.5 g of polymethyl methacrylic acid (Paraloid A-21, Rohm & Haas Co.). 4.5 g of vinylsulfone compound HD-21, 1.0 g of benztriazole and 1.0 g of fluorinated surfactanr (Surflon KH 40, available from ASAHI Glass Co., Ltd.). Then, 30 g of the matting agent dispersion and 15 of phthalazinone were added with stirring to obtain a coating solution of the surface protective layer.

HD-21: 1,3-bis(vinylsulfonyl)-2-hydroxypropane

Preparation of Matting Agent Dispersion

In 42.5 g MEK was dissolved cellulose acetate-butyrate (CAB 171-15, available from Eastman Chemical Co.) and further thereto, 5 g of calcium carbonate (Super-Pflex 200, available from Special Minerals Co.) was added and dispersed using a dissolver type homogenizer at 8000 rpm for 30 min. to obtain a matting agent dispersion.

Preparation of Backing Layer Coating Solution

To 830 g of methyl ethyl ketone (hereinafter, also denoted as MEK), 84.2 g of cellulose acetate-butylate (CAB381-20, available from Eastman Chemical Co.) and 4.5 g of polyester resin (Vitel PE2200B, available from Bostic Corp.) were added with stirring and dissolved therein. To the resulting solution was added a dye was added so that the absorbance at the maximum absorption was o.35 and 4.5 g fluorinated surfactant (Surflon KH40, available from ASAHI Glass Co. Ltd.) and 2.3 g fluorinated surfactant (Megafag F120K, available from DAINIPPON INK Co. Ltd.) which were dissolved in 43.2 g methanol, were added thereto and stirred until being dissolved. Then, 75 g of silica (Siloid 64X6000, available from W. R. Grace Corp.), which was dispersed in methyl ethyl ketone in a concentration of 1 wt % using a dissolver type homogenizer, was further added thereto with stirring to obtain a coating solution for backing layer.

Coating of Light Sensitive Layer Side

Using an extrusion coater, the foregoing light-sensitive layer coating solution and surface protective layer coating solution were simultaneously coated so that the lower light sensitive layer, the upper light sensitive layer and a protective layer was formed in this order from the support to obtain photothermographic material samples No. 1 through 30, in which the silver coverage of the lower and upper light sensitive layers 0.6 and 0.5 g/m$^2$, respectively and the dry thickness of the protective layer was 1.45 $\mu$m. Drying was conducted using dried air at a drying temperature of 75° C. and a dew point of 10° C. over a period of 5 min.

Coating of Backing Layer

The thus prepared coating solution for a backing layer was coated on the back side of each of samples 1 through 5 by an extrusion coater and dried so as to have dry thickness of 3.5 $\mu$m. Drying was carried out at a dry-bulb temperature of 100° C. and a wet-bulb temperature of 10° C. over a period of 5 min.

Evaluation of Photothermographic Material

The thus prepared photothermographic materials Nos. 201 through 230 were evaluated with respect to characteristics, according to the following procedure.

Sensitometry

The photothermographic materials each were cut to a size of 14×17 inch and imagewise exposed to 810 nm semiconductor laser, in which the angle between the exposed surface and the laser beam was 800, the laser power was 75 mW, the high frequency overlapping was outputted at a longitudinally multiple mode and the exposure time was $1\times10^{-7}$ sec. Thermal processing was carried out by homogeneously heating using a heated drum at 126° C. for 13 sec. The thus processed photothermographic materials were subjected to densitometry using an optical densitometer (PD-82, available from Konica Corp.) to prepare a characteristic curve comprised of density (D) and exposure (Log E) to determine the minimum density (or fog density) and sensitivity. Sensitivity was represented by a relative value of the reciprocal of exposure giving a density of the minimum density plus 1.0, based on the sensitivity of Sample No. 201 being 100. The photographic characteristic value, $\gamma$ represents a slope of the characteristic curve (or gradation). Thus, the $\gamma$ value is represented by a relative value of a slope of a straight line connecting two points corresponding to a density of 0.25 and a density of 2.0, based on the $\gamma$ of Sample No. 201 being 100.

Evaluation of Silver Tone

Processed samples were visually evaluated with respect to developed silver color in image areas, based on the following criteria:

A: black, superior tone

B: brownish black

C: yellow, unacceptable level.

Evaluation of Storage Stability

Photothermographic material samples were sealed in a light-shielded vessel, the interior of which was maintained at 25° C. and 55% RH and allowed to stand at 50° C. for 7 days. This aging is designated as accelerated aging. For comparison, the photothermographic material samples were also allowed to stand in the light-shielded vessel at 25° C. and 55% RH for 7 days, and this aging was designated as comparative aging. The thus aged samples were exposed and thermally processed similarly to the foregoing evaluation of sensitivity and fog, and the density of fogging areas was measured, based on the following equation:

Increment of fog density=(fog density at accelerated aging)−(fog density at comparative aging)

The thus measured increment of fog density was designated as a measure for storage stability of the photothermographic material. The increment was relative value, based on the increment of Sample No. 1 being 100.

Obtained results are in Table 3.

TABLE 3

| Sample No. | Fog | Sensitivity | $\gamma$ | Silver Tone | Storage Stability | Remark |
|---|---|---|---|---|---|---|
| 201 | 100 | 100 | 3.4 | B | 100 | Comp. |
| 202 | 119 | 104 | 8.0 | C | 126 | Comp. |
| 203 | 123 | 85 | 12.0 | C | 132 | Comp. |
| 204 | 112 | 87 | 8.0 | C | 139 | Comp. |
| 205 | 95 | 115 | 3.5 | A | 96 | Inv. |
| 206 | 94 | 116 | 3.5 | A | 95 | Inv. |
| 207 | 90 | 120 | 3.5 | A | 88 | Inv. |
| 208 | 92 | 129 | 3.6 | A | 89 | Inv. |
| 209 | 93 | 126 | 3.6 | A | 91 | Inv. |
| 210 | 96 | 125 | 3.6 | A | 92 | Inv. |
| 211 | 95 | 121 | 3.7 | A | 91 | Inv. |
| 212 | 124 | 88 | 8.0 | C | 142 | Comp. |
| 213 | 96 | 120 | 3.5 | A | 94 | Inv. |
| 214 | 95 | 121 | 3.5 | A | 90 | Inv. |
| 215 | 91 | 125 | 3.6 | A | 88 | Inv. |
| 216 | 93 | 132 | 3.6 | A | 90 | Inv. |
| 217 | 95 | 129 | 3.6 | A | 91 | Inv. |
| 218 | 97 | 127 | 3.5 | A | 91 | Inv. |
| 219 | 125 | 91 | 8.0 | C | 145 | Comp. |
| 220 | 89 | 126 | 3.5 | A | 85 | Inv. |
| 221 | 88 | 127 | 3.5 | A | 82 | Inv. |
| 222 | 83 | 138 | 3.6 | A | 78 | Inv. |
| 223 | 84 | 140 | 3.6 | A | 79 | Inv. |

TABLE 3-continued

| Sample No. | Fog | Sensitivity | γ | Silver Tone | Storage Stability | Remark |
|---|---|---|---|---|---|---|
| 224 | 84 | 139 | 3.6 | A | 80 | Inv. |
| 225 | 86 | 133 | 3.5 | A | 83 | Inv. |
| 226 | 86 | 141 | 3.6 | A | 81 | Inv. |
| 227 | 84 | 140 | 3.6 | A | 78 | Inv. |
| 228 | 86 | 135 | 3.6 | A | 78 | Inv. |
| 229 | 82 | 140 | 3.6 | A | 81 | Inv. |
| 230 | 83 | 142 | 3.7 | A | 77 | Inv. |

As apparent from Table 3, the inventive samples exhibited minimized fogging, sufficiently enhanced sensitivity, improved silver image tone and superior gradation, and also indicating superiority as a photographic material for medical use and photothermographic material superior in storage stability, as compared to comparative samples. It was also proved that the inventive samples exhibited a hue angle ($h_{ab}$) within the range of 190° to 260° (i.e., $190° < h_{ab} < 260°$).

What is claimed is:

1. A silver salt photothermographic material comprising on at least one side of a support at least two light-sensitive layers and at least one light insensitive layer, the light-sensitive layers comprising organic silver salt grains, a light-sensitive emulsion containing light-sensitive silver halide grains and a medium, a reducing agent and a binder, wherein at least one of the light-sensitive layers contains a silver-saving agent and wherein the photothermographic material after being subjected to imagewise exposure and thermal development at 123° C. for 13.5 sec. exhibits an average contrast of 2.0 to 6.0 within the density range of 0.25 to 2.0 on a characteristic curve of the photothermographic material after imagewise exposure and thermal development.

2. The photothermographic material of claim 1, wherein the silver-saving agent is a hydrazine compound represented by formula (H), a vinyl compound represented by formula (G) or an onium compound represented by formula (P):

formula (H)

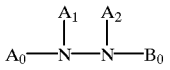

wherein $A_0$ is an aliphatic group, an aromatic group, a heterocyclic group or —$G_0$—$D_0$ group; $E_0$ is a blocking group; $A_1$ and $A_2$ are both hydrogen atoms, or one of $A_1$ and $A_2$ is a hydrogen atom and the other is an acyl group, a sulfonyl group or an oxalyl group, in which $G_0$ is a —CO—, —COCO—, —CS—, —C(=N$G_1D_1$)—, —SO—, —$SO_2$— or —P(O)($G_1D_1$)— group, in which $G_1$ is a bond, or a —O—, —S— or —N($D_1$)— group, and $D_1$ is a hydrogen atom, or an aliphatic group, aromatic group or heterocyclic group, provided that when a plural number of $D_1$ are present , they may be the same with or different from each other and $D_0$ is an aliphatic group, an aromatic group, a heterocyclic group, an amino group, an alkoxy group, an aryloxy group, an alkylthio group or an arylthio group;

formula (G)

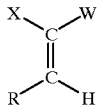

wherein X is an electron-withdrawing group W is a hydrogen atom, an alkyl group, an alkenyl group, an alkynyl group, an aryl group, a heterocyclic group, a halogen atom, an acyl group, a thioacyl group, an oxalyl group, an oxyoxalyl group, a thiooxalyl group, an oxamoyl group, an oxycarbonyl group, a thiocarbonyl group, a carbamoyl group, a thiocarbonyl group, a sulfonyl group, a sulfinyl group, an oxysulfinyl group, a thiosulfinyl group, a sulfamoyl group, an oxysulfinyl group, a thiosulfinyl group, a sulfinamoyl group, a phosphoryl group, nitro group, an imino group, a N-carbonylimino group, a N-sulfonylimino group, a dicyanoethylene group, an ammonium group, a sulfonium group, a phosphonium group, pyrylium group, or an inmonium group; R is a halogen atom, hydroxy or its organic or inorganic salt, an alkoxy group, an aryloxy group, a heterocyclic-oxy group, an alkenyloxy group, an acyloxy group, an alkoxycarbonyloxy group, an aminocarbonyloxy group, a mercapto group or its organic or inorganic salt, an alkylthio group, an arylthio group, a heterocyclic-thio group, an alkenylthio group, an acylthio group, an alkoxycarbonylthio group, an aminocarbonylthio group, an amino group, a cyclic amino group, an acylamino group, an oxycarbonylamino group, a heterocyclic group, a ureido group, or a sulfonamido group, provided that X and W, or X and R may combine together with each other to form a ring;

formula (P)

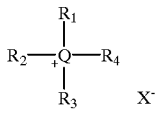

wherein Q is a nitrogen atom or a phosphorus atom; $R_1$, $R_2$, $R_3$ and $R_4$ each are a hydrogen atom or a substituent, provided that $R_1$, $R_2$, $R_3$ and $R_4$ may combine with each other to form a ring; and $X^-$ is an anion.

3. The photothermographic material of claim 1, wherein the silver-saving agent is contained in an amount of $10^{-5}$ to 1 mol per mol of the organic silver salt.

4. The photothermographic material of claim 1, wherein the total coating weight of silver is 0.7 to 1.2 g/$m^2$.

5. The photothermographic material of claim 1, wherein said light-sensitive layers are provided on one side of the support.

6. The photothermographic material of claim 1, wherein one of said light-sensitive layers is provided on one side of the support and the other of said light-sensitive layers is provided on the other side of the support.

7. The photothermographic material of claim 1, wherein the light sensitive silver halide grains have been chemically sensitized with a chalcogen sensitizer.

8. The photothermographic material of claim 7, wherein the chalcogen sensitizer is at least one selected from compounds represented by the following formula (1-1) or (1-2):

formula (1-1)

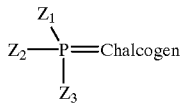

wherein $Z_1$, $Z_2$ and $Z_3$ each represent an aliphatic group, an aromatic group, a heterocyclic group, —$OR_7$, —$NR_8(R_9)$, —$SR_{10}$, —$SeR_{11}$, a halogen atom or a hydrogen atom, in which $R_7$, $R_{10}$ and $R_{11}$ each represent an aliphatic group, an aromatic group, a heterocyclic group or a cation and $R_8$ and $R_9$ each represent an aliphatic group, an aromatic group, a heterocyclic group or a hydrogen atom, provided that $Z_1$ and $Z_2$, $Z_2$ and $Z_3$, or $Z_3$ and $Z_1$ may combine with each other to form a ring; "Chalcogen" represents a sulfur atom, selenium atom or a tellurium atom; and P is a phosphorus atom;

formula (1-2)

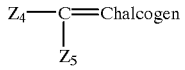

wherein $Z_4$ and $Z_5$ each represent an alkyl group, an alkenyl group, an aralkyl group, an aryl group, a heterocyclic group, —$NR_1(R_2)$, —$OR_3$ or —$SR_4$, in which $R_1$ and $R_2$ each represent a hydrogen atom, an acyl group, an alkyl group, an aralkyl group, aryl group or a heterocyclic group, and $R_3$ and $R_4$ each represent an alkyl group, an aralkyl group, an aryl group or a heterocyclic group, provided that $Z_4$ and $Z_5$ may combine with each other to form a ring; and "Chalcogen" represents a sulfur atom, selenium atom or a tellurium atom.

9. The photothermographic material of claim 8, wherein one of the light sensitive layers contains a compound represented by the following formula (3):

$$R_1—(S)m—(SO_2)n—R_2 \qquad \text{formula (3)}$$

wherein $R_1$ and $R_2$ each represent an aliphatic group, aromatic group, a heterocyclic group, —$SO_2$—$R_3$, in which $R_3$ is the same as defined in $R_1$ or an atomic group capable of forming a ring by the combination with each other; m is an integer of 1 to 6; and n is 0 or 1.

10. The photothermographic material of claim 1, wherein at least one of the light insensitive layers contains at least two compounds capable of generating, upon exposure to ultraviolet or visible radiation, a labile species capable of oxidizing silver or a labile species capable of deactivating a reducing agent to inhibit reduction of an organic silver salt to silver by the reducing agent.

11. The photothermographic material of claim 10, wherein said two compound each are represented by the following formulas [1] to [4]:

formula [1]

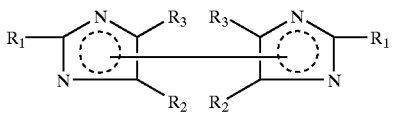

wherein $R_1$, $R_2$ and $R_3$ each are a hydrogen atom, an alkyl group, an alkenyl group, an alkoxy group, an aryl group, hydroxy group, a halogen atom, an aryloxyl group, an arylthio group, a heterocyclic group, an acyl group, a sulfonyl group, an acylamino group, sulfonylamino group, an acyloxy group, carboxy group, cyano group, a sulfo group, or an amino group;

formula [2]

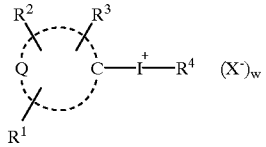

wherein Q is a group of atoms necessary to complete a 5-, 6-, or 7-membered ring, and the atoms being selected from a carbon atom, nitrogen atom, oxygen atom and sulfur atom; $R^1$, $R^2$ and $R^3$ each are a hydrogen atom, an alkyl group, an alkenyl group, an alkoxyl group, an aryl group, hydroxy, a halogen atom, an aryloxyl, an alkylthio group, an arylthio group, an acyl group, a sulfonyl group, an acylamino group, sulfonylamino group, an acyloxy group, a carboxy group, a cyano group, a sulfo group, or an amino group, provided that $R^1$, $R^2$ and $R^3$ may be bonded with each other to form a ring; $R^4$ is a carboxylate group or $O^-$; W is 0 or 1, provided that when $R^3$ is a sulfo group or a carboxy group, W is 0 and $R^4$ is $O^-$; $X^-$ is an anionic counter ion;

formula [3]

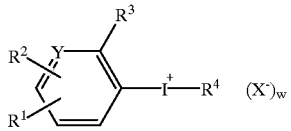

wherein $R^1$, $R^2$, $R^3$, $R^4$, $X^-$ and W are each the same as defined in formula [2]; Y represents —CH═ or —N═;

formula [4]

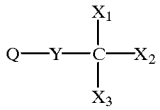

wherein Q is an aryl group or a heterocyclic group; $X_1$, $X_2$ and $X_3$ are each a hydrogen atom, a halogen atom, a haloalkyl group, an acyl group, an alkoxycarbonyl group, an aryloxycarbonyl group, a sulfonyl group, an aryl group or a heterocyclic group, provided that at least of them a halogen atom; and Y represents —C(═O)—, —SO— or —$SO_2$—.

12. The photothermographic material of claim 1, wherein the photothermographic material which has been subjected to thermal development exhibits a hue angle ($h_{ab}$) within the range of $190° < h_{ab} < 260°$.

13. The photothermographic material of claim 1, wherein when the photothermographic material which has been subjected to thermal development is placed on a viewing box provided with a white fluorescent lamp, a correlated color temperature of light transmitted through the photothermographic material is 5000 to 6000° K.

* * * * *